United States Patent [19]

Shiba et al.

[11] Patent Number: 4,942,114

[45] Date of Patent: Jul. 17, 1990

[54] SILVER HALIDE PHOTOGRAPHIC MATERIALS WITH REDUCIBLE BRIGHTENING AGENT RELEASER

[75] Inventors: Keisuke Shiba; Keizo Koya, both of Kanagawa, Japan

[73] Assignee: Fuji Photo Film Co., Ltd., Kanagawa, Japan

[21] Appl. No.: 189,003

[22] Filed: May 2, 1988

[30] Foreign Application Priority Data

Apr. 30, 1987 [JP] Japan ..... 62-106894

[51] Int. Cl.[5] ..... G03C 1/40; G03C 1/92

[52] U.S. Cl. ..... 430/434; 430/223; 430/359; 430/512; 430/517; 430/543; 430/564; 430/933; 430/955

[58] Field of Search ..... 430/505, 443, 493, 542, 430/544, 546, 564, 600, 603, 613, 955, 957, 958, 627, 223, 933, 543, 359, 517, 434

[56] References Cited

U.S. PATENT DOCUMENTS 3,617,291 11/1971 Sawdey ..... 430/553
4,551,423 11/1985 Koyama et al. ..... 430/559
4,729,936 3/1988 Kitaguchi et al. ..... 430/151
4,770,990 9/1988 Nakamura et al. ..... 430/564
4,774,181 9/1988 Ravindran et al. ..... 430/933
4,783,396 11/1988 Nakamura et al. ..... 430/223

FOREIGN PATENT DOCUMENTS 0220746 5/1987 European Pat. Off. .

*Primary Examiner*—Richard L. Schilling
*Attorney, Agent, or Firm*—Sughrue, Mion, Zinn, Macpeak & Seas

[57] ABSTRACT

A silver halide photographic material having at least one silver halide emulsion layer on a support, comprising a compound of formula (I):

$$\text{PWR—(Time)}_t\text{—FWA} \quad \text{(I)}$$

in which PWR represents a group capable of releasing $(\text{Time})_t$—FWA upon reduction; FWA represents a group which functions as a brightening agent; Time represents a group capable of releasing FWA through a reaction which follows the release of $(\text{Time})_t$—FWA from PWR; and t represents an integer of 0 or 1.

14 Claims, 1 Drawing Sheet

SILVER HALIDE PHOTOGRAPHIC MATERIALS WITH REDUCIBLE BRIGHTENING AGENT RELEASER

FIELD OF THE INVENTION

The present invention relates to a silver halide photographic material in which the steadiness of the shadow in the image formed and the density of the image formed have been improved and the selective whiteness of the non-image part has also been improved, and in particular, to a silver halide reflective photographic material which contains a functional brightening agent capable of selectively imparting fluorescent whiteness to the non-image part of the material during or after the image formation step.

BACKGROUND OF THE INVENTION

Hitherto, for the purpose of whitening the white background part of a reflective photographic material, a so-called brightening agent has been used in combination with a reflective support, such as a paper, a baryta paper or a film, a synthetic paper or a resin-coated paper containing an inorganic white pigment, for example, titanium dioxide, barium sulfate, magnesium oxide, etc. In addition, various techniques have been known to enhance the degree of whiteness by improving the brightening agent itself to be used or improving the method of dispersion of the brightening agent as well as the means of combination of this agent with particular polymers. For example, the descriptions in U.S. Pat. Nos. 3,269,840 and 3,684,729, Japanese Patent Publication Nos. 7127/59, 47371/80, 22089/82, 21372/85, and 30463/76, Japanese Patent Application (OPI) Nos. 126732/75, 147885/78, 134232/85, 111147/84, and 134833/80, etc. can be referred to. (The term "OPI as used herein means a "published unexamined Japanese patent application".) Especially preferred brightening agents are, for example, the compounds described in U.S. Pat. Nos. 2,632,701, 3,269,840, and 3,359,102, British Pat. Nos. 852,075 and 1,319,763, Japanese Patent Application (OPI) No. 32547/81, etc. Further, a means of combining a brightening agent with silver halide grains having a particular form has also been developed, which is described, for example, in Japanese Patent Application (OPI) No. 158436/85.

In the method of using such brightening agents, however, the brightening agent acts to brighten not only the non-image part but also the image part to thereby cause deterioration of the steadiness of the shadow part of the image formed and deterioration of the density of the image formed.

On the other hand, brightening agent-releasing type couplers are described, for example, in British Pat. No. 945,542, Japanese Patent Application (OPI) No. 109927/77, etc. Further, fluorescent couplers which may extinguish the fluorescence by coupling reaction with the oxidation product of a color developing agent are also known. These are described, for example, in Japanese Patent Publication No. 8750/72. However, these are defective because, when they are incorporated into raw photographic materials, the sharpness of the image formed is deteriorated, as described in Japanese Patent Publication No. 34933/80.

SUMMARY OF THE INVENTION

The object of the present invention is, therefore, to overcome the above-noted defects by using novel functional brightening agents.

Specifically, a first object of the present invention is to provide a silver halide photographic material in which the whiteness of the background white part has been improved by selective impartation of fluorescent whiteness in the non-image part.

A second object of the present invention is to provide a silver halide photographic material containing a functiona brightening agent which does not substantially impart fluorescent whiteness to raw photographic materials but can selectively impart fluorescent whiteness to only the non-image part in the material during or after image formation therein, so as to improve the whiteness of the background white part of the material. Other objects of the present invention will be apparent from the description of the specification.

The above-noted objects can be attained by incorporating a compound of the following formula (I), which can release a brightening agent by reduction, into a silver halide photographic material.

$$\text{PWR—(time)}_t\text{—FWA} \qquad \text{(I)}$$

wherein PWR represents a group capable of releasing $(\text{Time})_t$—FWA upon reduction; Time represents a group capable of releasing FWA through a reaction which follows the release of $(\text{Time})_t$—FWA from PWR; t represents an integer of 0 or 1; and FWA represents a group which functions as a brightening agent.

DETAILED DESCRIPTION OF THE INVENTION

Figure 1:
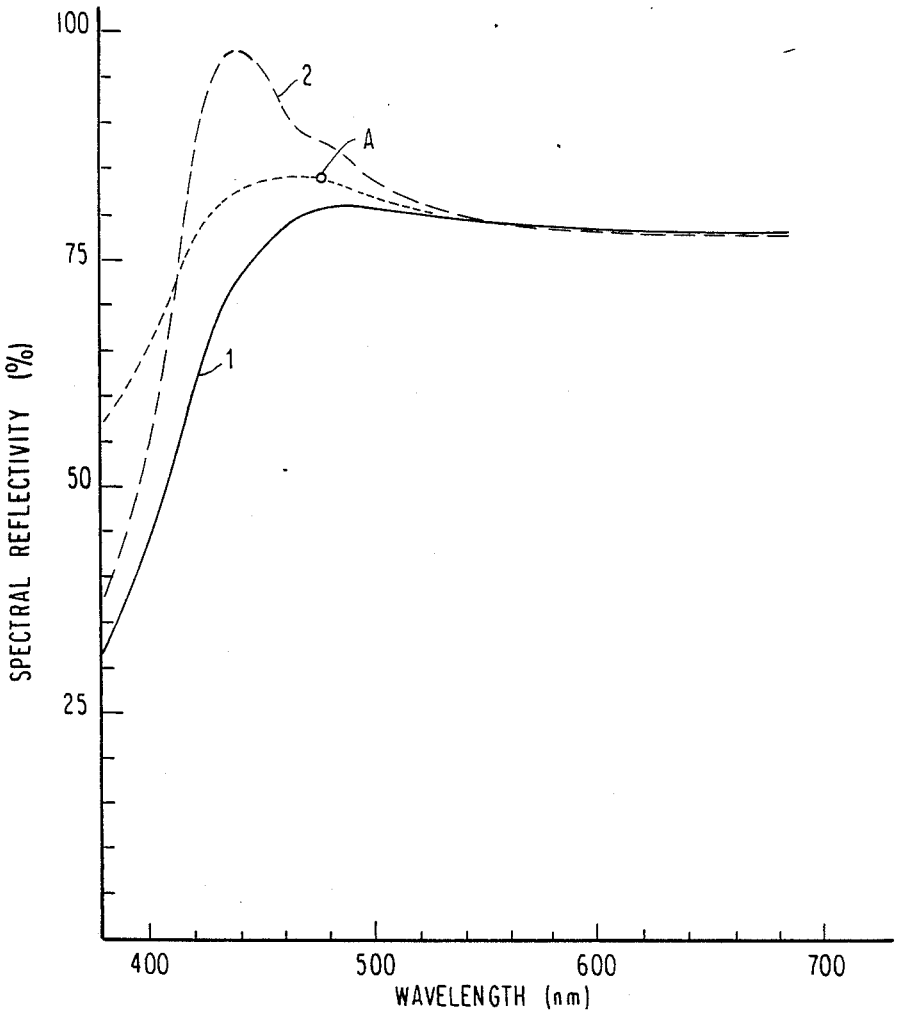
FIG. 1 is a graph showing the results of Example 1 of the invention.

PWR is described in detail hereinafter.

The group represented by PWR may be any of: (1) the group that corresponds to a moiety containing an electron accepting center and an intramolecular nucleophilic displacement center in a compound capable of releasing a photographic reagent through reduction followed by intramolecular nucleophilic displacement as disclosed in U.S. Pat. Nos. 4,139,379, 4,139,389 and 4,564,577 and Japanese Patent Application (OPI) No. 185333/84 and 84453/82 (the term "OPI" as used herein means "unexamined published Japanese Patent Application" ); (2) the group that corresponds to a moiety containing an electron accepting quinoid center and a carbon atom connecting the quinoid center to a photographic reagent in a compound capable of releasing a photographic reagent through reduction followed by intramolecular electron transfer as disclosed in U.S. Pat. No. 4,232,107, Japanese Patent Application (OPI) No. 101649/84, *Research Disclosure,* No. 24025, IV (1984), and Japanese Patent Application (OPI) No. 88257/86; (3) the group that corresponds to a moiety containing an aryl group substituted with an electron attractive group and an atom (a sulfur, carbon or nitrogen atom) connecting the substituted aryl group to a photographic reagent in a compound capable of releasing a photographic reagent through reduction followed by cleavage of its single bond as disclosed in West German Patent Application (OLS) No. 3,008,588, Japanese Patent Application (OPI) No. 142530/81, and U.S. Pat. Nos. 4,343,893 and 4,619,884; (4) the group that corresponds to a moiety containing a nitro group and a carbon atom connecting the nitro group to a photographic reagent in a nitro compound capable of releasing a photographic reagent after electron acceptance as disclosed in U.S. Pat. No. 4,450,223; and (5) the group that corresponds to a moiety containing a gem-dinitro group and a carbon atom connecting the dinitro group to a photographic reagent in a dinitro compound capable of $\beta$-eliminating a photographic reagent after electron acceptance as disclosed in U.S. Pat. No. 4,609,610.

The groups represented by $-(\text{Time})_t$ and FWA will be described later.

Of the compounds represented by formula (I), preferred are those represented by formula (II):

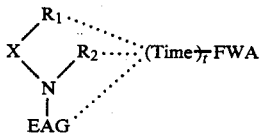

(II)

wherein X represents an oxygen atom, a sulfur atom or a nitrogen-containing group of formula $-N(R_3)-$; $R_1$, $R_2$, and $R_3$ each represents a mere bond or a group other than a hydrogen atom; EAG represents an electron accepting group; or $R_1$, $R_2$, $R_3$ and EAG are connected to each other to form a ring; Time represents a group capable of releasing FWA upon cleavage of the N—X bond through a reaction subsequent to the release from the rest of the compound in the form of $-(\text{Time})_t\text{FWA}$; FWA and t are as defined above; when t is 0, Time represents a mere bond; and the dotted lines represent possible bonds, provided that at least one dotted line is a bond.

In formula (II),

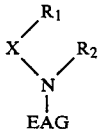

corresponds to PWR of formula (I). $(\text{Time})_t\text{FWA}$ is bonded to at least one of $R_1$ $R_2$, and EAG.

The group other than a hydrogen atom as represented by $R_1$, $R_2$, and $R_3$ includes a substituted or unsubstituted alkyl or aralkyl group (e.g., methyl, trifluoromethyl, benzyl, chloromethyl, dimethylaminomethyl, ethoxycarbonylmethyl, aminomethyl, acetylaminomethyl, ethyl, 2-(4-dodecanoylaminophenyl)ethyl, carboxyethyl, allyl, 3,3,3-trichloropropyl, n-propyl, isopropyl, n-butyl, isobutyl, sec-butyl, t-butyl, n-pentyl, sec-pentyl, t-pentyl, cyclopentyl, n-hexyl, sec-hexyl, t-hexyl, n-octyl, sec-octyl, t-octyl, n-decyl, n-undecyl, n-dodecyl, n-tetradecyl, n-pentadecyl, n-hexadecyl, sec-hexadecyl, t-hexadecyl, n-octadecyl, and t-octadecyl groups), a substituted or unsubstituted alkenyl group (e.g., vinyl, 2-chlorovinyl, 1-methylvinyl, 2-cyanovinyl, and cyclohexen-1-yl groups), a substituted or unsubstituted alkynyl group (e.g., ethynyl, 1-propynyl, and 2-ethoxycarbonylethynyl groups), a substituted or unsubstituted aryl group (e.g., phenyl, naphthyl, 3-hydroxyphenyl, 3-chlorophenyl, 4-acetylaminophenyl, 4-hexadecanesulfonylaminophenyl, 2-methanesulfonyl-4-nitrophenyl, 3-nitrophenyl, 4-methoxyphenyl, 4-acetylaminophenyl, 4-methanesulfonylphenyl, 2,4-dimethylphenyl, and 4-tetradecyloxyphenyl groups), a substituted or unsubstituted heterocyclic group (e.g., 1-imidazolyl, 2-furyl, 2-pyridyl, 5-nitro-2-pyridyl, 3-pyridyl, 3,5-dicyano-2-pyridyl, 5-tetrazolyl, 5-phenyl-1-tetrazolyl, 2-benzothiazolyl, 2-benzimidazolyl, 2-benzoxazolyl, 2-oxazolin-2-yl, and morpholino groups), a substituted or unsubstituted acyl group (e.g., acetyl, propionyl, butyroyl, isobutyroyl, 2,2-dimethylpropionyl, benzoyl, 3,4-dichlorobenzoyl, 3-acetylamino-4-methoxybenzoyl, 4-methylbenzoyl, and 4-methoxy-3-sulfobenzoyl groups), a substituted or unsubstituted sulfonyl group (e.g., methanesulfonyl, ethanesulfonyl, chloromethanesulfonyl, propanesulfonyl, butanesulfonyl, n-octanesulfonyl, n-dodecanesulfonyl, n-hexadecanesulfonyl, benzenesulfonyl, 4-toluenesulfonyl, and 4-n-dodecyloxybenzenesulfonyl groups), a substituted or unsubstituted carbamoyl group (e.g., carbanoyl, methylcarbamoyl, dimethylcarbamoyl, bis-(2-methoxyethyl)carbamoyl, diethylcarbamoyl, cyclohexylcarbamoyl, di-n-octylcarbamoyl, 3-dodecyloxypropylcarbamoyl, hexadecylcarbamoyl, 3-(2,4-di-t-pentylphenoxy)propylcarbamoyl, 3-octanesulfonylaminophenycarbamoyl, and di-n-octadecylcarbamoyl groups), a substituted or unsubstituted sulfamoyl group (e.g., sulfamoyl, methylsulfamoyl, dimethylsulfamoyl, diethylsulfamoyl, bis(2-methoxyethyl)sulfamoyl, di-n-butylsulfamoyl, methyl-n-octylsulfamoyl, n-hexadecylmethylsulfamoyl, 3-ethoxypropylmethylsulfamoyl, N-phenyl-N-methylsulfamoyl, 4-decyloxyphenylsulfamoyl, and methyloctadecylsulfamoyl group), and the like.

$R_1$ and $R_3$ each preferably represents a substituted or unsubstituted alkyl, alkenyl, alkynyl, aryl, heterocyclic, acyl or sulfonyl group, etc. $R_1$ and $R_3$ each preferably contains 1 to 40 carbon atoms.

$R_2$ preferably represents a substituted or unsubstituted acyl or sulfonyl group and preferably contains 1 to 40 carbon atoms.

X preferably represents an oxygen atom.

$R_1$, $R_2$, $R_3$, and EAG may be taken together to form a ring.

More preferred among the compounds represented by formula (II) are those represented by formula (III):

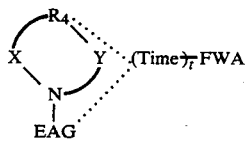

(III)

wherein Y represents a divalent linking group, and preferably

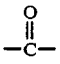

or $-SO_2-$; $R_4$ represents an atom group forming a 5- to 8-membered nitrogen-containing monocyclic or condensed heterocyclic ring together with X and Y; X, t, EAG, Time, FWA, and the dotted lines are as defined above.
in formula (III),
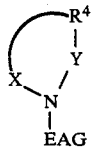
corresponds to PWR in formula (I), and $(Time)_t$FWA is bonded to at least one of $R_4$ and EAG.
Specific and preferred examples of the heterocyclic ring formed by X, Y, $R_4$, and N are shown below.
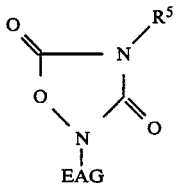
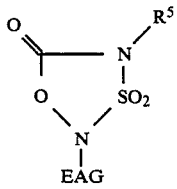
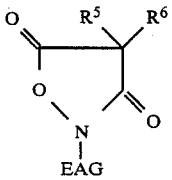
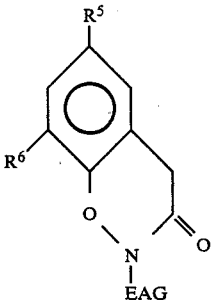
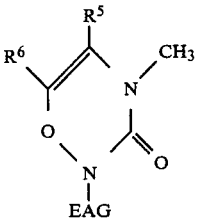
-continued
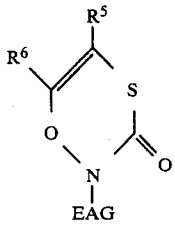
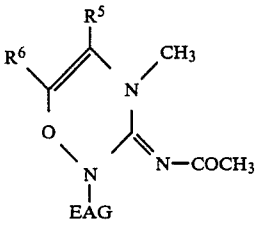
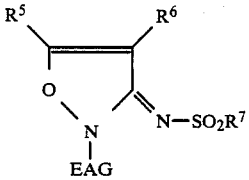
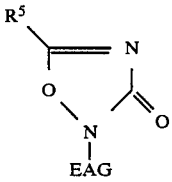
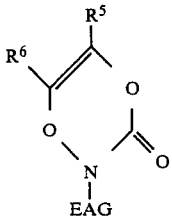
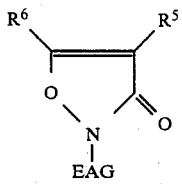
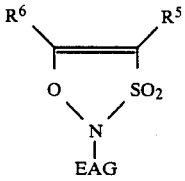
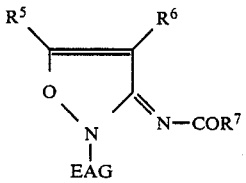

-continued
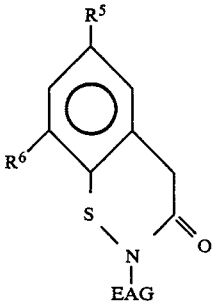
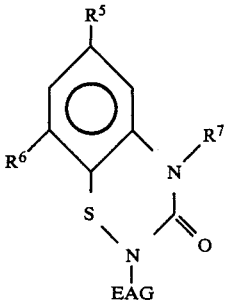
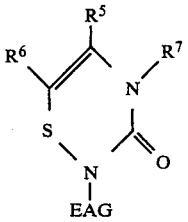
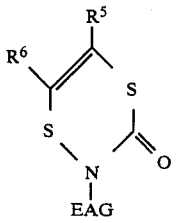
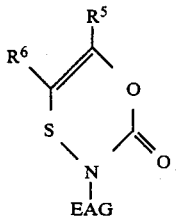
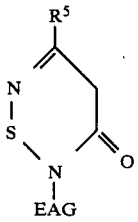
-continued
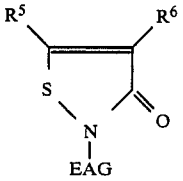
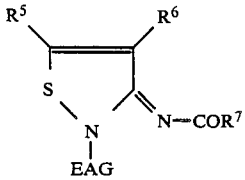
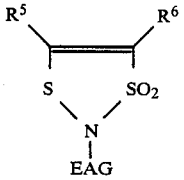
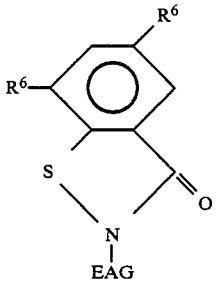
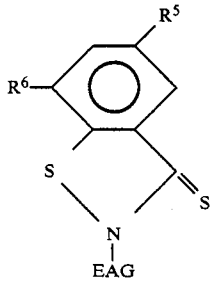
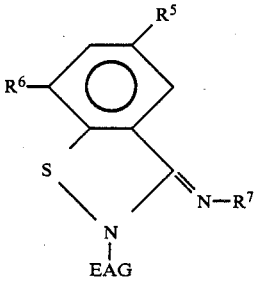
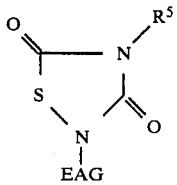

-continued
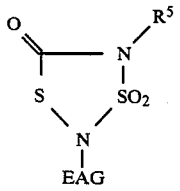
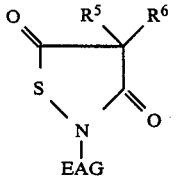
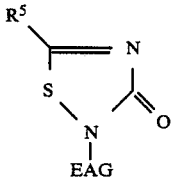
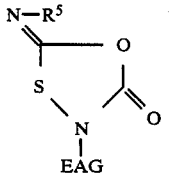
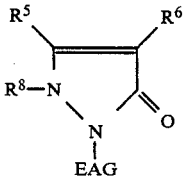
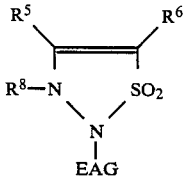
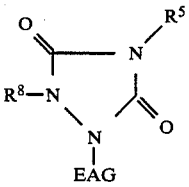
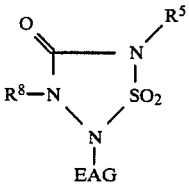
-continued
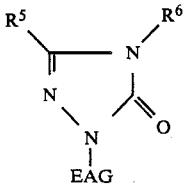
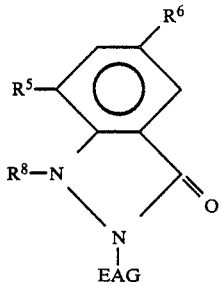
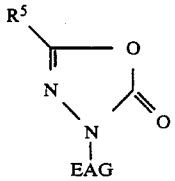
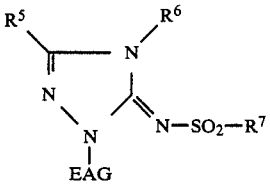
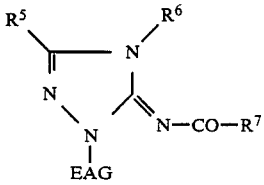
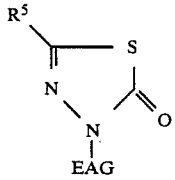
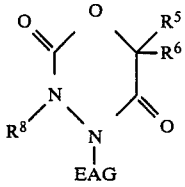
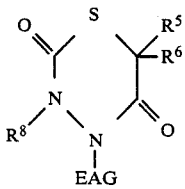

-continued
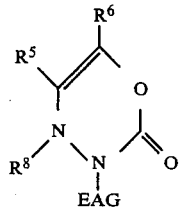
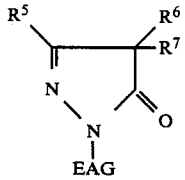
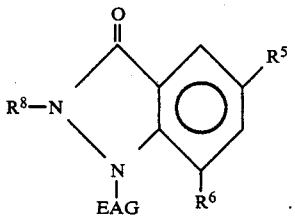
wherein $R^5$, $R^6$, and $R^7$ each represents a hydrogen atom, an alkyl group, an aryl group or a heterocyclic group; and $R^8$ represents an acyl group or a sulfonyl group.
Particularly preferred examples of these heterocyclic rings are shown below, in which the bonding position of $-(Time)_t-FWA$ is also shown.
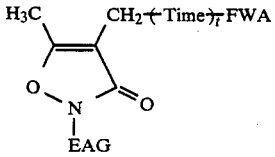
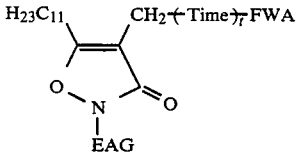
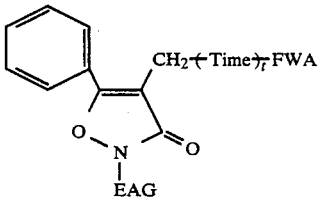
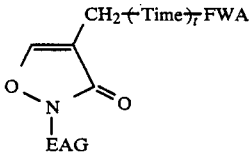
-continued
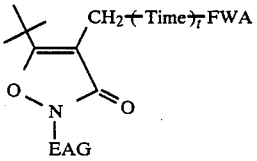
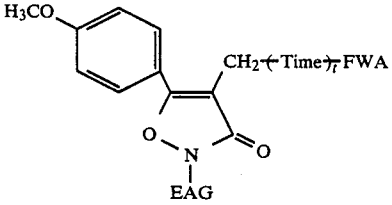
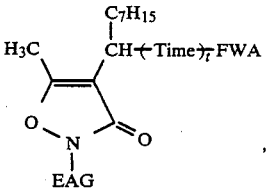
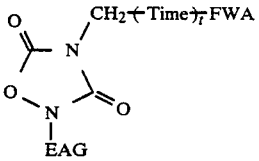
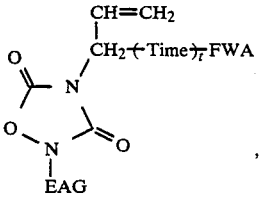
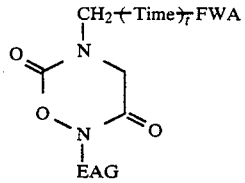
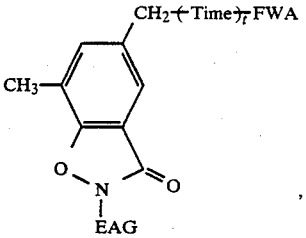
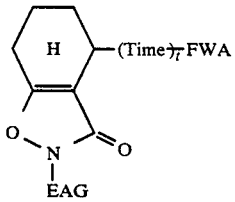

-continued

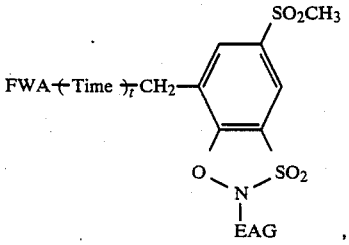

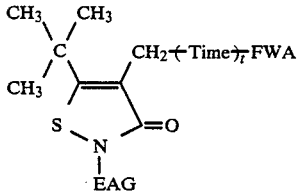

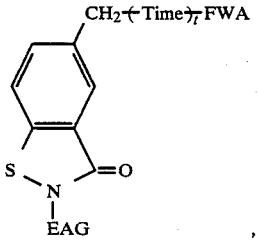

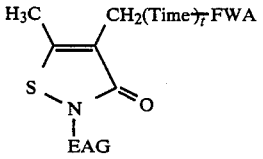

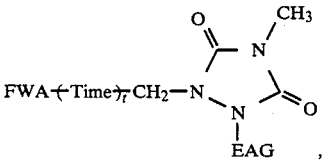

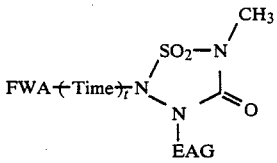

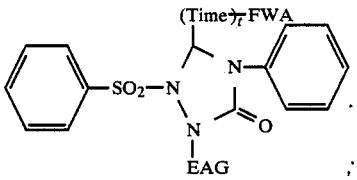

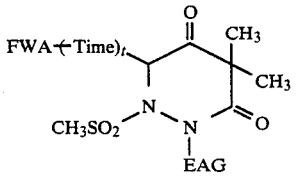

-continued

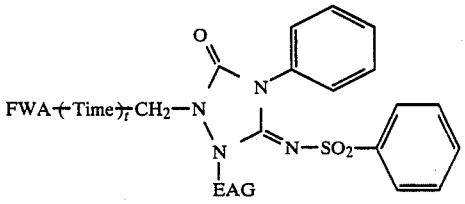

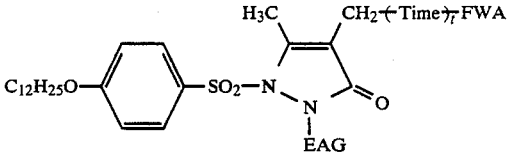

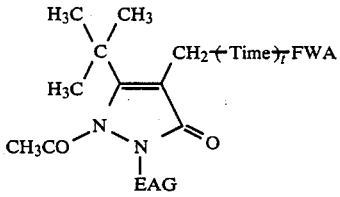

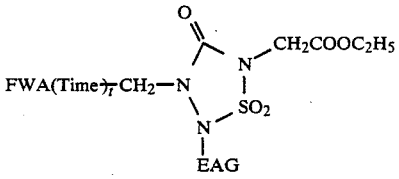

In the foregoing formulae, EAG represents an aromatic group which accepts an electron from a reducing substance and is bonded to the nitrogen atom. EAG preferably includes a group represented by formula (A):

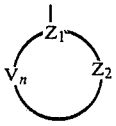

(A)

wherein $Z_1$ represents

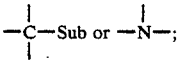

$V_n$ represents an atom group forming a 3- to 8-membered aromatic ring together with $Z_1$ and $Z_2$; n represents an integer of from 3 to 8, $V_3$ is $-Z_3-$, $V_4$ is $-Z_3-Z_4-$, $V_5$ is $-Z_3-Z_4-Z_5-$, $V_6$ is $-Z_3-Z_4-Z_5-Z_6-$, $V_7$ is $-Z_3-Z_4-Z_5-Z_6-Z_7-$, $V_8$ is $-Z_3-Z_4-Z_5-Z_6-Z_7-Z_8-$; $Z_2$, $Z_3$, $Z_4$, $Z_5$, $Z_6$, $Z_7$, and $Z_8$ each represents

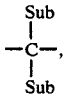

$$-\overset{\overset{\text{Sub}}{|}}{N}-,$$

—O—, —S— or —$SO_2$—; and Sub represents a mere bond ($\pi$-bond), a hydrogen atom or a substituent hereinafter described for EAG, provided that when more than one Sub is present, each is the same or different or they are connected to each other to form a 3- to 8-membered saturated or unsaturated carbon ring or heterocyclic ring.

In formula (A), the substituent represented by Sub is selected so that a sum of Hammett's sigma constant and Hammett's para constant is at least +0.50, preferably at least +0.70, and more preferably at least +0.85.

EAG preferably represents an aryl or heterocyclic group substituted with at least one electron attractive group. The substituent on the aryl or heterocyclic group can be taken advantage of for controlling physical properties of the compound as a whole, such as easiness of electron acceptance, water solubility, oil solubility, diffusibility, sublimating property, melting point, dispersibility in a binder (e.g., gelatin), reactivity to a nucleophilic group, reactivity to electrophilic group, and the like.

Specific examples of the aryl group substituted with at least one electron attractive group are 4-nitrophenyl, 2-nitrophenyl, 2-nitro-4-N-methyl-N-n-butylsulfamoylphenyl, 2-nitro-4-N-methyl-N-n-octylsulfamoylphenyl, 2-nitro-4-N-methyl-N-n-dodecylsulfamoylphenyl, 2-nitro-4-N-methyl-N-n-hexadecylsulfamoylphenyl, 2-nitro-4-N-methyl-N-n-octadecylsulfamoylphenyl, 2-nitro-4-N-methyl-N-(3-carboxypropyl)sulfamoylphenyl, 2-nitro-4-N-ethyl-N-(2-sulfoethyl)sulfamoylphenyl, 2-nitro-4-N-n-hexadecyl-N-(3-sulfopropyl)sulfamoylphenyl, 2-nitro-4-N-(2-cyanoethyl)-N-[(2-hydroxyethoxy)ethyl]sulfamoylphenyl, 2-nitro4-diethylsulfamoylphenyl, 2-nitro-4-di-n-butylsulfamoylphenyl, 2-nitro-4-di-n-octylsulfamoylphenyl, 2-nitro-4-di-n-octadecylsulfamoylphenyl, 2-nitro-4-methylsulfamoylphenyl, 2-nitro-4-n-hexadecylsulfamoylphenyl, 2-nitro-4-N-methyl-N-(4-dodecylsulfonylphenyl)sulfamoylphenyl, 2-nitro-4-(3-methylsulfamoylphenyl)sulfamoylphenyl, 4-nitro-2-N-methyl-N-n-butylsulfamoylphenyl, 4-nitro-2-N-methyl-N-n-octylsulfamoylphenyl, 4-nitro-2-N-methyl-N-n-dodecylsulfamoylphenyl, 4-nitro-2-N-methyl-N-n-hexadecylsulfamoylphenyl, 4-nitro-2-N-methyl-N-n-octadecylsulfamoylphenyl, 4-nitro-2-N-methyl-N-(3-carboxypropyl)sulfamoylphenyl, 4-nitro-2-N-ethyl-N-(2-sulfoethyl)sulfamoylphenyl, 4-nitro-2-N-n-hexadecyl-N-(3-sulfopropyl)sulfamoylphenyl, 4-nitro-2-N-(2-cyanoethyl)-N-[(2-hydroxyethoxy)ethyl]-sulfamoylphenyl, 4-nitro-2-diethylsulfamoylphenyl, 4-nitro-2-di-n-butylsulfamoylphenyl, 4-nitro-2-di-n-octylsulfamoylphenyl, 4-nitro-2-di-n-octadecylsulfamoylphenyl, 4-nitro-2-methylsulfamoylphenyl, 4 -nitro-2-n-hexadexylsulfamoylphenyl, 4-nitro-2-N-methyl-N-(4-dodecylsulfonylphenyl)sulfamoylphenyl, 4-nitro-2-(3-methylsulfamoylphenyl)sulfamoylphenyl, 4-nitro-2-chlorophenyl, 2-nitro-4-chlorophenyl, 2-nitro-4-N-methyl-N-n-butylcarbamoylphenyl, 2-nitro-4-N-methyl-N-n-octylcarbamoylphenyl, 2-nitro-4-N-methyl-N-n-dodecylcarbamoylphenyl, 2-nitro-4-N-methyl-N-n-hexadecylcarbamoylphenyl, 2-nitro-4-N-methyl-N-n-octadecylcarbamoylphenyl, 2-nitro-4-N-methyl-N-(3-carboxypropyl)carbamoylphenyl, 2-nitro-4-N-ethyl-N-(2-sulfoethyl)carbamoylphenyl, 2-nitro-4-N-n-hexadecyl-N-( 3-sulfopropyl)carbamoylphenyl, 2-nitro-4-N-(2-cyanoethyl)-N-[(2-hydroxyethoxy)ethyl]carbamoylphenyl, 2-nitro-4-diethylcarbamoylphenyl, 2-nitro-4-di-nbutylcarbamoylphenyl, 2-nitro-4-di-n-octylcarbamoylphenyl, 2-nitro-4-di n-octadecylcarbamoylphenyl, 2-nitro-4-methylcarbamoylphenyl, 2-nitro-4-n-hexadecylcarbamoylphenyl, 2-nitro-4-N-methyl-N-(4-dodecylsulfonylphenyl)carbamoylphenyl, 2-nitro-4-(3-methylsulfamoylphenyl)carbamoylphenyl, 4-nitro-2-N-methyl-N-n-butylcarbamoylphenyl, 4-nitro-2-N-methyl-N-n-octylcarbamoylphenyl, 4-nitro-2-N-methyl-N-n-dodecylcarbamoylphenyl, 4-nitro-2-N-methyl-N-n-hexadecylcarbamoylphenyl, 4-nitro-2-N-methyl-N-n-octadecylcarbamoylphenyl, 4-nitro-2-N-methyl-N-(3-carboxypropyl)carbamoylphenyl, 4-nitro-2-N-ethyl-N-(2-sulfoethyl)carbamoylphenyl, 4-nitro-2-N-n-hexadecyl-N-(3-sulfopropyl)carbamoylphenyl, 4-nitro-2-N-(2-cyanoethyl)-N-[(2 -hydroxyethoxy)ethyl]carbamoylphenyl, 4-nitro-2-diethylcarbamoylphenyl, 4-nitro-2-di-n-butylcarbamoylphenyl, 4-nitro-2-di-n-octylcarbamoylphenyl, 4-nitro-2-di-n-octadecylcarbamoylphenyl, 4-nitro-2-methylcarbamoylphenyl, 4-nitro-2-n-hexadecylcarbamoylphenyl, 4-nitro-2-N-methyl-N-(4-dodecylsulfonylphenyl)carbamoylphenyl, 4-nitro-2-(3-methylsulfamoylphenyl)carbamoylphenyl, 2,4-dimethanesulfonylphenyl, 2-methanesulfonyl-4-benzenesulfonylphenyl, 2-n-octanesulfonyl-4-methanesulfonylphenyl, 2-n-tetradecanesulfonyl-4-methanesulfonylphenyl, 2-n-hexadecanesulfonyl-4-methanesulfonylphenyl, 2,4 di-n-dodecanesulfonylphenyl, 2,4-didodecanesulfonyl-5-trifluoromethylphenyl, 2-n-decanesulfonyl-4-cyano-5-trifluoromethylphenyl, 2-cyano-4-methanesulfonylphenyl, 2,4,6-tricyanophenyl, 2,4-dicyanophenyl, 2-nitro-4-methanesulfonylsulfoethylsulfonyl)phenyl, 2-nitro-4-n-dodecanesulfonylphenyl, 2-nitro-4-(2-sulfoethylsulfonyl)phenyl, 2-nitro-4-carboxymethylsulfonylphenyl, 2-nitro-4 carboxyphenyl, 2-nitro-4-ethoxycarbonyl-5-n-butoxyphenyl, 2-nitro-4-ethoxycarbonyl-5-n-hexadecyloxyphenyl, 2-nitro-4-diethylcarbamoyl-5-n-hexadecyloxyphenyl, 2-nitro-4-cyano-5-n-dodecylphenyl, 2,4-dinitrophenyl, 2-nitro-4-n-decylthiophenyl, 3,5-dinitrophenyl, 2-nitro-3,5-dimethyl-4-n-hexadecanesulfonylphenyl, 4-methanesulfonyl-2-benzenesulfonylphenyl, 4-n-octanesulfonyl-2-methanesulfonylphenyl, 4-n-tetradecanesulfonyl2-methanesulfonylphenyl, 4-n-hexadecanesulfonyl-2-methanesulfonylphenyl, 2,5-didodecanesulfonyl-4-trifluoromethylphenyl, 4-n-decanesulfonyl-2-cyano-5-trifluoromethylphenyl, 4-cyano-2-methanesulfonylphenyl, 4-nitro-2-methanesulfonylphenyl, 4-nitro-2-n-dodecanesulfonylphenyl, 4-nitro-2-(2-sulfoethylsulfonyl)phenyl, 4-nitro-2-carboxymethylsulfonylphenyl, 4-nitro-2-carboxyphenyl, 4-nitro-2-ethoxycarbonyl-5-n-butoxyphenyl, 4-nitro-2-ethoxycarbonyl-5-n-hexadecyloxyphenyl, 4-nitro-2-diethylcarbamoyl-5-n-hexadecyloxyphenyl, 4-nitro-2cyano-5-n-dodecylphenyl, 4-nitro-2-n-decylthiophenyl, 4-nitro-3,5-dimethyl-2n-hexadecanesulfonylphenyl, 4-nitronaphthyl, 2,4-dinitronaphthyl, 4-nitro-2-n-octadecylcarbamoylnaphthyl, 4-nitro2- dioctylcarbamoyl-5-(3-sulfobenzenesulfonylamino)naphthyl, 2,3,4,5,6-pentafluoropheyl, 2-nitro-4-benzoylphenyl, 2,4-diacetylphenyl, 2-nitro-4-trifluoromethylphenyl, 4-nitro-2-trifluoromethylphenyl, 4-nitro-3-trifluoromethylphenyl, 2,4,5-tricyanophenyl, 3,4-dicyanophenyl, 2-chloro-4,5-dicyanophenyl, 2-bromo-4,5-dicyanophenyl, 4-methanesulfonylphenyl, 4-n-hexadecanesulfonylphenyl, 2-decanesulfonyl-5-trifluoromethylphenyl, 2-nitro5-methylphenyl, 2-nitro-5-n-octadecyloxyphenyl, 2-nitro-4-N-(vinylsulfonylethyl)-N-methylsulfamoylphenyl, and 2-methyl-6-nitrobenzoxazol-5-yl groups.

Specific examples of the heterocyclic group are 2-pryridyl, 3-pyridyl, 4-pyridyl, 5-nitro-2-pyridyl, 5-nitro-N-hexadecylcarbamoyl-2-pyridyl, 3,5-dicyano-2 -pyridyl, 5-dodecanesulfonyl-2-pyridyl, 5-cyano-2-pyrazyl, 4-nitrothiophen-2-yl, 5-nitro-1,2-dimethylimidazol-4-yl, 3,5-diacetyl-2-pyridyl, 1-dodecyl-5-carbamoylpyridinium-2-yl, 5-nitro-2-furyl, and 5-nitrobenzothiazol-2-yl groups.

The group represented by $\text{-}(\text{Time})_t\text{FWA}$ is explained below.

Time represents a group capable of releasing FWA upon cleavage of a nitrogen-oxygen bond, a nitrogen-nitrogen bond or a nitrogen-sulfur bond through a reaction subsequent to the release from PWR in the form of $\text{-}(\text{Time})_t\text{FWA}$.

Various known groups, e.g., those described in Japanese Patent Application (OPI) Nos. 147244/86, 236549/86 and 215270/87, can be exemplified as Time.

Time preferably represents any one of the following groups in which (*) means the position at which the group is bonded to PWR in the formula (I) or at which the group is bonded to the side of the dotted lines in the formula (II) or (III), and (*)(*) means the position at which the group is bonded to FWA in the formula (I), (II) or (III). However, the present invention should not be construed as being limited to these representative examples.

(1)

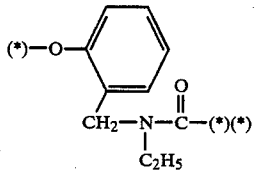

(2)

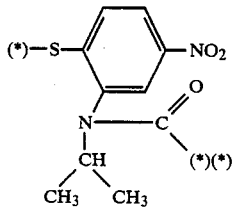

(3)

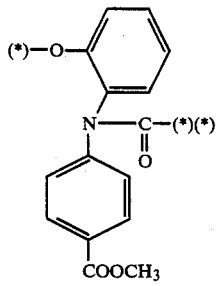

(4)

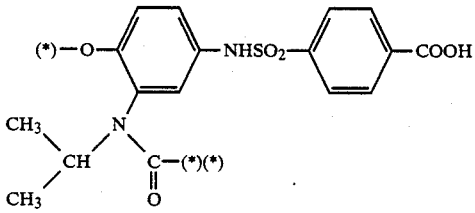

-continued (5)

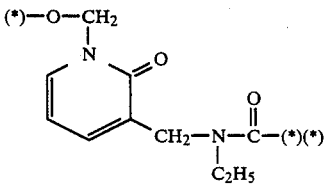

(6)

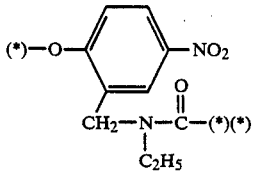

(7)

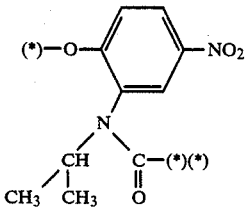

(8)

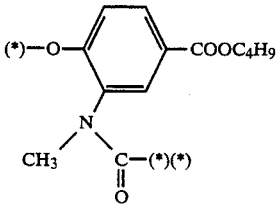

(9)

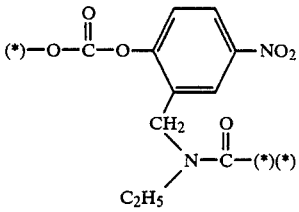

(10)

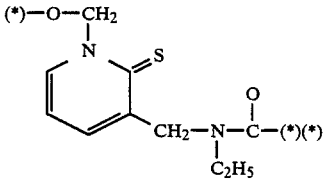

(11)

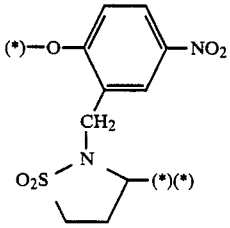

-continued
(12)
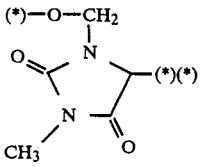
(13)
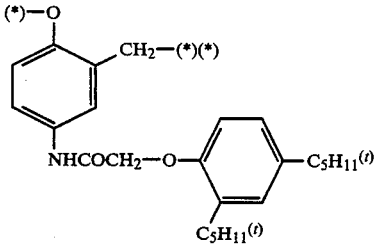
(14)
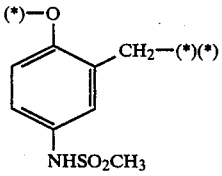
(15)
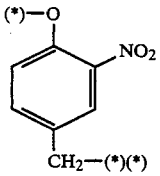
(16)
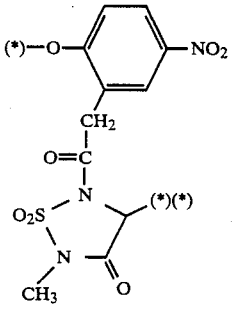
(17)
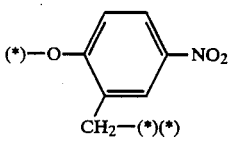
(18)
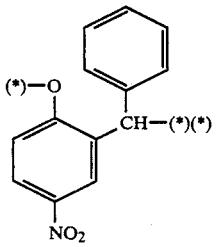
-continued
(19)
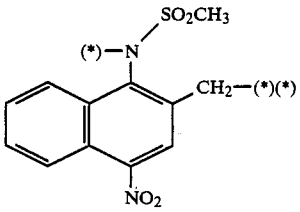
(20)
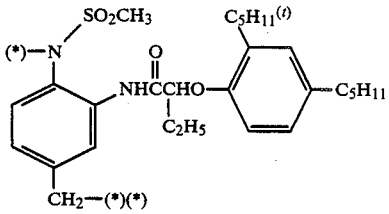
(21)
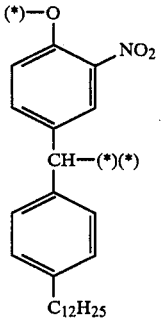
(22)
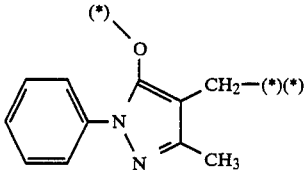
(23)
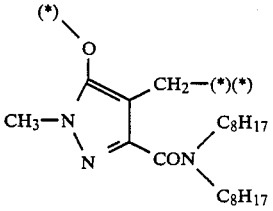
(24)
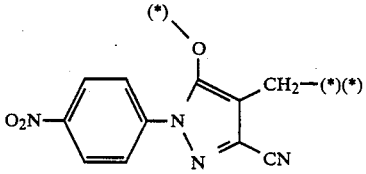
(25)
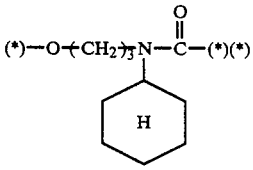
(26)
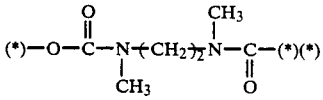

-continued (27)

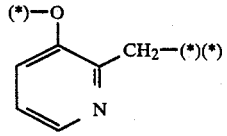

(28)

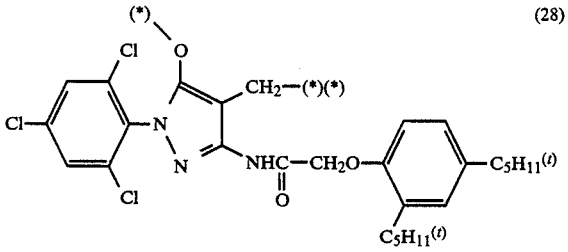

(29)

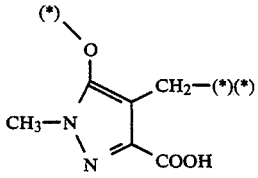

(30)

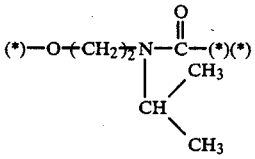

(31)

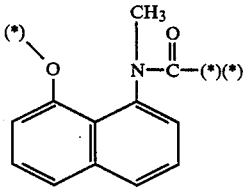

(32)

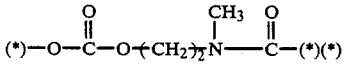

(33)

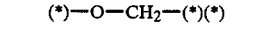

(34)

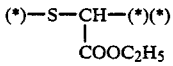

(35)

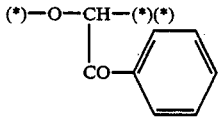

(36)

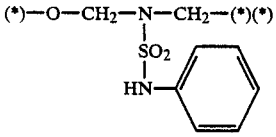

(37)

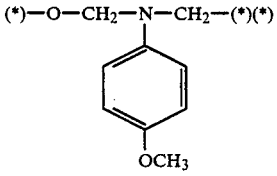

-continued (38)

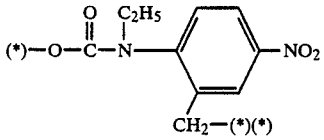

(39)

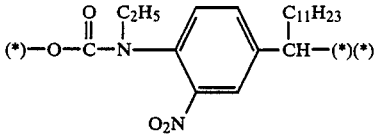

(40)

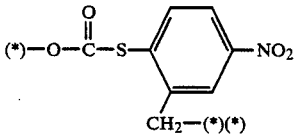

(41)

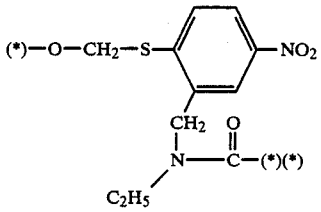

(42)

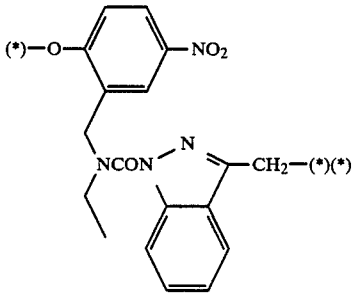

(43)

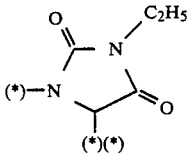

FWA is a group which functions as a brightening agent (that is, a group which functions as a brightening agent when bonded to —(Time)$_t$—PWR or which expresses a function as a brightening agent or has an enhanced function as a brightening agent after being released from Time). Compounds which can ,act as such a group are described, for example, in K. Veen Rataraman, *The Chemistry of Synthetic Dyes,* Vol. V, Chap. 8; S. Asahara, *Novel Dyes and Pigments,* Chap. 3; J. Schroeder, *Angew. Chem. Inter.,* Edit. 14 (10), pages 665 to 679; Japanese Patent Application (OPI) No. 109927/77, etc.

Preferred compounds for FWA are grouped, on the basis of the chemical structure of the fluorescent base thereof. For example preferred example of FWA can be grouped into stilbene series, imidazole series, thiazole series, oxazole series, triazole series, oxadiazole series, thiadiazole series, imidazolone series, coumarin series, naphthalimide series, pyrazoline series, methine series, pyridine series, triazylaminostilbene series, diphenyl series, carbostyryl series, fluoresceine series, oxacyanine series, anthrapyridazine series, benzidine series, diaminobenzothiophene dioxide series, diaminofluorene series, diaminocarbazole series, furan series, pyrroline series, azaindene series, etc.

Examples of preferred brightening agents are set forth below, however, the present invention should not be construed as being limited thereto.

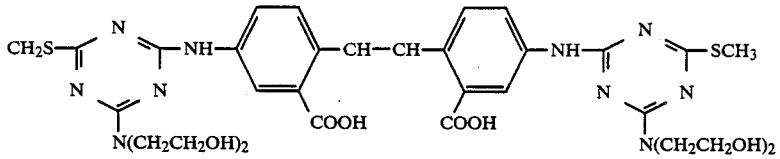

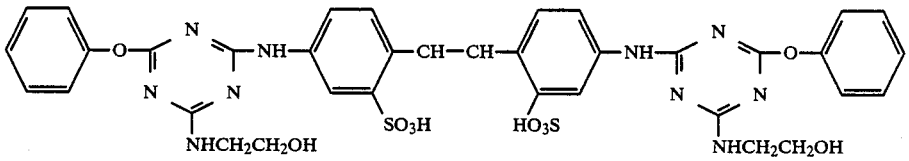

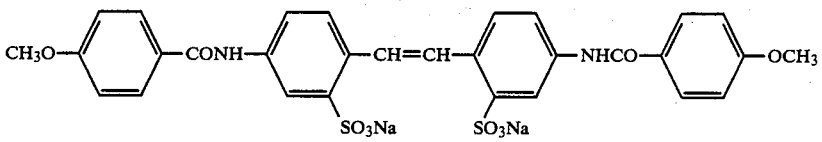

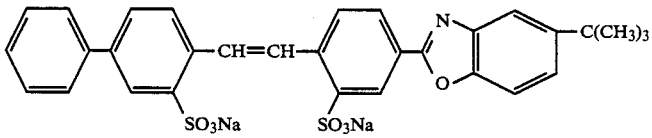

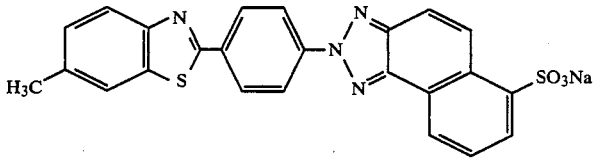

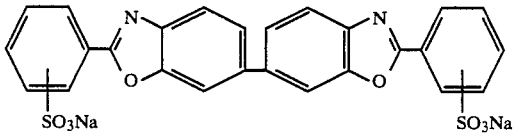

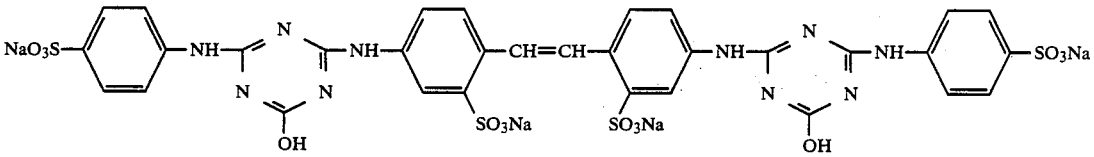

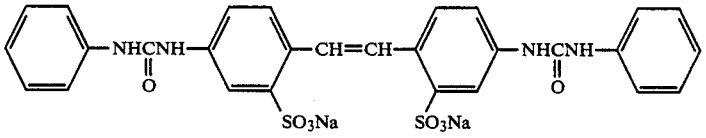

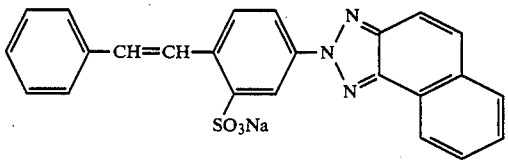

-continued
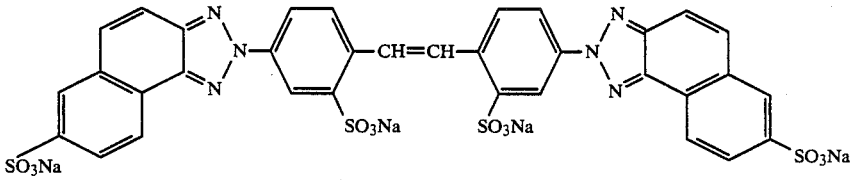
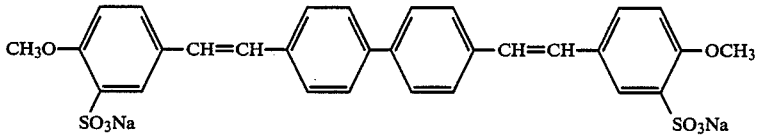
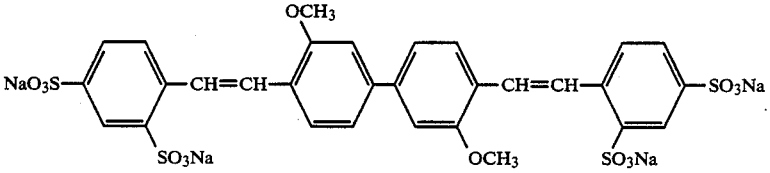
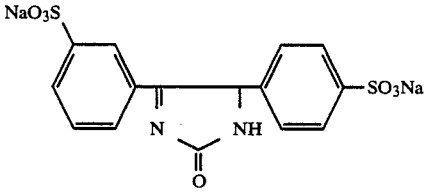
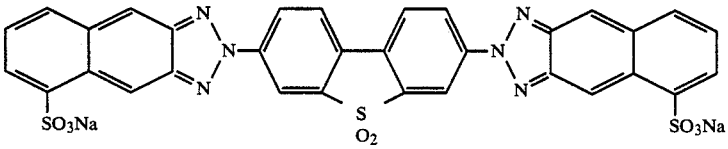
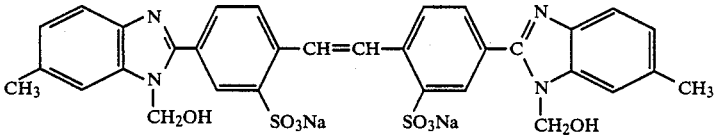
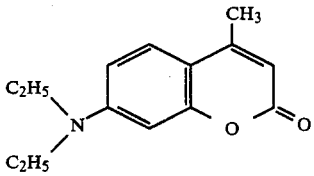
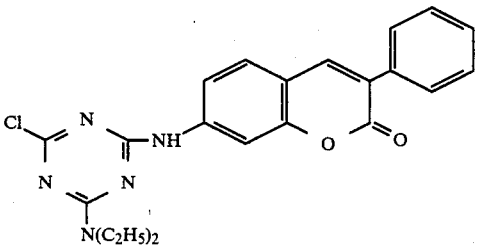

-continued
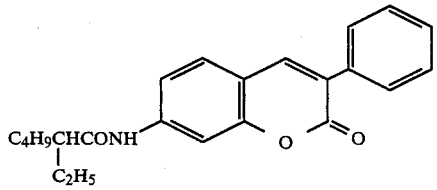
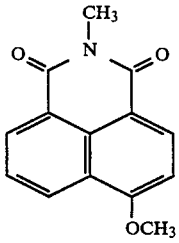
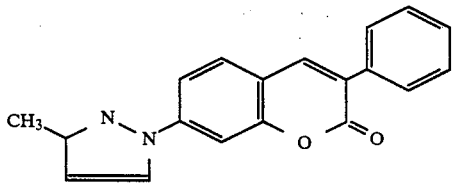
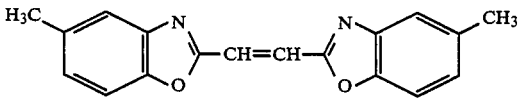
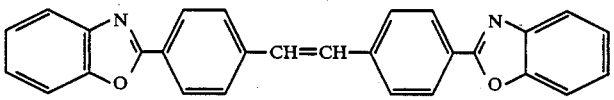
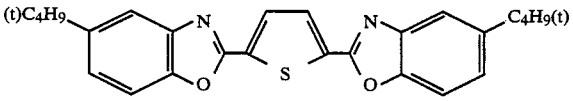
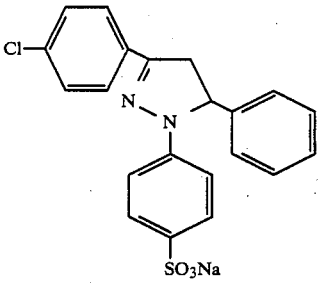
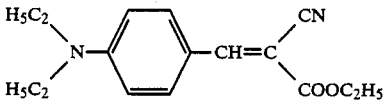
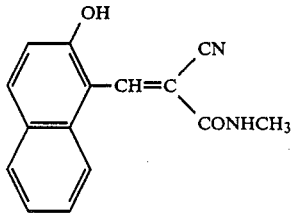

-continued
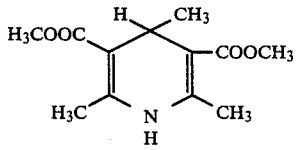
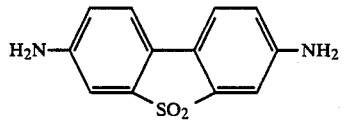
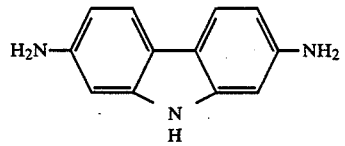
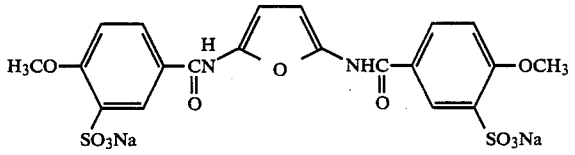
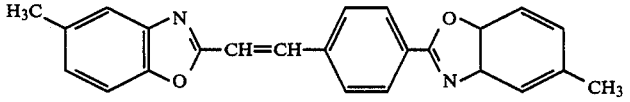
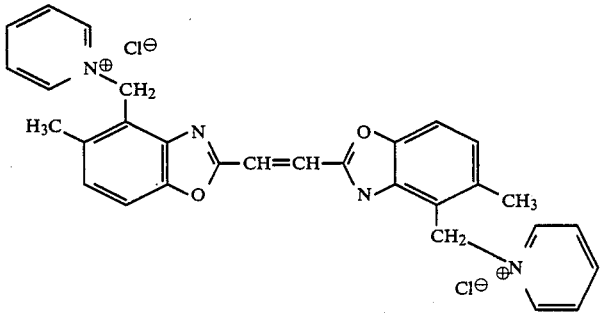
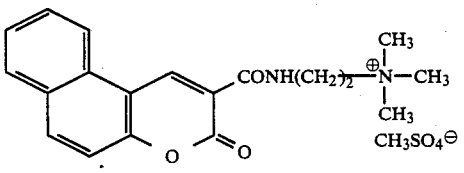
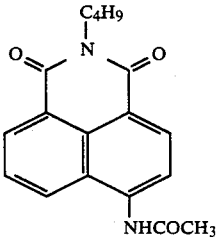

-continued
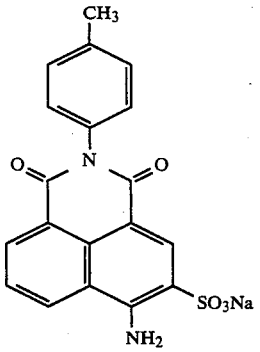
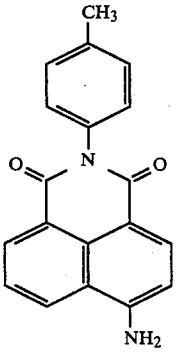
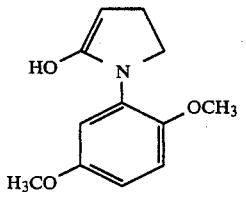
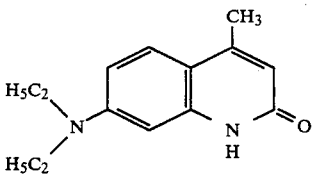
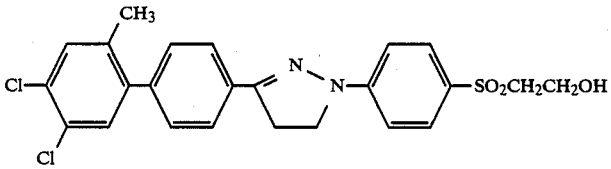
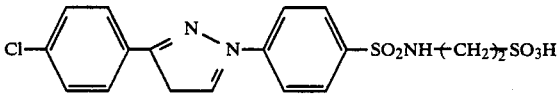
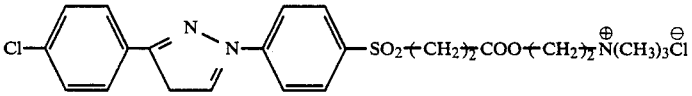

-continued
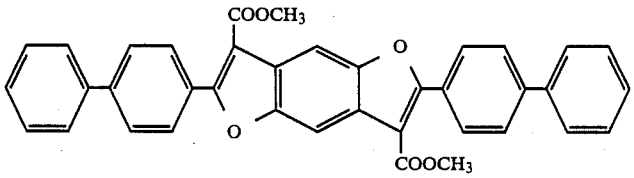
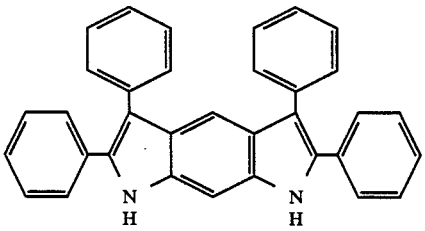
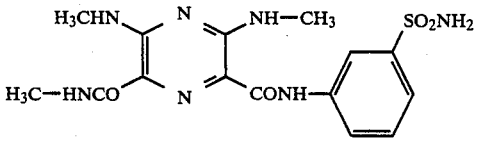
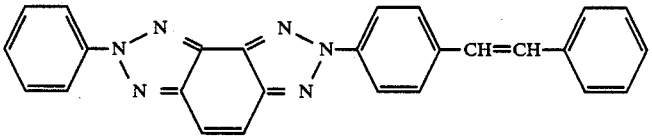
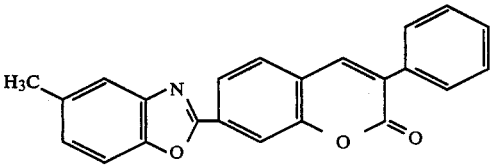
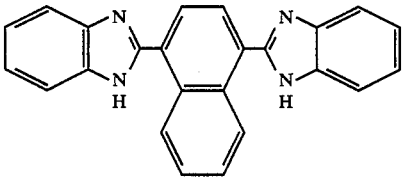
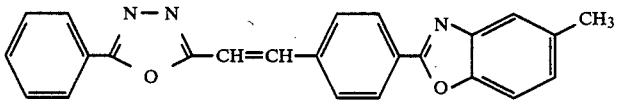
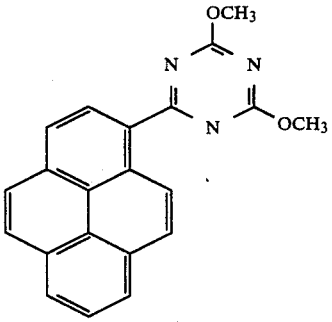

-continued

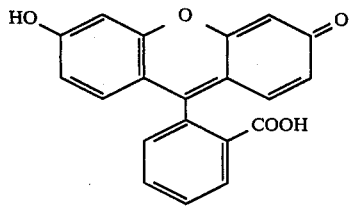

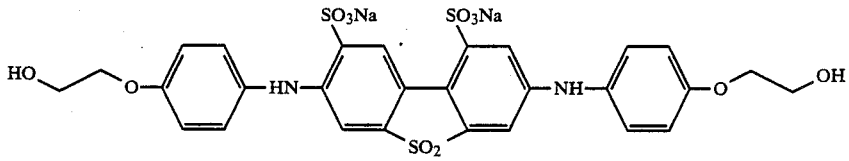

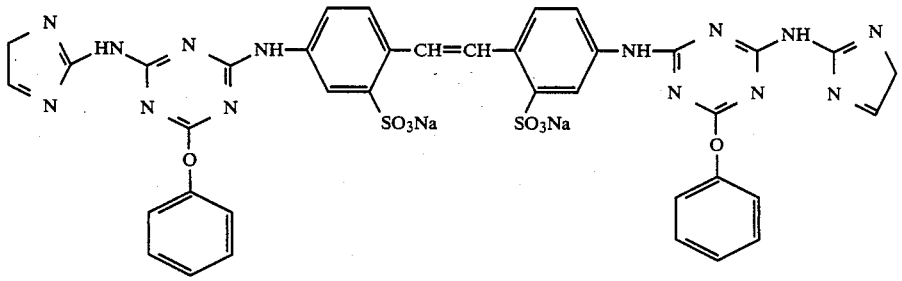

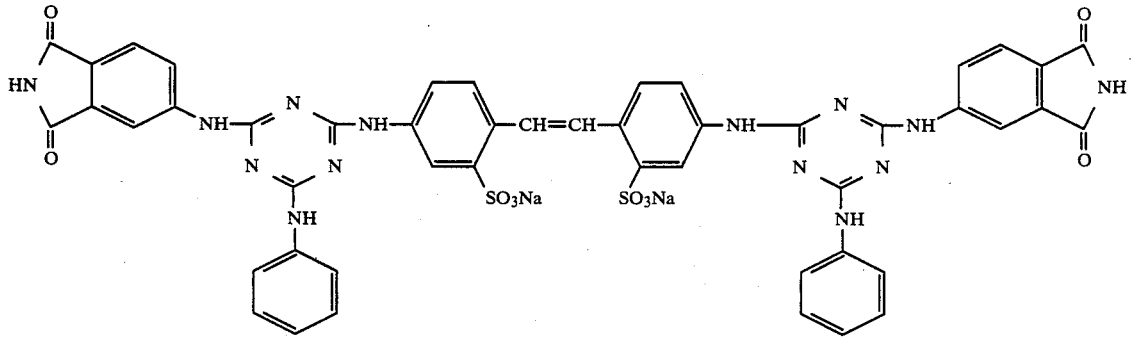

The compounds of the above described formulae (I), (II) and (III) are those capable of releasing a brightening agent in the presence of a reducing agent during or after the image formation step. More practically, the compounds of the present invention do not emit or only weakly emit fluorescent light by themselves. However, the brightening agents released from these compounds may have a function of strongly emitting a fluorescent light. Also, there is a noticeable difference between the diffusibility of the compounds of the present invention themselves and that of the brightening agents to be released from the compounds (for example, the compounds of the present invention themselves may dissolve in a development processing solution, but the brightening agents to be released therefrom solidify in said solution due to their limited solubility therein). Therefore, it is preferred that compounds having the characteristics set forth above are used in the present invention.

Examples of the compounds employable in the present invention are set forth below, however, these compounds are not limitative.

1
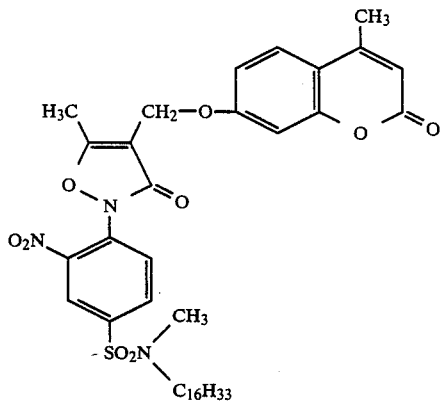
2
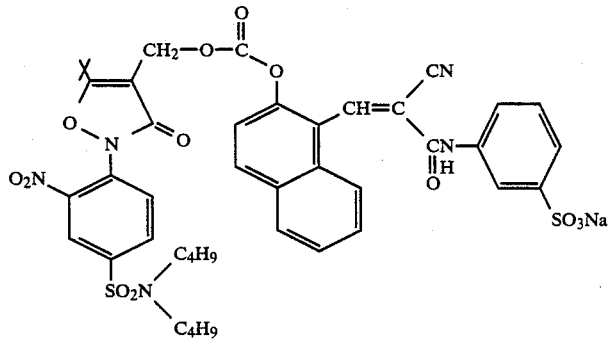
3
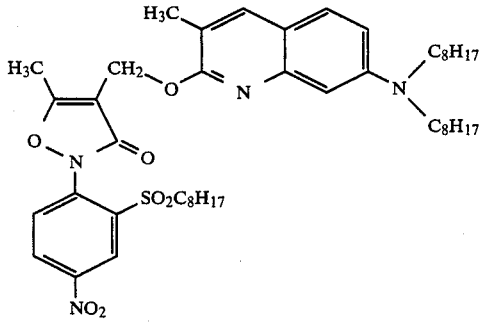
4
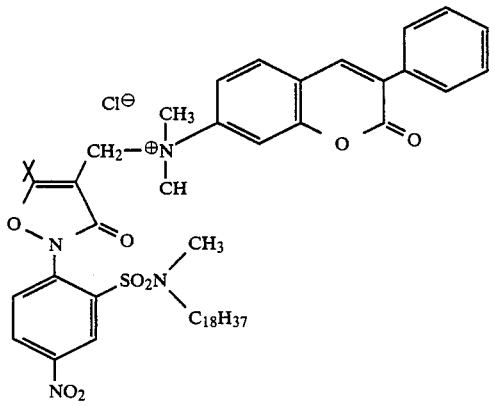

-continued
5
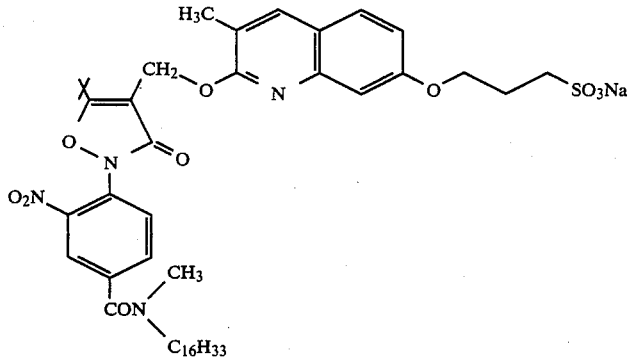
6
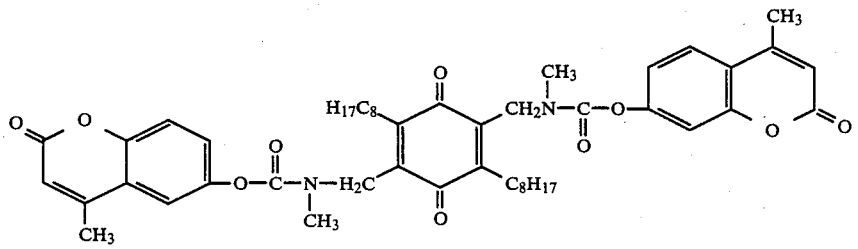
7
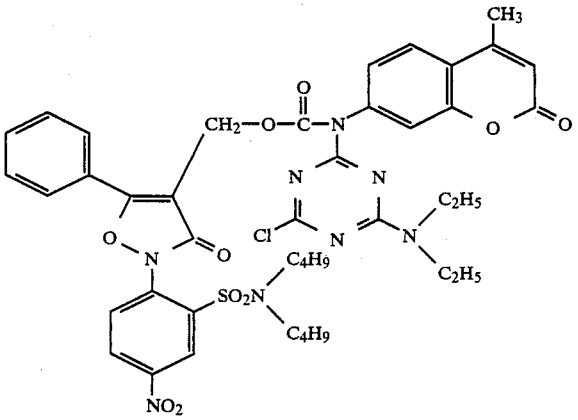
8
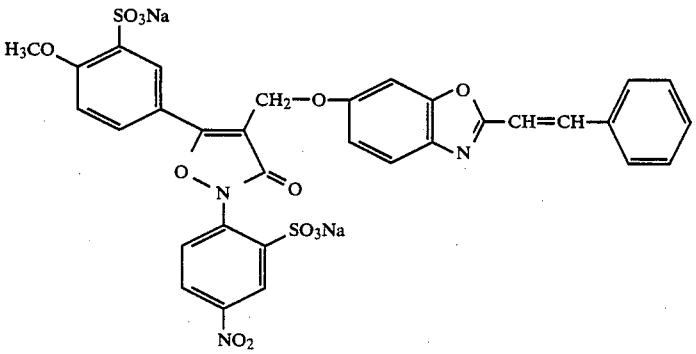

-continued
9
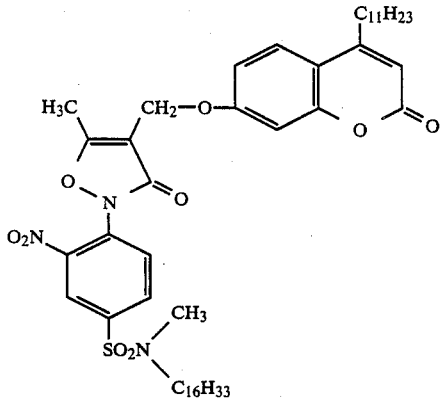
10
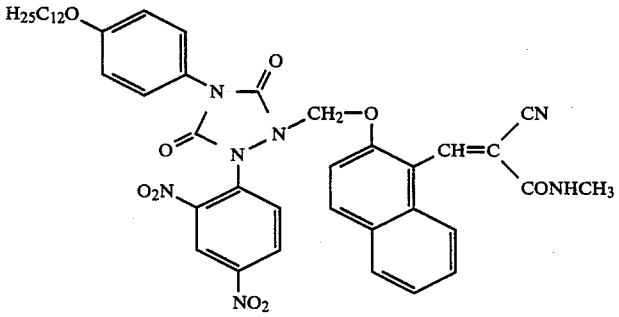
11
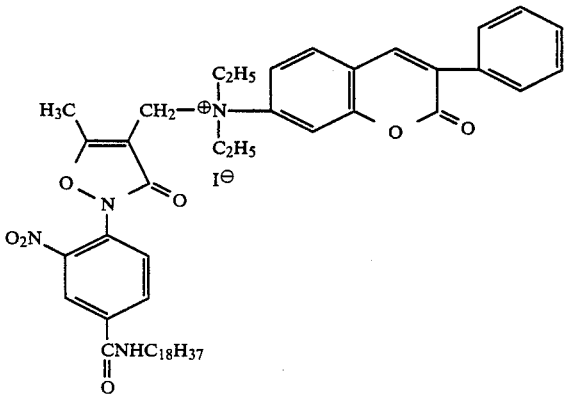
12
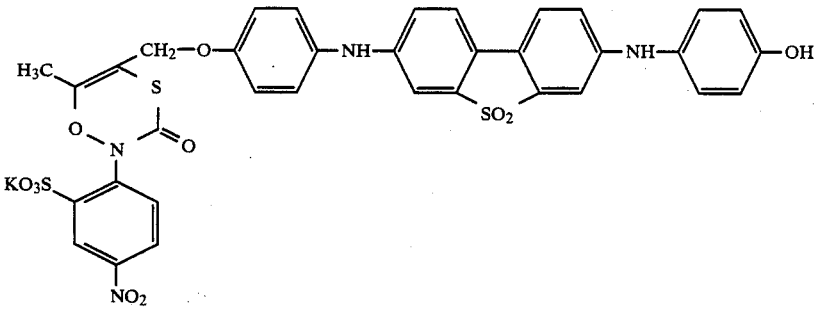
13
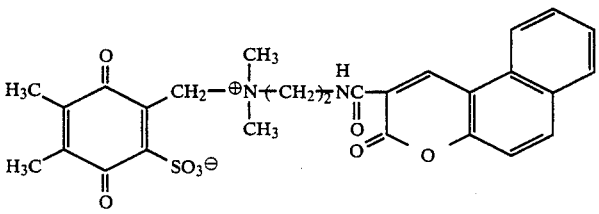

-continued
14
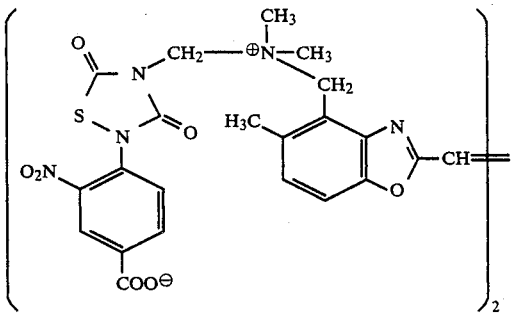
15
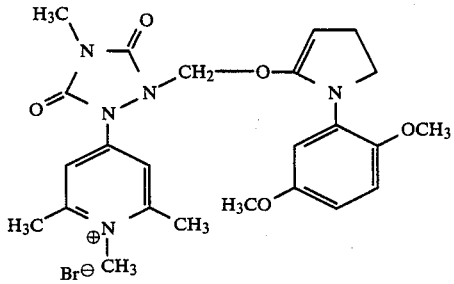
16
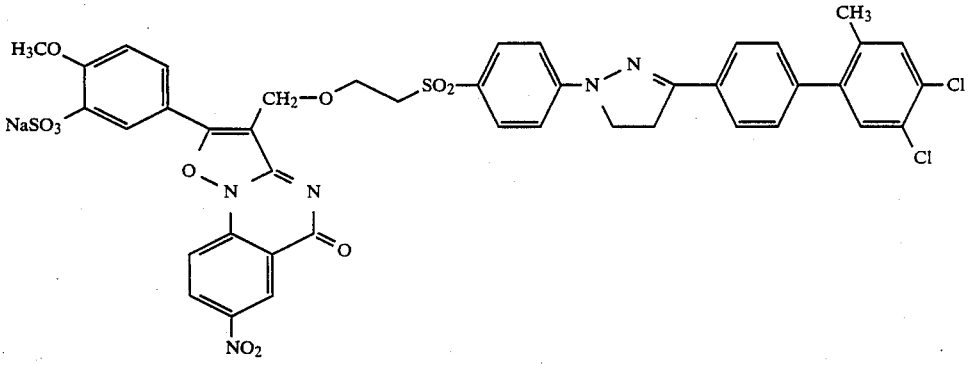
17
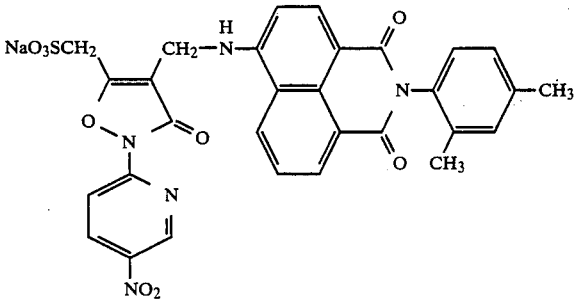

-continued
18
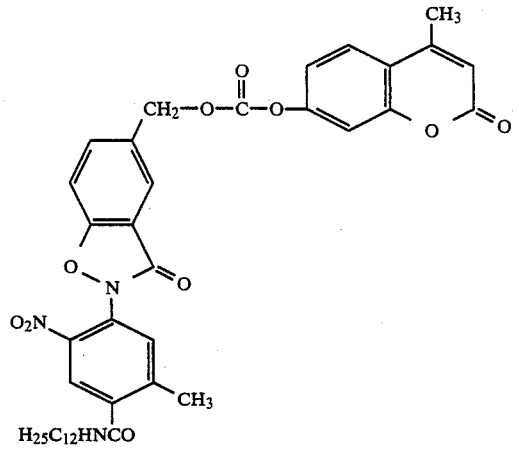
19
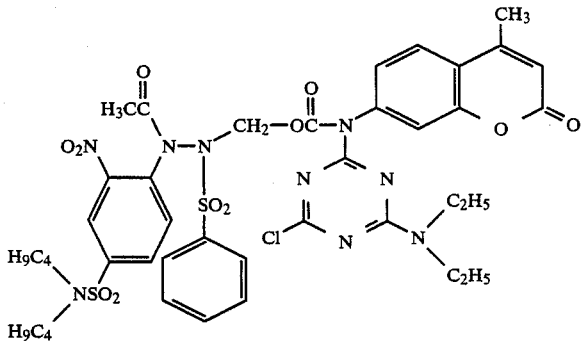
20
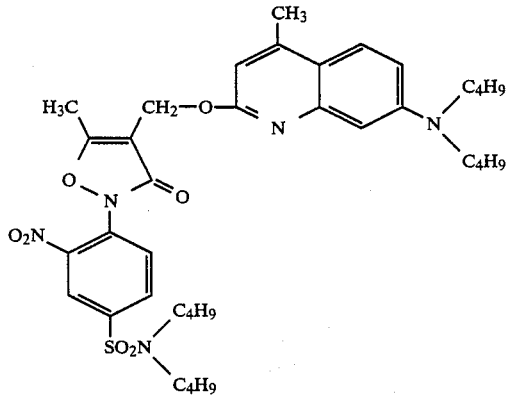
21
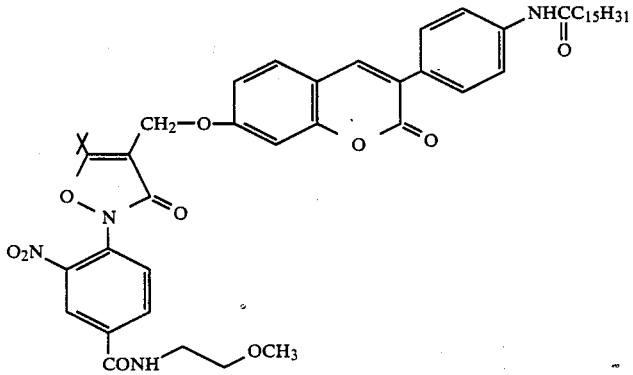

-continued
22
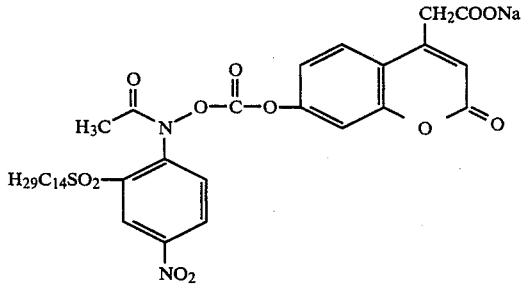
23
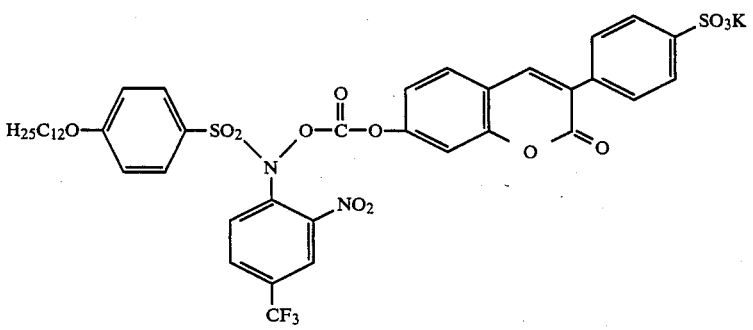
25
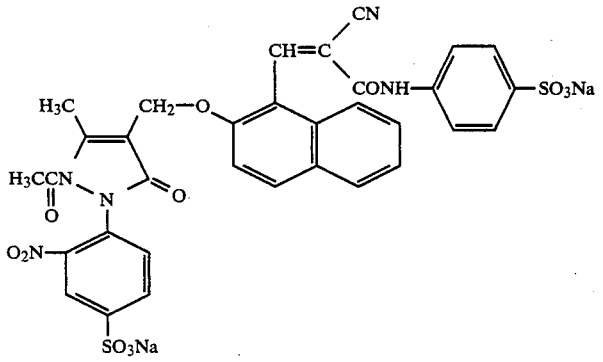
26
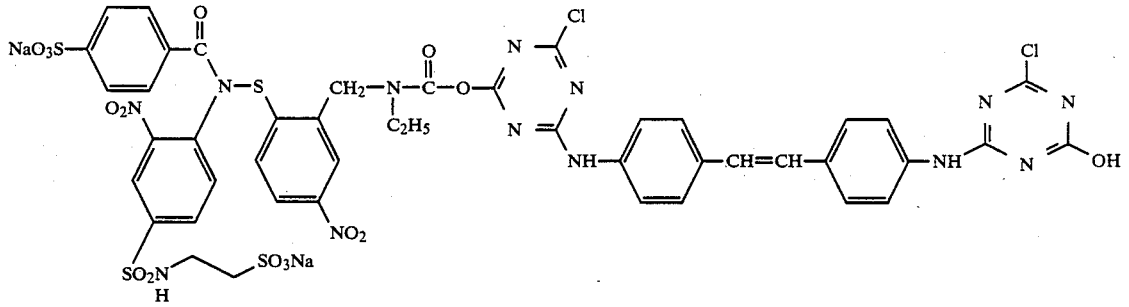
27
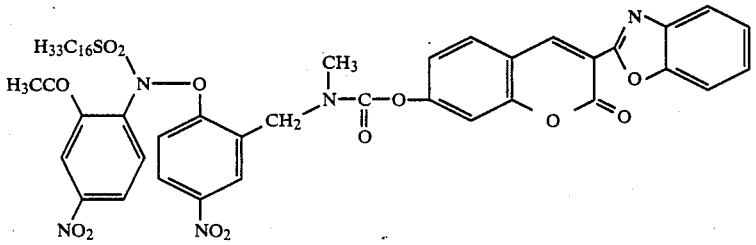

-continued
28
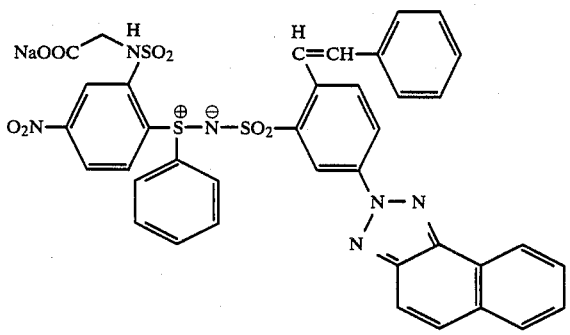
29
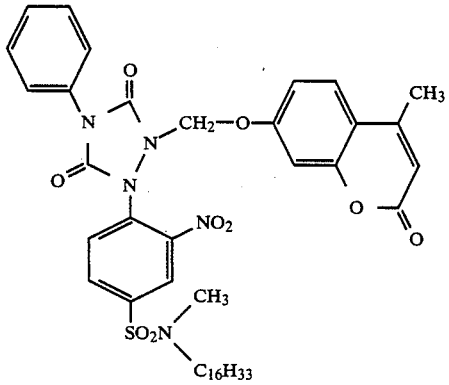
30
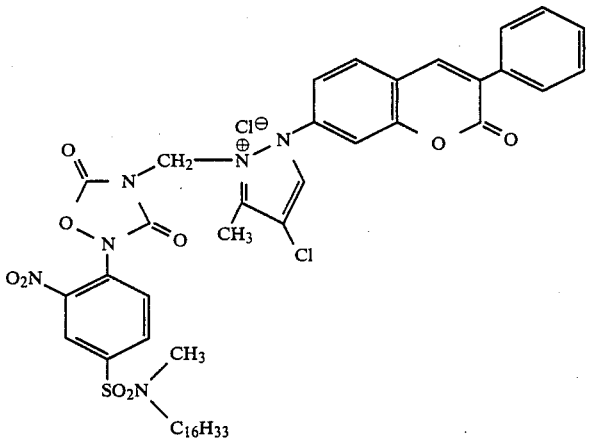
31
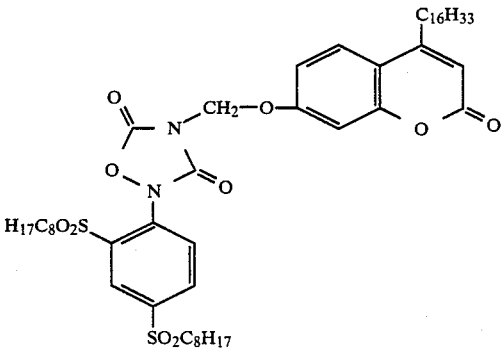

-continued
32
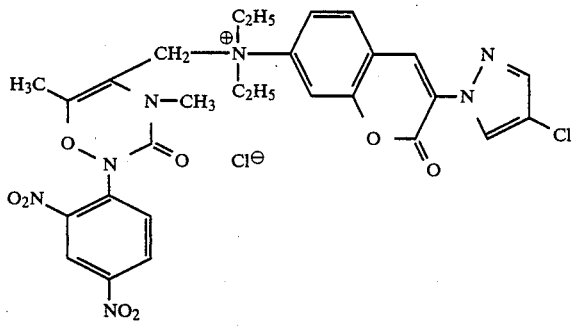
33
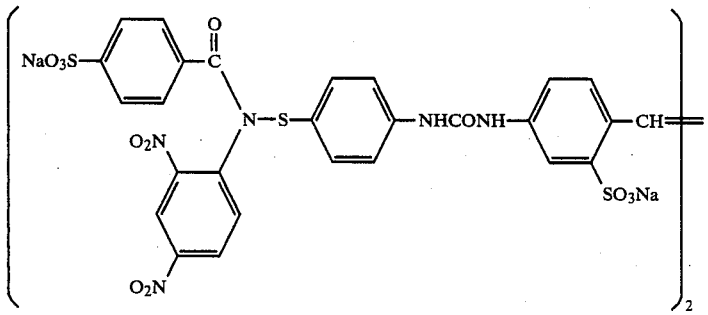
34
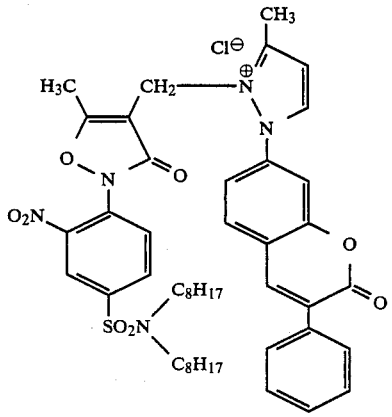
35
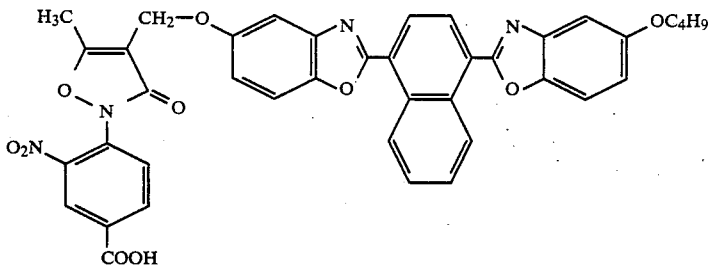
36
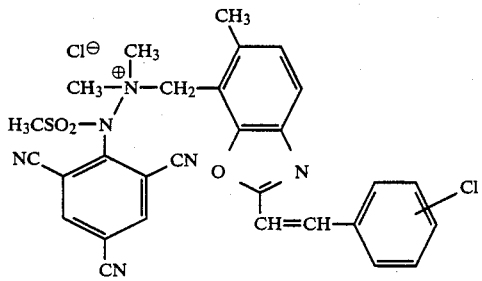

-continued
37
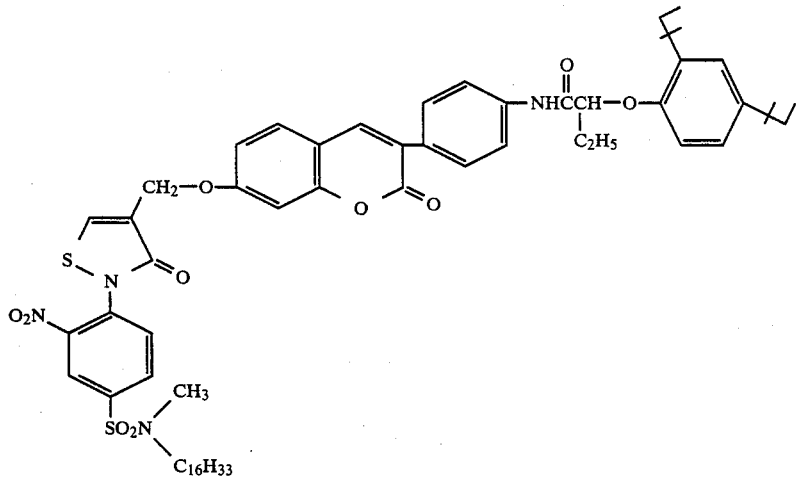
38
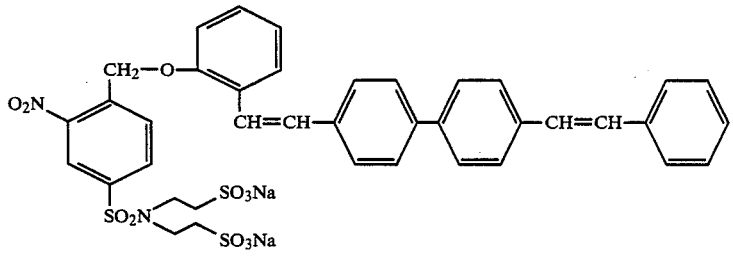
39
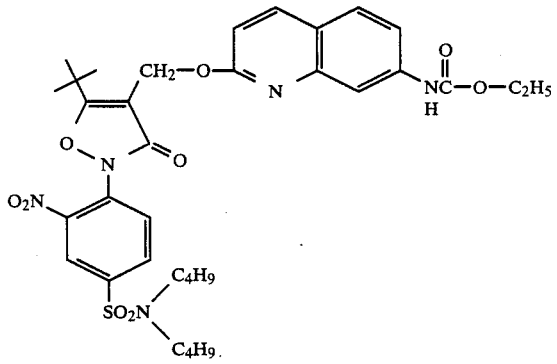
40
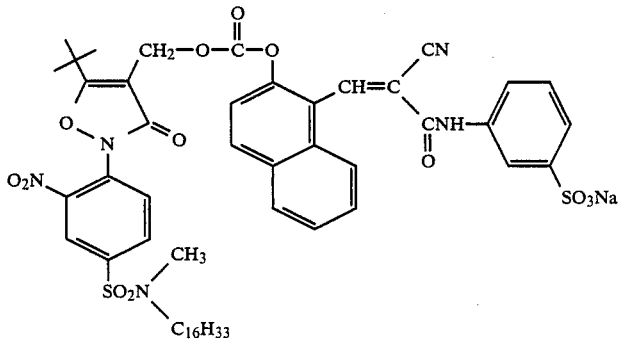

-continued
41
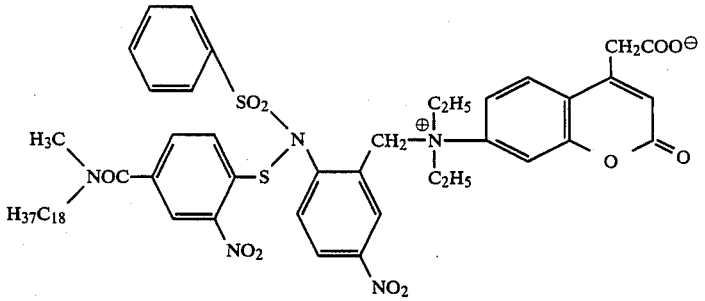
42
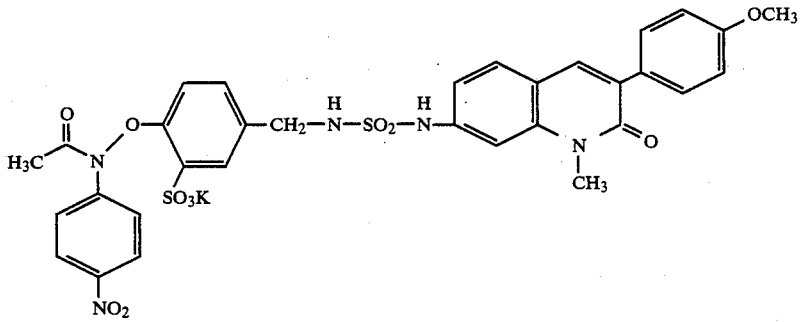
43
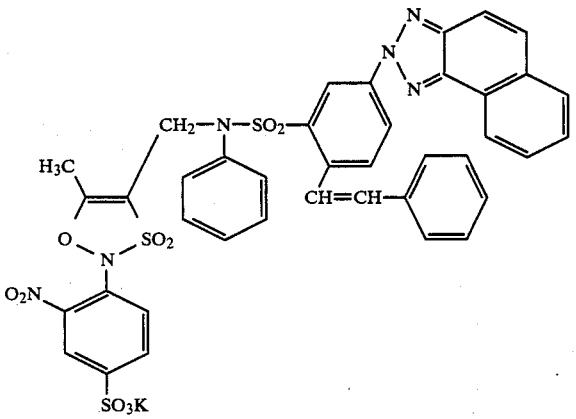
44
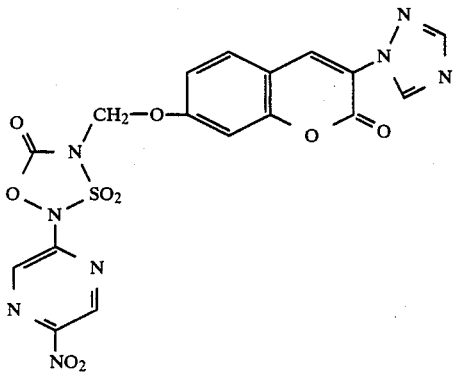

-continued
45
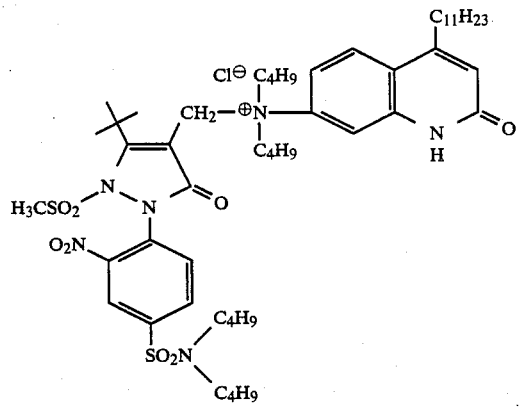
46
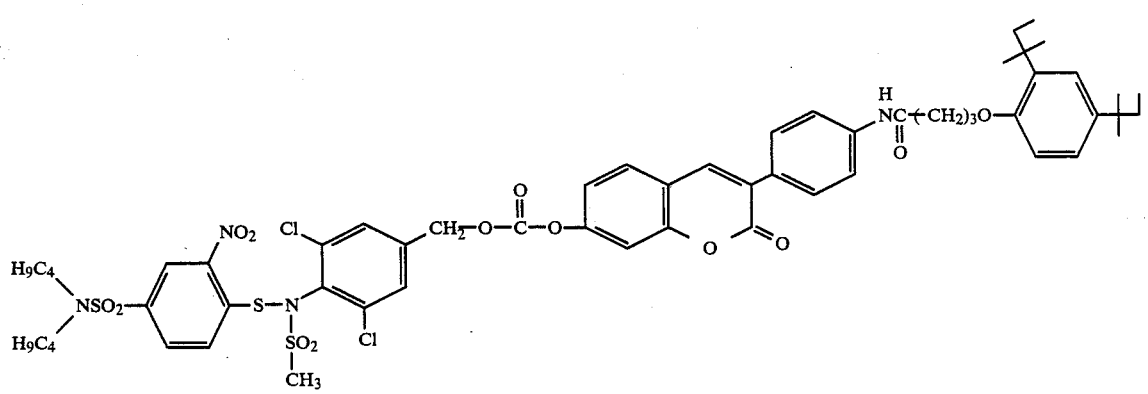
47
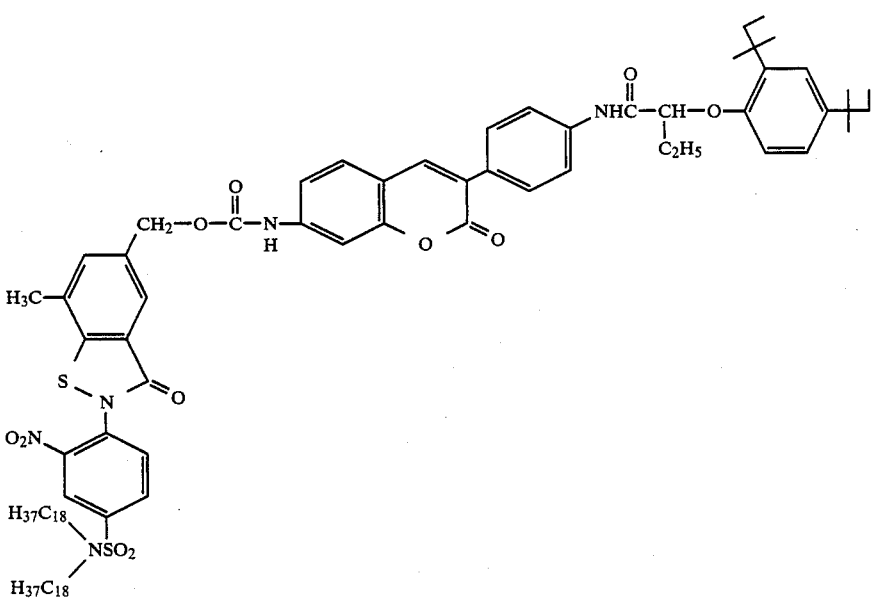

-continued
48
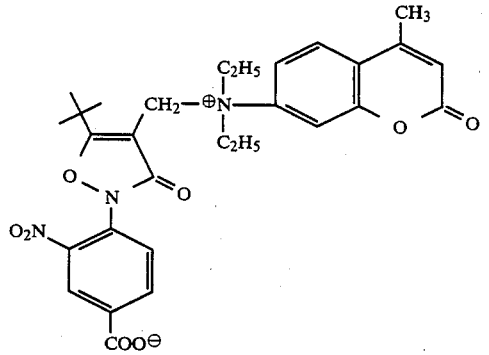
49
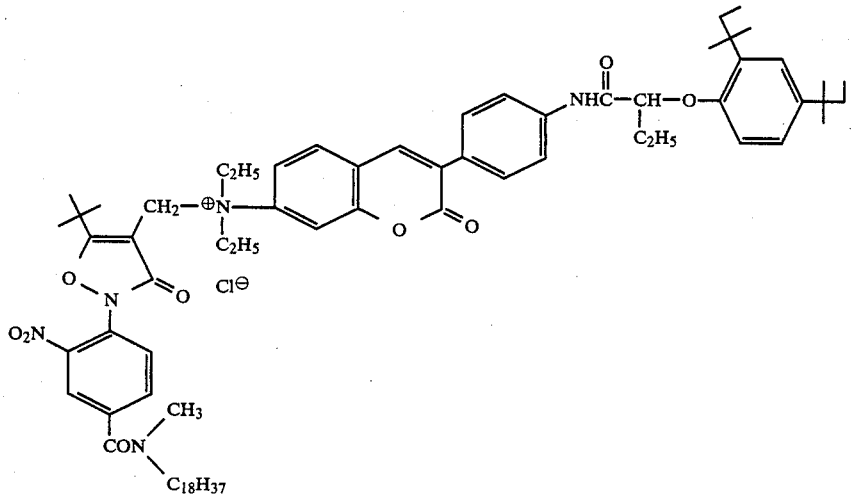
50
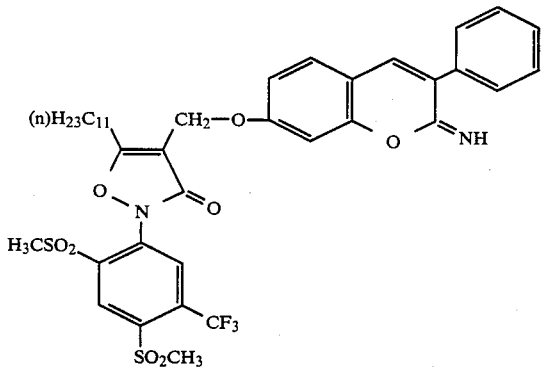
51
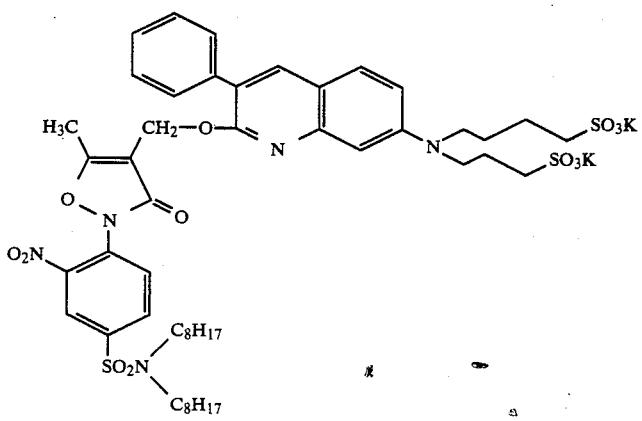

-continued
52
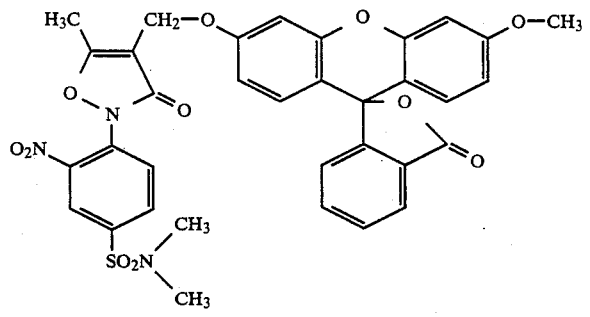
53
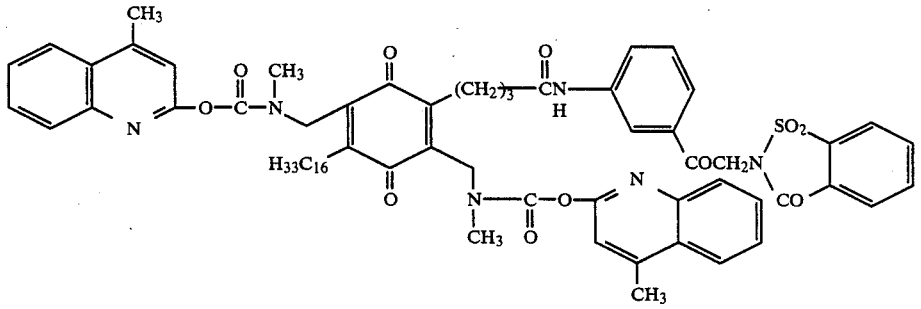
54
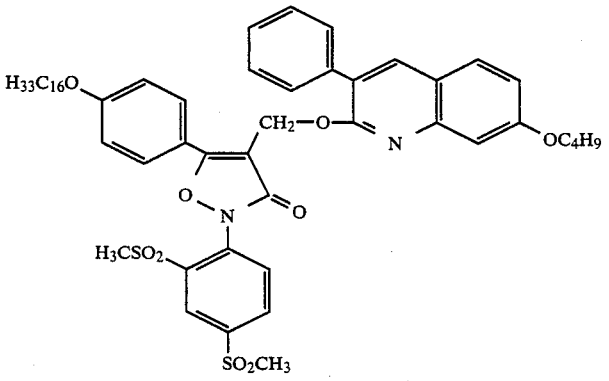
55
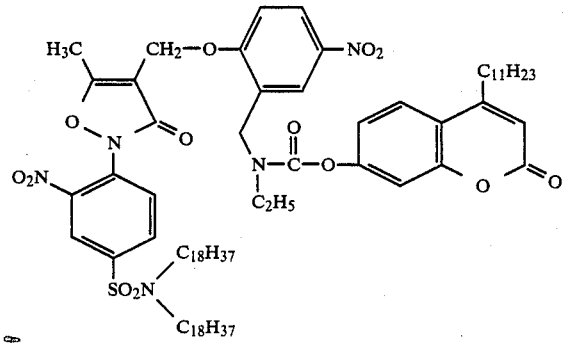

-continued
56
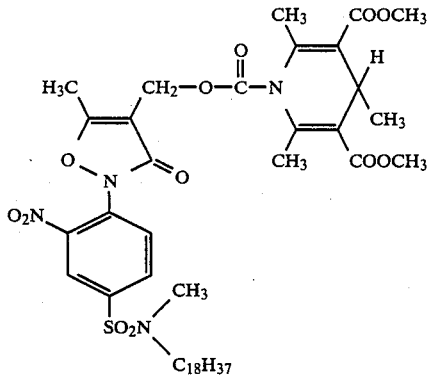
57
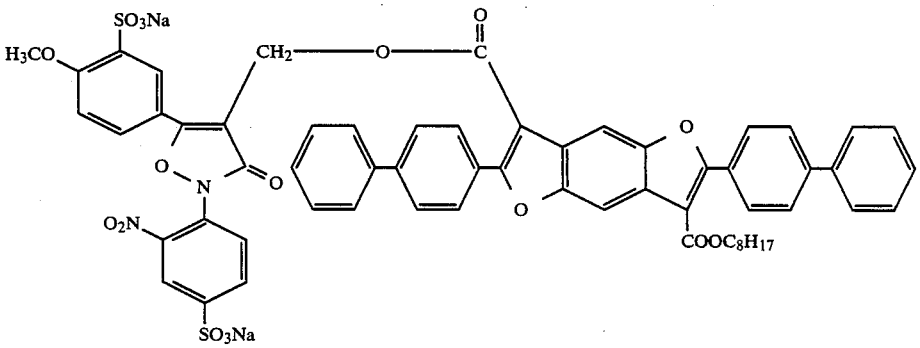
58
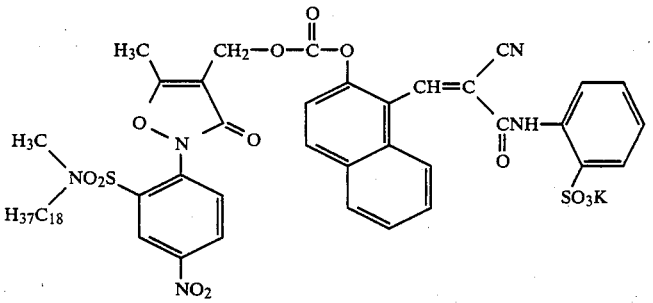
59
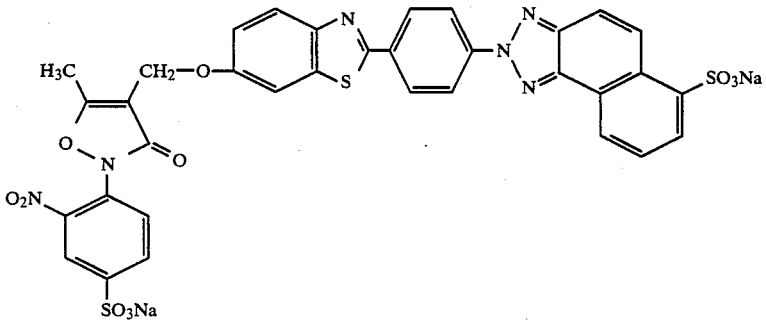

-continued
60
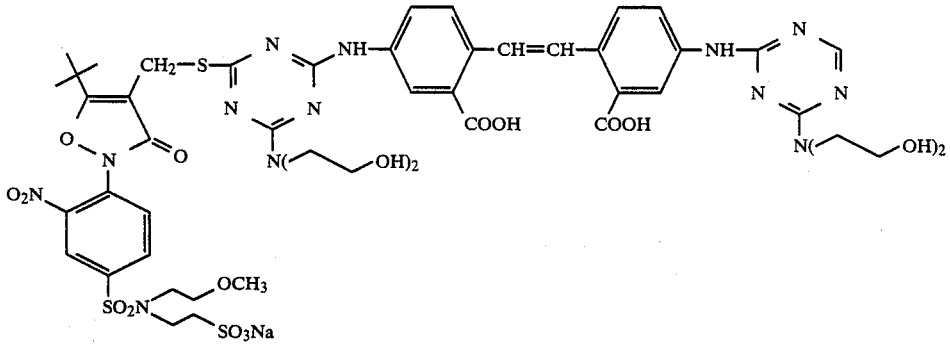
61
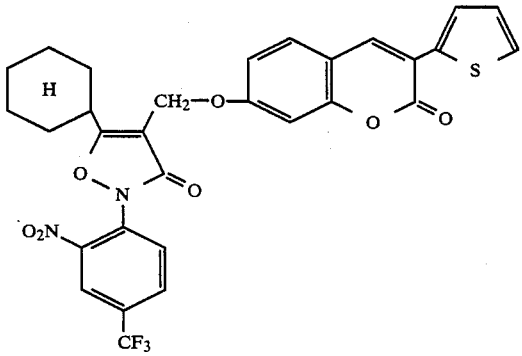
62
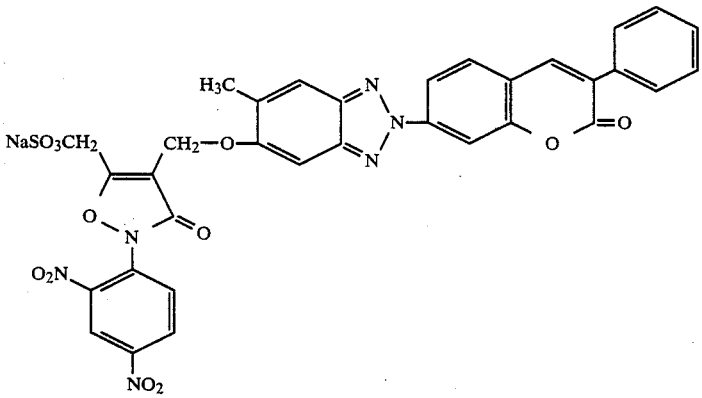
63
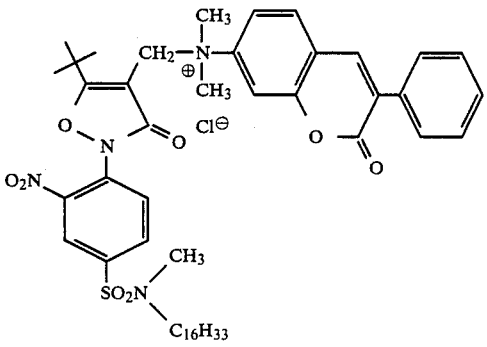

-continued
64
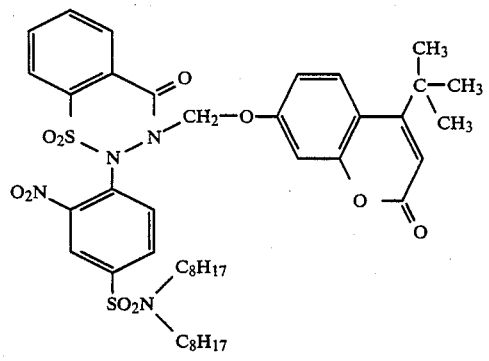
65
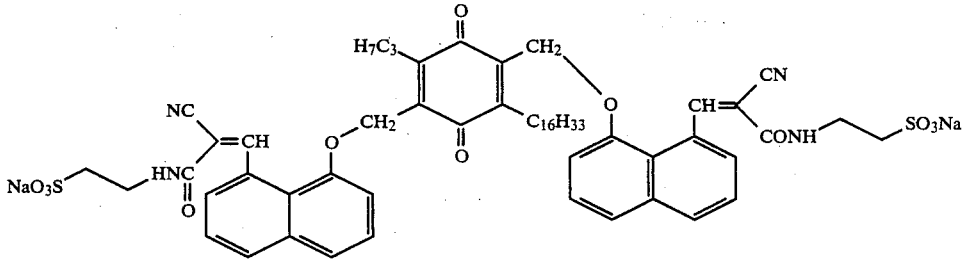
66
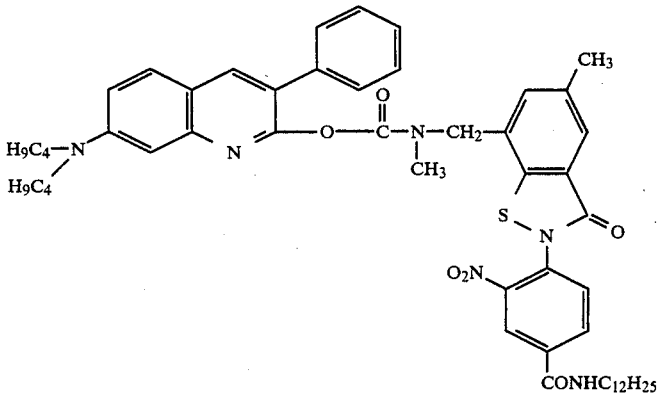
67
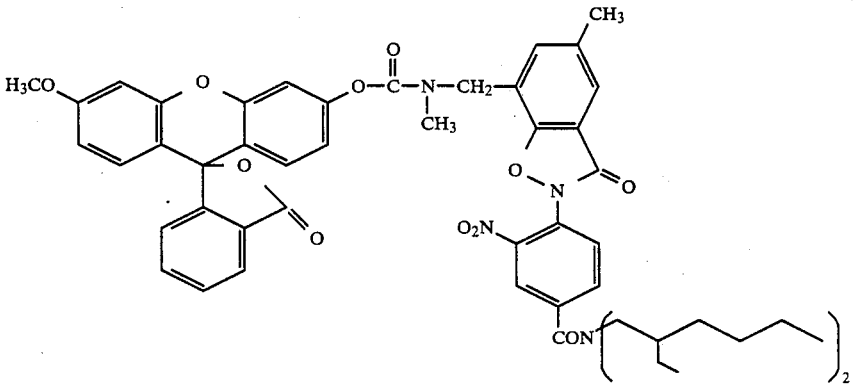

-continued
68
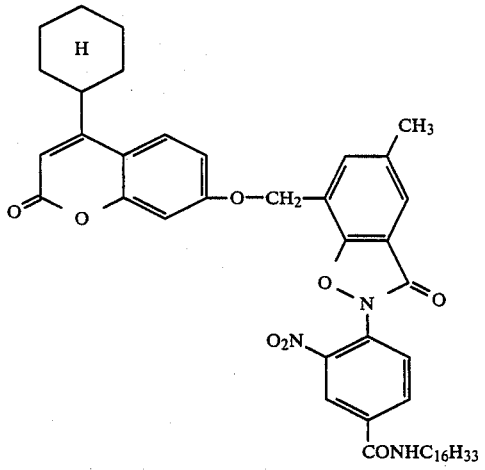
69
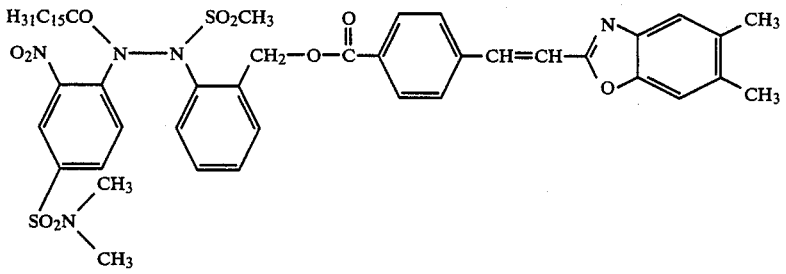
70
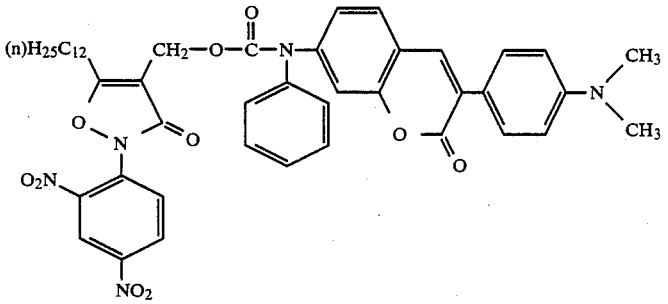
71
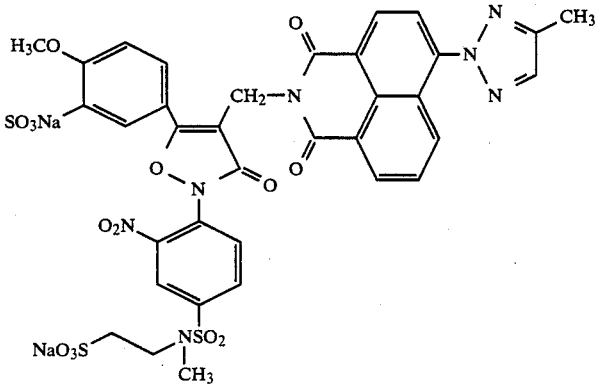

-continued
72
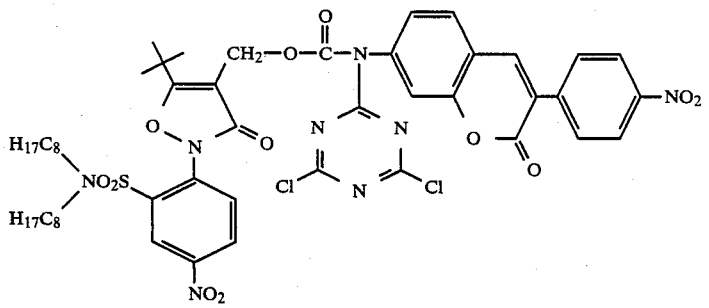
73
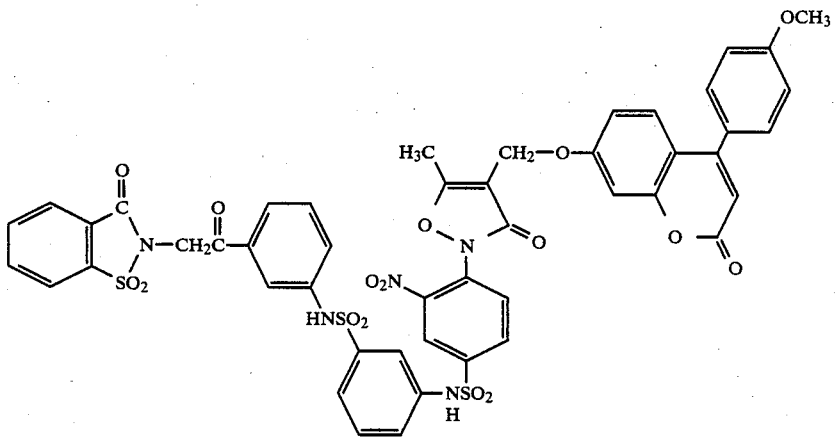
74
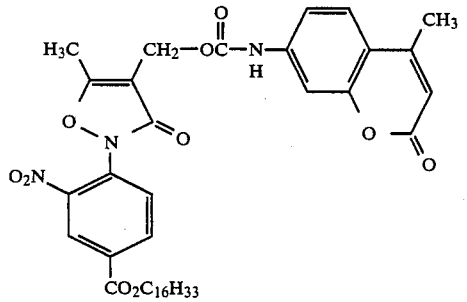
75
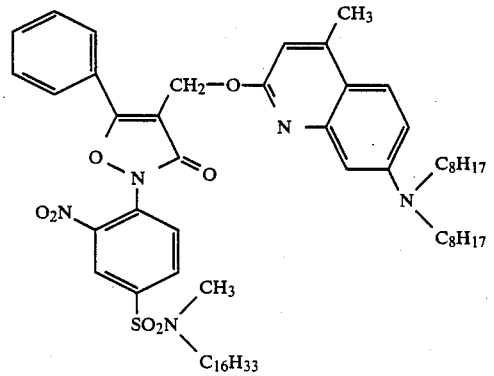

-continued
76
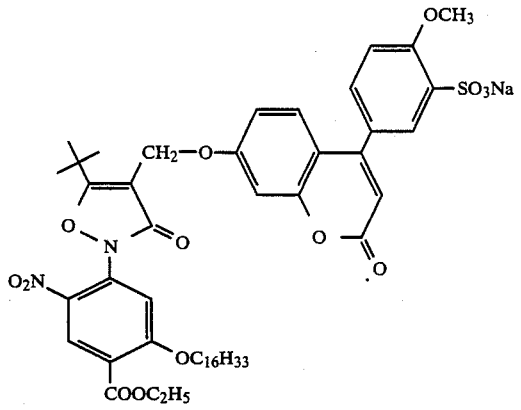
77
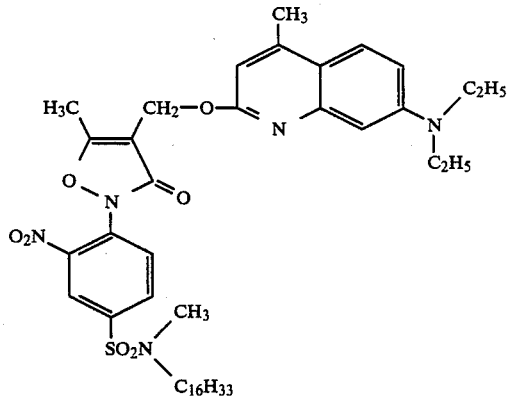
78
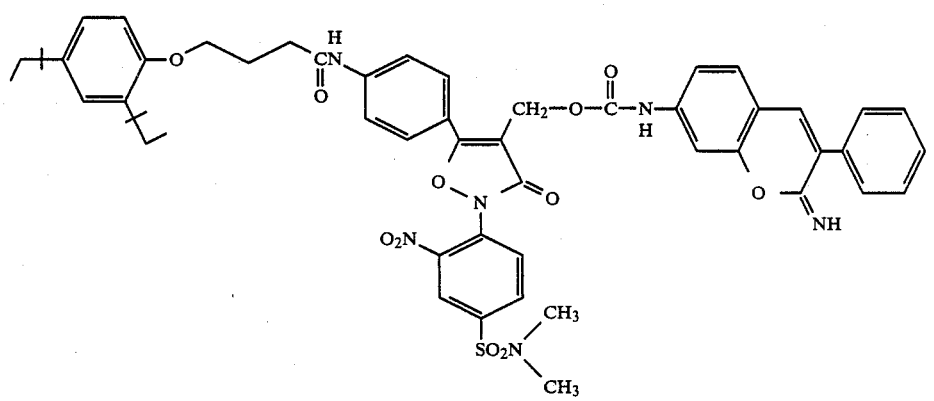
79
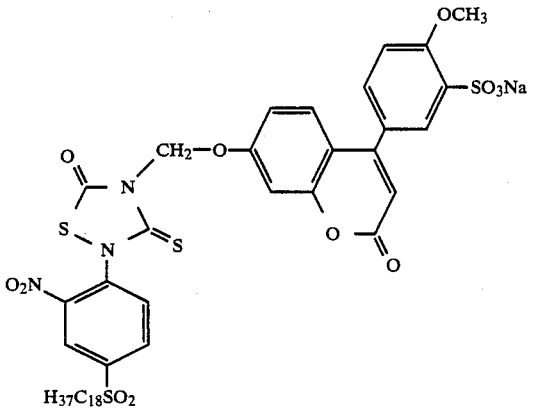

-continued
80
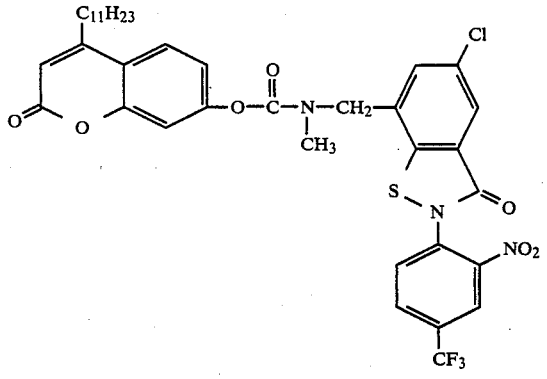
81
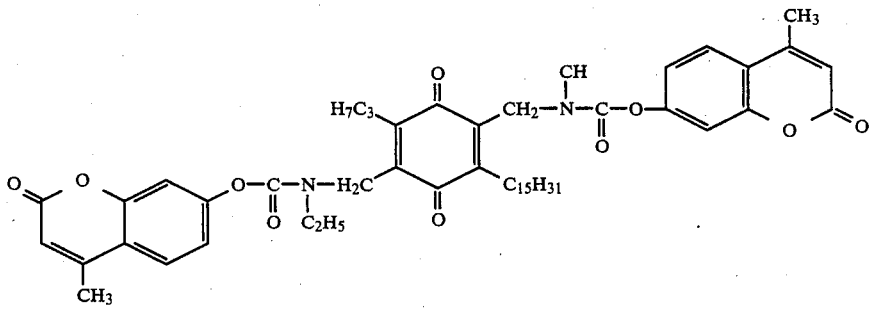
82
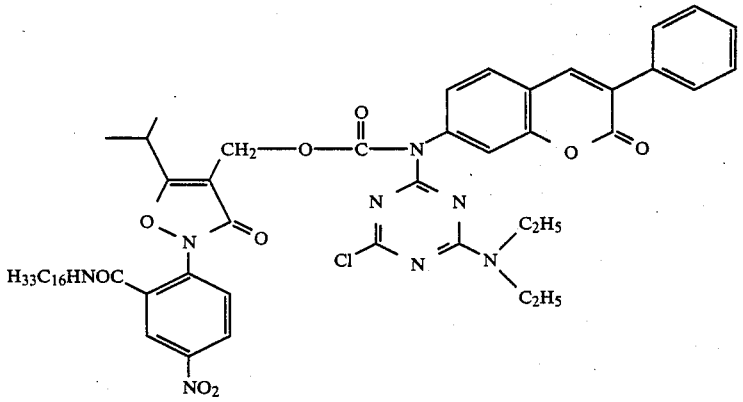
83
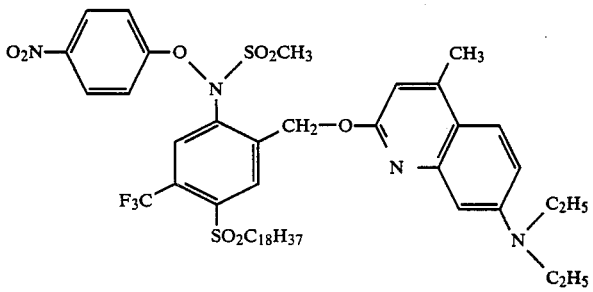

-continued

84

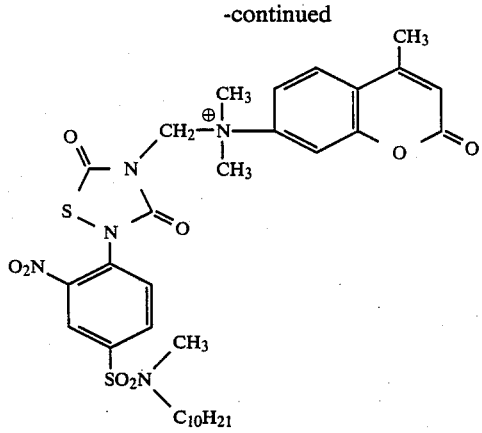

Methods for the production of the compounds of the present invention are described in detail below.

The moiety PWR in the compounds of the formula (I) described above, can be produced by reference to the production examples set forth in U. S. Pat. Nos. 4,139,389, 4,139,379, and 4,564,577; Japanese Patent Application (OPI) Nos. 185333/84 and 84453/82; U.S. Pat. 4,232,107; Japanese Patent Application (OPI) No. 101649/84; *Research Disclosure* (1985), IV, (RD No. 24025); Japanese Patent Application (OPI) No. 88257/86; West German Patent Application (OLS) No. 3,008,588; Japanese Patent Application (OPI) No. 142530/81; U.S. Pat. Nos. 4,343,893, 4,619,884, 4,450,223, and 4,609,610; etc., which are referred to in the aforesaid description for detailed explanation for the moiety PWR. The production of the moiety PWR in the compounds of the formula (II) will be described in greater detail below.

The connection of the moiety PWR with the moiety —(Time)$_t$—FWA, can be effected by reference to the above-noted patent publications and the method which will be described hereinafter.

The moiety FWA can be produced by reference to the patent publications, literatures, etc., which are set forth above in the detailed explanation for the moiety FWA; and the moiety Time can be produced by reference to the description of Japanese Patent Application (OPI) Nos. 147244/86 and 244873/85 and the patent publications referred to therein.

Accordingly, the method of production of the compounds of formula (II) will be described in detail hereinafter. However, since it is difficult to generically describe the general method for production of the compounds of the formula (II), the compounds of the formula (II) are grouped into plural groups on the basis of the kind of the X atom (i.e., oxygen, sulfur, nitrogen) bonded to the nitrogen atom in the formula (II). The general production methods for the respective groups are set forth below. For easy understanding of the production methods, concrete examples of the production methods are shown.

First, a general method for production of the compounds of the formula (II), in which X is an oxygen atom, is described below.

For the production of the compounds of this kind, the most significant point resides in the process of binding the nitrogen-oxygen group moiety and the electron-accepting group moiety. The binding process includes two different methods which are (1) a method in which a nitro group is introduced into the electron-accepting moiety and then reduced with a zinc-ammonium chloride series reagent to give a hydroxylamine and the resulting hydroxylamine is bound with the —(Time)$_t$—FWA moiety; and (2) a method in which a group which is easily substitutable (such as a halogen atom) is introduced into the electron-accepting group moiety and the group is substituted by a hydroxylamine or an equivalent group thereof by nucleophilic displacement. Regarding the method (1), the compounds of the formula (II) can be produced in accordance with the method described in S.P. Sandler & W. Karo, *Organic Functional Group Preparations.* Regarding the method (2), the production of the compounds of the formula (II) can be attained by reaction of the starting compounds in ethanol, dimethylformamide or dimethyl sulfoxide under a neutral or basic condition.

Next, a general method for the production of the compounds of formula (II), in which X is a sulfur atom and the nitrogen-sulfur bond is not contained in the hetero ring structure, is set forth below. The method includes the following two process routes (A) and (B).

The (A) route comprises producing a sulfenamide from a sulfenyl chloride and an amine and converting the thus produced sulfenamide into an N-acyl or N-sulfonylsulfenamide by utilizing the nucleophilic property of the remaining amine.

The (B) route comprises first producing an N-acylated or N-sulfonylated compound and forming an anion on the nitrogen atom of the resulting compound for nucleophilic displacement reaction with a sulfenyl chloride.

Production of the sulfenyl chloride may be attained by reaction of the corresponding disulfide or thiol and chlorine or sulfuryl chloride. The disulfide can be produced mainly by displacement reaction of an alkali disulfide and a compound of $R_1$—Cl (or $R_1$—$N_2^+X^-$). For the production of the thiol, see the general production method described in Saul Patai, *The Chemistry of the Thiol Group Part I* (published by John Wiley & Sons), Chap. 4.

On the other hand, the general method for production of the compounds of the formula (II) in which the nitrogen-sulfur bond is contained in a part of the hetero ring structure includes the following two processes.

The first process comprises producing a hetero ring containing a nitrogen-sulfur bond and then binding the nitrogen atom with the electron-accepting group moiety. The production of the hetero ring is described in the known literatures, for example, *Comprehensive Heterocyclic Chemistry,* which mentions much of the production of the ring. The reaction of the resulting hetero ring with the electron-accepting group moiety can be carried out in a solvent such as ethanol, dimethylformamide or dimethyl sulfoxide under neutral or basic conditions. The other comprises ring-closure with nitrogen as bonded at the electron-accepting group moiety.

Next, a general method for production of the compounds of formula (II), in which X represents a nitrogen atom, is set forth below. This comprises the following two processes.

Method (A):

A compound having an aromatic nucleophilic displaceable electron-accepting group (such as 4-halo-3-nitrobenzenesulfonamides) is reacted with a hydrazide or sulfonylhydrazine in an aprotic polar solvent such as dimethyl sulfoxide or dimethylformamide in the presence of a base and then halomethylated, and the resulting product is bonded with FWA by displacement reaction. Alternatively, if FWA is reactive to hydrazine or sulfonylhydrazine, this may directly be reacted with hydrazine or sulfonylhydrazine. Thus, the compounds of the noted type can be produced.

Method (B):

A compound having an aromatic nucleophilic displaceable electron-accepting group (such as 4-halo-3-nitrobenzenesulfonamides) is reacted with a heterocyclic compound having an N-N single bond in which any one of the nitrogen atoms of the bond is dissociative in an aprotic polar solvent in the same manner as Method (A), so as to bond the electron-accepting group to the nitrogen atom of the hetero ring. Selection of the above-mentioned heterocyclic compounds by utilizing the reaction can be associated with the release of FWA, as shown in some examples of the aforesaid compounds for use in the present invention.

In order to facilitate the understanding of the general production methods described above, some production examples are shown hereinafter.

*Production Example* 1: Production of Compound No. 1

Step 1: Production of 5-Methyl-3-hydroxyisoxazole

This was produced by the method described in *Canadian Journal of Chemistry,* 62, 1940 (1984). Specifically, refer to the operation of Step 1 of Production Example 2. The compound had a melting point of 85° to 86° C.

Step 2: Production of 4-Chloro-3-nitrobenzenesulfonyl Chloride:

1250 ml of phosphorus oxychloride was added dropwise to a mixture comprising 1280 g of potassium 4-chloro-3-nitrobenzenesulfonate, 1150 ml of acetonitrile, 250 ml of sulforane and 30 ml of dimethylacetamide, while the inner temperature of the reaction system was kept at from 60° C. to 70° C. After being reacted for 3 hours at 73° C., the reaction mixture was cooled with water and 400 ml of water was gradually added thereto, and then the resulting mixture was poured into 5 liters of ice-water. The crystal precipitated was taken out by filtration, washed with water and dried. Yield: 1060 g, 84%.

Step 3: Production of 4-Chloro-3-nitro N-hexadecylbenzenesulfonamide:

1 liter of dichloromethane was added to 800 g of 4 chloro-3-nitrobenzenesulfonyl chloride and cooled to 0° C. To the solution was added dropwise a mixture comprising 600 g of hexadecylamine, 251 ml of triethylamine and 780 ml of dichloromethane at 20 to 30° C. After being reacted for 2 hours at room temperature, the dichloromethane was removed by distillation under reduced pressure, and 3 liters of methanol was added to the residue and dissolved under heat. The resulting solution was gradually cooled and crystallized out at room temperature. Further, 3 liters of methanol was added and the resulting solution was again crystallized out under ice-cooling, and the crystal precipitated was taken out by filtration and dried. Yield: 1020 g, 88%.

Step 4: Production of 4-Chloro-3-nitro-N-methyl-N-hexadecylbenzenesulfonamide:

170 g of 4-chloro-3-nitro-N-hexadecylbenzenesulfonamide was dissolved in 640 ml of acetone, and 79 g of potassium carbonate, 4006 ml of polyethylene glycol and 71 g of dimethylsulfuric acid were then added thereto and heated under reflux for 5 hours. 240 ml of acetone was added thereto, 870 ml of water was added dropwise at 40° C., and the whole was cooled to room temperature, whereby a crystal precipitated out. The crystal was taken out by filtration, washed with water and methanol, and dried. Yield: 169 g, 97%.

Step 5: Production of 5-Methyl-2-(4-N-methyl-N-hexadecylsulfamoyl-2-nitrophenyl)-3-isoxazolone:

160 g of the 4-chloro-3-nitro-N-methyl-N-hexadecylbenzenesulfonamide produced in Step 4 was mixed with 48 g of 5-methyl-3-hydroxyisoxazole, 64 g of sodium hydrogen carbonate and 500 ml of dimethyl sulfoxide and reacted at 75° C. for 6 hours. The reaction mixture was poured into a hydrochloric acid aqueous solution and the crystal precipitated was taken out by filtration and recrystallized from methanol. Yield: 179 g, 99%.

Step 6: Production of 5-Methyl-4-chloromethyl-2-(4-N-methyl-N-hexadecylsulfamoyl-2-nitrophenyl)-3-isoxazolone:

160 g of the 5-methyl-2-(4-N-methyl-N-hexadecylsulfamoyl-2-nitrophenyl)-3-isoxazolone produced in Step 5 was mixed with 50 g of zinc chloride, 70 g of paraormaldehyde, 500 ml of acetic acid and 5 ml of concentrated sulfuric acid and stirred for 9 hours at 75° C., while hydrogen chloride gas was blown into the mixture.

After being cooled, the reaction mixture was poured into water and the crystal thus precipitated was taken out by filtration and recrystallized from methanol. Yield: 163 g, 94%. Step 7: Production of Compound No. 1:

200 ml of acetone was added to 22.2 g of 5-methyl-4-chloromethyl-2-(4-N-methyl-N-hexadecylsulfamoyl-2-nitrophenyl)-3-isoxazolone, 10.0 g of 4-methylumbelliferone, 2.0 g of potassium carbonate and 0.5 g of sodium iodide and heated under reflux for 1 hour.

The reaction mixture was poured into an aqueous dilute hydrochloric acid solution, and the precipitate formed was taken out by filtration and then recrystallized from acetonitrile. Yield: 35.1 g, 85%. m.p. 59° C. to 60° C.

Production Example 2: Production of Compound No. 63

The compound can be produced with ease by reference to the methods described in the following literature and patent publications.

*Sankyo Laboratory Annual Report,* Vol. 22, page 215 (1970); Japanese Patent Publication No. 9675/77; *Bulletin de la Societe Chemique de France,* page 1978; Japanese Patent Application (OPI) Nos. 206668/82 and 206667/82; *Tetrahedron,* Vol. 20, page 2835 (1964); Japanese Patent Application (OPI) Nos. 194867/83 and 70878/82; Japanese Patent Publication No. 48953/74; Japanese Patent Application (OPI) No. 190977/84; *Journal of Organic Chemistry,* Vol. 48, page 4307 (1983); *Chemical and Pharmaceutical Bulletin,* Vol. 14, page 277; *Heterocycles,* Vol. 12, No. 10, page 1297; *Canadian Journal of Chemistry,* Vol. 62, page 1940; WO 8401774, etc.

A specific operation for the production of the compound is mentioned below.

Step 1: Production of 5-t-Butyl-3-hydroxyisoxazole:

583.7 g of hydroxylamine hydrochloride was dissolved in 2 liters of an aqueous 4N sodium hydroxide solution, and 2 liters of ethanol was added thereto with ice cooling. Further, a mixed solution of aqueous 4N sodium hydroxide-ethanol (1/1) was added so that the pH value of the resulting solution was adjusted to 10.0. To this solution were added dropwise 1380 g of ethyl pivaoloylacetate and a mixed solution of aqueous 4N sodium hydroxide-ethanol (1/1) at the same time, so that the pH of the reaction solution could be 10±0.2 and the temperature thereof could be from 0° to 5° C.

After the completion of the dropwise addition, the mixture was stirred for 2 hours at room temperature and then poured into 6 kg of a concentrated hydrochloric acid solution at 0° C., and the mixture was left as such for 12 hours. The crystal precipitated was taken out by filtration, fully washed with water and then dried. Yield: 770 g, 68.2%.

Step 2: Production of 5-t-Butyl-2-(4-N-methyl-N-hexadecylsulfamoyl-2-nitrophenyl)-3-isoxazolone:

470 g of the 4-chloro-3-nitro-N-methyl-N-hexadecylbenzenesulfonamide produced in Step 4 of Production Example 1, 169 g of the 5-t-butyl-3-hydroxyisoxazole produced in Step 1, 168 g of potassium carbonate and 1.2 liters of dimethyl sulfoxide were mixed and reacted for 6 hours at 65° C.

The reaction mixture was poured into ice-water and the crystal precipitated was taken out by filtration, washed with water and then dried. Yield: 576 g, 100%.

Step 3: Production of 5-t-Butyl-4-chloromethyl-2-(4-N-methyl-N-hexadecylsulfamoyl-2-nitrophenyl)-3-isoxazolone:

550 g of 5-t-butyl-2-(4-N-methyl-N-hexadecylsulfamoyl-2-nitrophenyl-3-isoxazolone, 200 g of zinc chloride, 200 g of paraformaldehyde and 1.5 liters of acetic acid were mixed and heated under reflux for 10 hours while hydrogen chloride gas was blown into the mixture. After being cooled, the reaction mixture was poured into water, and the crystal precipitated was taken out by filtration and recrystallized from a mixed solvent of acetonitrile/methanol (1/4). Yield: 585 g, 96%.

Step 4: Production of Compound No. 63:

30 g of 5-t-butyl-4-chloromethyl-2-(4-N-methyl-N-hexadecylsulfamoyl-2-nitrophenyl)-3-isoxazolone and 63.2 g of Brightening Agent (A)(*) (set forth below) were dissolved in 150 ml of dimethyl sulfoxide and stirred for 40 hours at room temperature. Water was added to the reaction mixture, and the crystal precipitated was taken out by filtration and recrystallized from a mixed solvent of ethyl acetate-benzene (5/1). Yield: 9.4 g, 23%. m.p. 8° C. to 40° C.

Brighteninq Agent (A)(*):

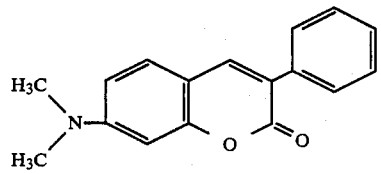

Production Example 3: Production of Compound No. 5:

Step 1: Production of 4-Chloro-3-nitro-N-methyl-N-octadecylbenzamide:

105.7 g of 3-nitro-4-chlorobenzoic acid and 800 ml of acetonitrile were blended, and 68.6 g of thionyl chloride was added thereto and heated under reflux for 4 hours. After being cooled, the solvent was removed by distillation, and the resulting residue was dissolved in chloroform. 63.5 g of triethylamine was added to the resulting solution and this was adjusted to have a temperature of 5° C. Next, a chloroform solution containing 148.6 g of N-methyloctadecylamine was added dropwise thereto. After completion of the reaction, water was added to the reaction mixture for liquid separation. The organic phase separated was dried over anhydrous sodium sulfate. The inorganic substance was separated by filtration, and the solvent was then removed by distillation. The product was recrystallized from acetonitrile-methanol (1/3). Yield: 186 g, 76.0%.

Step 2: Production of 5-t-Butyl-2-(4-N-methyl-N-octadecylcarbamoyl-2-nitrophenyl)-3-isoxazolone:

300 ml of dimethylformamide was added to 34.1 g of N-methyl-N-octadecyl-3-nitro-4-chlorobenzamide, 12.4 g of 5-t-butyl-3-hydroxyisoxazole and 12.4 g of potassium carbonate and reacted for 5 hours at 100° C. The solvent was removed by distillation under reduced pressure, and ethyl acetate and water were added to the residue and stirred. Then, the organic layer separated was taken out and the main product was isolated by silica gel column chromatography. This was then recrystallized from n-hexane-ethyl acetate. Yield: 18.9 g, 43.1%.

Step 3: Production of 4-Chloromethyl-5-t-butyl-2-(4-N-methyl-N-octadecylcarbamoyl-2-nitrophenyl)-3-isoxazolone:

36 g of 5-t-butyl-2-(4-N-methyl-N-octadecylcarbamoyl-2-nitrophenyl)-3-isoxazolone, 5.7 g of paraformaldehyde and 10.3 g of zinc chloride were blended with 250 ml of acetic acid and reacted for 20 hours at 100° C., while hydrogen chloride gas was blown into the mixture. After completion of the reaction, the reaction mixture was cooled and then poured into ice-water. The solid precipitated was taken out by filtration, dissolved in chloroform and purified by column chromatography. Yield: 10.0 g, 26%.

Step 4: Production of 4-Hydroxymethyl-5-t-butyl-2-(4-N-methyl-N-octadecylcarbamoyl-2-nitrophenyl)-3-isoxazolone:

50 g of the chloride produced in Step 3 was dissolved in 150 ml of dimethyl sulfoxide, and 1.5 g of sodium iodide and 41 g of potassium acetate were added thereto and stirred for 3 hours at room temperature.

The reaction mixture was poured into water and the crystal precipitated was taken out by filtration. This was added to a mixed solvent comprising 800 ml of ethanol, 80 ml of water and 80 ml of concentrated hydrochloric acid. After being heated under reflux for 1 hour, water was added to the reaction mixture and the resulting solution was spontaneously cooled. The crystal thus precipitated was taken out by filtration. Yield: 42 g, 87%.

Step 5: Production of Compound No. 5:

40.0 g of 4-hydroxymethyl-5-t-butyl-2-(4-N-methyl-N-octadecylcarbamoyl-2-nitrophenyl)-3-isoxazolone and 27 g of Compound (B)(*) (set forth below) were dissolved in a mixed solvent of acetone-DMF, and 13.8 g of potassium carbonate was added thereto and stirred for 60 hours at 40° C.

The reaction mixture was put into an aqueous dilute hydrochloric acid solution and extracted with ethyl acetate, and then the resulting extract was concentrated. The residue was subjected to silica gel flash column chromatography and the product was obtained from the fraction eluted with chloroform-methanol (3/1).

Compound (B)(*):

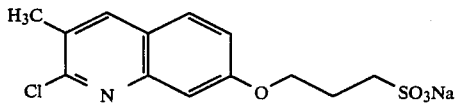

Yield: 15.9 g, 26%. m.p. >200° C.

Production Example 4: Production of Compound No. 4

Step 1: Production of N-Methyl-N-octadecyl-5-nitro-2-chlorobenzenesulfonamide:

44 g of 5-nitro-2-chlorobenzenesulfonyl chloride and 100 ml of. dichloromethane were blended, and a dichloromethane solution containing 48.4 g of methyloctadecylamine and 36.1 ml of triethylamine was added dropwise thereto. After completion of the reaction, the reaction solvent was removed by distillation under reduced pressure. 300 ml of methanol was added to the residue and dissolved, and then the resulting solution was gradually cooled to precipitate a crystal. The crystal was taken out by filtration and dried. Yield: 64 g, 74%.

Step 2: Production of 5-t-Butyl-2-(2-N-methyl-N-octadecylsulfamoyl-4-nitrophenyl)-4-isoxazolin-3-one:

62.0 g of N-methyl-N-octadecyl-5-nitro-2-chlorobenzenesulfonamide, 20.9 g of 5-t-butyl-3-hydroxyisoxazole, 20.7 g of potassium carbonate and 300 ml of dimethylformamide were blended and reacted for 6 hours at 80° C. The reaction mixture was poured into ice-water and ethyl acetate was added thereto for extraction. The organic layer was dried to solid under reduced pressure, and the residue was purified by silica gel column chromatography. The intended product was eluted with n-hexane-ethyl acetate (2/1). Yield: 29.0 g, 37%.

Step 3: Production of 5-t-Butyl-4-chloromethyl-2-(2-N-methyl-N-octadecylsulfamoyl-4-nitrophenyl)-4-isoxazolin-3-one:

20 g of 5-t-butyl-2-(2-N-methyl-N-octadecylsulfamoyl-4-nitrophenyl)-4-isoxazolin-3-one, 5.4 g of zinc chloride, 3 g of paraformaldehyde and 100 ml of acetic acid were blended and heated under reflux for 10 hours, while hydrogen chloride gas was blown into the mixture. After being cooled, the reaction mixture was poured into ice-water and ethyl acetate was added thereto for extraction. The organic layer was dried to solid under reduced pressure, and the residue was purified by silica gel column chromatography. The intended product was eluted with n-hexane-ethyl acetate (2/1). Yield: 12.0 g, 58%.

Step 4: Production of Compound No. 4:

The compound was obtained by the same operation as in Step 4 for the production of Compound No. 63 in Production Example 2. Yield: 18%. m.p. near room temperature.

Production Example 5: Production of Compound No. 37

Step 1: Production of 2 Nitro-4 (N-methyl-N-hexadecylsulfamoyl)aniline:

This was produced in accordance with the method shown in Production Example 1.

100 g of 4-chloro-3-nitro-N-methyl-N-hexadecylbenzenesulfonamide was dissolved in 300 ml of dimethyl sulfoxide, and ammonia gas was blown into the mixture. While the gas was continuously blown thereinto, the reaction system was heated up to 80° C. and stirred for 6 hours. The reaction mixture was changed to yellow brown and this was poured into ice-water, and the crystal precipitated was taken out by filtration, fully washed with water and dried. Yield: 95 g, 99%.

Step 2: Production of N,N'-Bis[2-nitro-4-(N-methyl-N-hexadecylsulfamoyl)]-3,3'-dithiodipropionanilide:

50 g of 2-nitro-4 (N-methyl-N hexadecylsulfamoyl-)aniline was dissolved in 300 ml of methylene chloride. While well stirring under ice-cooling, 16.3 g of 3,3'-dithiopropionyl dichloride was added dropwise, and then the reaction mixture was stirred for 2 hours at room temperature and then poured into ice water. This was extracted with methylene chloride, and the resulting extract was washed with water and dried. The solvent was removed by distillation under reduced pressure. Methanol was added to the resulting residue for crystallization. Yield: 52 g, 87%.

Step 3: Production of 2-[2-Nitro-4-(N-methyl-N-hexadecylsulfamoyl)]-4-isothiazolin-3-one:

40 g of N,N'-bis[2-nitro-4 (N-methyl-N-hexadecylsulfamoyl)]-3,3'-dithiodipropionanilide was suspended in 100 ml of toluene, and 15 g of sulfuryl chloride was added dropwise thereto over several hours. After the dropwise addition, 150 ml of toluene was further added and the whole was stirred for 1 hour at room temperature. Ice-water was added thereto for liquid separation. The separated toluene layer was dried, and then the solvent was removed by distillation under reduced pressure. Methanol was added to the residue for crystallization. Yield: 23 g, 57%.

Step 4: Production of 2-[2-Nitro-4-(N-methyl-N-hexadecylsulfamoylphenyl)]-4-chloromethyl-4-isothiazolin-3-one:

15 g of 2-[2-nitro-4-(N-methyl-N-hexadecylsulfamoyl)]-4-isothiazolin-3-one, 6 g of paraformaldehyde and 10 g of zinc chloride were blended with 50 ml of acetic acid and reacted for 5 hours at 80° C., while a hydrogen chloride gas was blown thereinto. After completion of the reaction, the reaction mixture was cooled and then poured into ice-water. The solid precipitated was taken out by filtration and purified by column chromatography. Yield: 7.5 g, 46%.

Step 5: Production of Compound No. 37:

50 ml of acetone was added to 7 g of 2-[2-nitro-4-(N-methyl-N-hexadecylsulfamoylphenyl)]-4-chloromethyl-4-isothiazolin-3-one, 7.9 g of Brightening Agent (C)(*) (set forth below), 3.0 g of potassium carbonate and 0.3 g of sodium iodide, and stirred under heat for 1 hour.

The reaction mixture was poured into an aqueous dilute hydrochloric acid solution and extracted with ethyl acetate, and then the resulting extract was concentrated. The residue was purified by column chromatography, to obtain a pale yellow oily product. Yield: 7.5 g, 57%.

Brightening Aqent (C)(*):

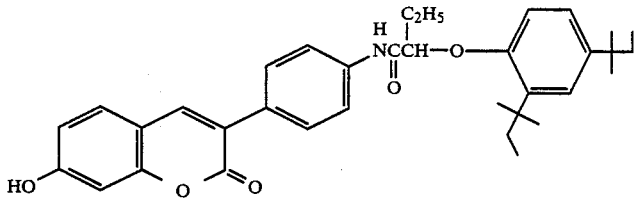

Production Example 6: Production of Compound No. 29

Step 1: Production of 1-(2-Nitro-4-N-methyl-N-hexadecylsulfamoylphenyl)-4-phenyl-1,2,4-triazolin-3,5-dione:

10 g of N-methyl-N-hexadecyl-4-chloro-3-nitrobenzenesulfonamide and 4.1 g of 3-phenyl-1,2,4-triazolin-3,5-dione were dissolved in dimethyl sulfoxide, and 4.4 g of potassium carbonate was added thereto and reacted for 4 hours at 60° C. After the reaction, the reaction mixture was cooled and then poured into an aqueous dilute hydrochloric acid solution with ice to precipitate a crystal. The crystal was recrystallized from a mixed solvent comprising acetonitrile-methanol and a small amount of water. Yield: 7.5 g, 57.7%.

Step 2: Production of 1-(2-Nitro-4-N-methyl-N-hexadecylsulfamoylphenyl)-2-chloromethyl-4-phenyl-1,2,4-triazolin-3,5-dione:

3 g of the compound produced in Step 1 was dissolved in 3 g of acetic acid and 1.0 g of paraformaldehyde was added thereto, and then a hydrogenn chloride gas was blown into the mixture. The reaction temperature was gradually elevated to 80° C. and the mixture was reacted for 5 hours.

After completion of the reaction, the reaction mixture was poured into ice-water and extracted with ethyl acetate. The solvent was removed by distillation and the main product was isolated by silica gel column chromatography. Yield: 1.2 g, 37.1%.

Step 3: Production of Compound No. 29:

50 ml of acetone was added to 4.2 g of the chloride produced in Step 2, 1.4 g of 3-methylumbelliferone, 1.6 g of potassium carbonate and 0.1 g of sodium iodide and heated under reflux for 30 minutes.

The reaction mixture was poured into an aqueous dilute hydrochloric acid solution and extracted with ethyl acetate. The resulting extract was concentrated under reduced pressure, and the residue was purified by column chromatography to obtain the intended product as a colorless powder. Yield: 2.1 g, 38%. m.p. 36° to 41° C.

The compounds of the above-described formulae (I), (II) and (III) for use in the present invention, can be incorporated into hydrophilic colloid layers by well-known methods.

For example, the compound may be dissolved in an appropriate solvent (for example, alcohols (e.g., methanol, ethanol, propanol, etc.), acetone, methyl ethyl ketone, methyl cellosolve, dimethylfomamide, cyclohexanone, ethyl acetate, etc.), and the resulting solution may be dissolved or dispersed in gelatin. Alternatively, the compound may be added to an oil having a high boiling point to give an emulsified dispersion of fine oil droplets, and the dispersion may be added to gelatin. Any conventional oil can be used, including tricresyl phosphate, diethyl phthalate, dibutyl phthalate, triphenyl phosphate, etc.

Other dispersion methods are, for example, as described in U.S. Pat. No. 4,512,969, Japanese Patent Application (OPI) No. 59943/76 and Japanese Patent Publication No. 39853/76, wherein the compound of the present invention is dissolved in an organic solvent which is miscible with water and then blended with a polymer latex which may be swollen with the organic solvent, and at least a part of the organic solvent is removed to obtain a stable dispersion. This can be used in the present invention. Alternatively, the compound of the present invention may be dispersed in water with a medium dispersing machine such as a ball mill or colloid mill, and the resulting aqueous dispersion may be blended with an aqueous gelatin solution. The thus prepared gelatin dispersion can also be used in the present invention. In this case, it is effective to use various surfactants which are known as dispersion promoters. Examples of such surfactants are described in Japanese Patent Publication No. 39853/76, etc.

The functional brightening agents of the present invention can be used in both black-and-white photographic materials and color photographic materials. The method of using these agents differs in accordance with their use, the constitution of photographic materials to which the agents are to be incorporated and the development process for the materials. In the case of black-and-white photographic materials, images are formed from the reduced silver formed by development of the silver halide grains themselves in the material. In this case, the compounds of the present invention are decomposed by the action of the residual reduction product of a developing agent itself, such as hydroquinone, "Metol" or pyrazolidone, by development, to thereby cleave the functional residue FWA and release the brightening agent. It is a matter of course, that the compounds of the present invention can also release the brightening agent by the action of the residual reduction product to be formed by cross-oxidation between the oxidation product of the developing agent formed by development and other reducing agents.

In the case of color photographic materials, on the other hand, the materials contain color image-forming agents and mostly comprise two or more light-sensitive layers which have different coloring agents with different spectral-sensitivity distributions. When paraphenylenediamine derivatives are used as a color developing agent for color photographic materials which contain the compound of the present invention, the compound can effectively release the brightening agent because of the action of the residual reduction product formed by cross-oxidation of the oxidation product of the color developing agent formed by development of light-sensitive silver halides and a coexisting reducing agent. Accordingly, in the case of color photographic materials, the co-existing reducing agent and the reaction conditions are especially important for color development of the materials.

The compounds of the present invention can release a photographically useful group or a precursor thereof, after having received an electron from a reducing substance. Accordingly, imagewise conversion of the reducing substance into the oxidation product leads to reverse-imagewise release of the photographically useful group or a precursor thereof from the compound of the present invention.

The reducing substance may be either an inorganic compound or an organic compound, but it is preferred that this has an oxidation potential which is lower than the standard redox potential of 0.80 V of silver ion/silver.

Examples of inorganic compounds as the reducing substance include, for example, metals having an oxidation potential of 0.8 V or lower, such as Mn, Ti, Si, Zn, Cr, Fe, Co, Mo, Sn, Pb, W, $H_2$, Sb, Cu, Hg, etc.; ions or complex compounds thereof, having an oxidation potential of 0.8 V or lower, such as $Cr^{2+}$, $V^{2+}$, $Cu^{+}$, $Fe^{2+}$, $MnO_4^{2-}$, $I^-$, $Co(CN)_6^{4-}$, $Fe(CN)_6^{4-}$, $(Fe\text{-}EDTA)^{2-}$, etc.; metal hydrides having an oxidation potential of 0.8 V or lower, such as NaH, LiH, KH, $NaBH_4$, $LiBH_4$, $LiAl(O\text{-}tC_4H_9)_3H$, $LiAl(OCH_3)_3H$, etc,; sulfur or phosphorus compounds having an oxidation potential of 0.8 V or lower, such as $Na_2SO_3$, NaHS, NaHS03, $H_3P$, $H_2S$, $Na_2S$, $Na_2S_2$, etc.

As examples of organic compounds which can be used as the reducing substance, there are organic nitrogen compounds such as alkylamines or arylamines, organic sulfur compounds such as alkyl mercaptans or aryl mercaptans, and organic phosphorus compounds such as alkylphosphines or arylphosphines. However, compounds having the following formula (C), which follow the Kendall-Pelz rule, are preferred.

$$Q_1-(\alpha=\beta)_n-Q_2 \qquad \text{(C)}$$

wherein $Q_1$ and $Q_2$ each represents —O—Sub,

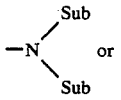

or

—S—Sub; n represents an integer of from 0 to 8, and when n=0, the formula (C) is $Q_1$—$Q_2$;
$\alpha$ and $\beta$ each represents

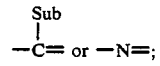

and when n is more than 2, $\alpha_1$, $\alpha_2$, $\beta_1$, $\beta_2$, . . . in —($\alpha_1$=$\beta_1$)—($\alpha_2$=$\beta_2$)—. . . may be same or different; Sub represents a hydrogen atom or has the same meaning as the substituent described for Sub in formula (A); and $Q_1$ and $Q_2$, $Q_1$ and $\alpha$ or $\beta$, and $Q_2$ and $\alpha$ or $\beta$ may form a hetero ring.

More preferred examples of the compounds of the formula (C) are set forth below, however, the present invention should not be construed as being limited thereto.

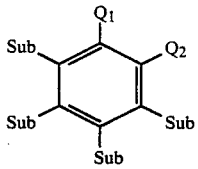

(C-1)

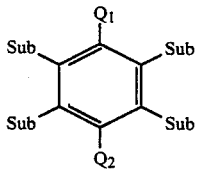

(C-2)

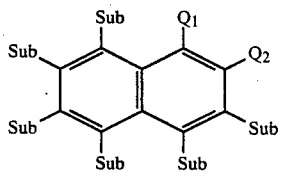

(C-3)

-continued (C-4)

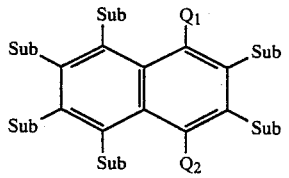

(C-5)

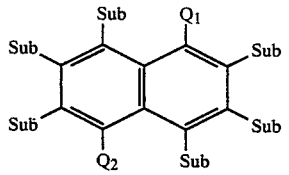

(C-6)

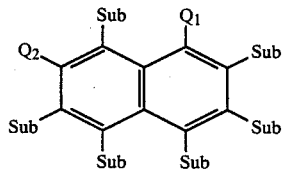

(C-7)

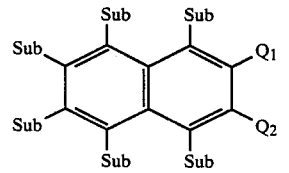

(C-8)

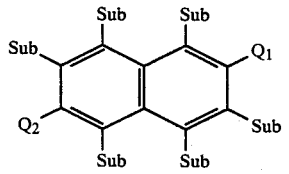

(C-9)

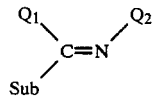

(C-10)

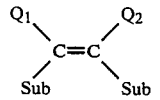

(C-11)

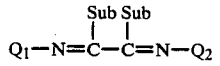

(C-12)

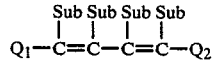

(C-13)

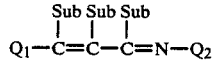

In formulae (C-1) to (C-13), Sub represents a hydrogen atom or has the same meaning as the substituent cribed for Sub in the formula (A).

Among the compounds of formulae (C-1) to (C-13), ormulae (C-1), (C-2), (C-3), (C-4), (C-7), (C-9), (C-10) and C-12), are especially preferred.

Preferred examples for $Q_1$ and $Q_2$ include:

—OH

-continued

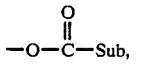

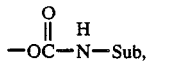

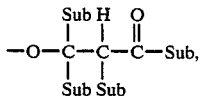

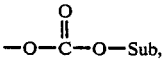

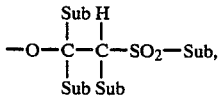

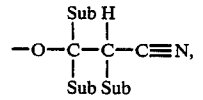

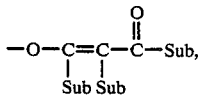

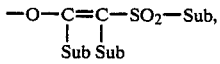

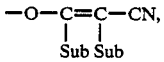

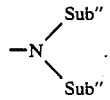

In these groups, Sub has the same meaning as set forth above; and Sub" has the same meaning as Sub but is preferably a hydrogen atom, an alkyl group, an aryl group, an acyl group or a sulfonyl group.

Examples of more preferred reducing agents are as follows: 3-pyrazolidones and precursors thereof, for example, 1-phenyl-3-pyrazolidone, 1-phenyl-4,4-dimethyl-3-pyrazolidone, 4-hydroxymethyl-4-methyl-1-phenyl-3 -pyrazolidone, 1-m-toyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl) 4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-pyrazolidone, 4,4-dimethyl-3-pyrazolidone, 5-methyl-3-pyrazolidone, 1,5-diphenyl-3-pyrazolidone, 1-phenyl 4-methyl-4-stearoyloxymethyl-3-pyrazolidone, 1-phenyl-4-methyl-4-lauroyloxymethyl-3-pyrazolidone, 1 phenyl-4,4-bis-(lauroyloxymethyl)-3-pyrazolidone, 1-phenyl-2-acetyl-3-pyrazolidone, 1-phenyl-3-acetoxypyrazolidone, etc.; and hydroquinones and precursors thereof, for example, hydroquinone, toluhydroquinone, 2,6-dimethylhydroquinone, t-butylhydroquinone, 2,5-di-t-butylhydroquinone, t-octylhydroquinone, 2,5-di-t-octylhydroquinone, pentadecylhydroquinone, sodium 5-pentadecylhydroquinone-2-sulfonate, p-benzoyloxyphenol, 2-me thy 1-4-benzoyloxyphenol, 2-t-butyl-4-(4-chlorobenzoyloxy)phenol, etc.

The combination of various kinds of reducing agents described in U.S. Pat. No. 3,039,869, can also be used in the present invention.

As the reducing substance for use in the present invention, color developing agents are also useful, and p-phenylene series color developing agents, such as N,N-diethyl-3-methyl-p-phenylenediamine, which are described in U.S. Pat. No. 3,531,286, may be used. Further useful reducing agents are the aminophenols described in U.S. Pat. No. 3,761,270. Among the aminophenol reducing agents especially preferred are 4-amino-2,6-dichlorophenol, 4-amino-2,6-dibromophenol, 4-amino-2-methylphenol sulfate, 4-amino-3-methylphenol sulfate, 4-amino-2,6-dichlorophenol hydrochloride, etc. Furthermore, the 2,6-dichloro-4substituted sulfonamidophenols and 2,6-dibromo-4substituted sulfonamidophenols described in *Research Disclosure,* Vol. 151, (RD No. 15108) and U.S. Pat. No. 4,021,240, and the p-(N,N-dialkylaminophenyl)sulfamines described in Japanese Patent Application (OPI) No. 116740/84, are also useful In addition to the above-mentioned phenol series reducing agents, naphthol series reducing agents, for example, 4-aminonaphthol derivatives as well as the 4-substituted sulfonamidonaphthol derivatives described in Japanese Patent Application (OPI) No. 259253/86 are especially useful. Further, as general color developing agents which can be used in the present invention, there are, for example, the aminohydroxypyrazole derivatives described in U.S. Pat. No. 2,895,825, the aminopyrazoline derivatives described in U.S. Pat. No. 2,892,714, and the hydrazone derivatives described in *Research Disclosure,* pages 227 to 230 and 236 to 240 (June, 1980, RD No. 19412 and RD No. 19415). These color developing agents can be used singly or in the form of a combination of two or more thereof.

The compounds of the present invention function in the silver halide photographic materials, as described below, in the actual practice of the present invention.

The compound of the present invention is incorporated into a silver halide photographic material, as described below, and thereby reduced through the electron transfer route as shown by the arrow in the following formula (1), to release the photographically useful group.

In formula (1), the reducing substance (RE) may be the above-noted inorganic or organic substance, which may be incorporated into a processing solution for the photographic material so that the substance may react on the material during processing. Alternatively this reducing substance may previously be incorporated into the material to directly react thereon; or this reducing substance may previously be incorporated into the photographic material, and may directly react thereon, while the same or different reducing substance (RE) may further be incorporated into the processing solution, so that this may react on the material together with the incorporated reducing substance.

When the reducing substance (RE) is used in conventional negative-working silver halide photographic materials, this is consumed for reduction of the silver halide in accordance with the degree of the exposure of the material. Therefore, the reducing substance is used for the reaction with the compound of the present invention only in an amount which reversely corresponds to the degree of the exposure of the material, or that it, in an amount as remained without being used for the reduction of the silver halide among the total reducing substance (RE). Accordingly, the photographically useful group could be released more in the part in which was exposed less. In contrast to the case of negative-working emulsions, when an auto-positive emulsion is used, the reduction of the silver halide is effected in the side of the non-exposed part, and therefore, the reducing substance is consumed in the non-exposed part. Accordingly, the reaction between the compound of the present invention and the reducing substance is greater in the more exposed part, so that the photographically useful group may be released to a greater extent in the more exposed part.

As mentioned above, the compound of the present invention can release a small amount of the photographically useful group in the developed area (that is, the part where the silver halide has reacted with the reducing substance), but a large amount of the photographically useful group in the non-developed part. For the purpose of adjusting the ratio of the amount of the photographically useful groups released in the developed part to that in the non-developed part (generally, for the purpose of elevating the said ratio), a reducing substance which is called an electron transport agent (ETA), and which satisfies the following formula (2), can be used together with the compound of the present invention.

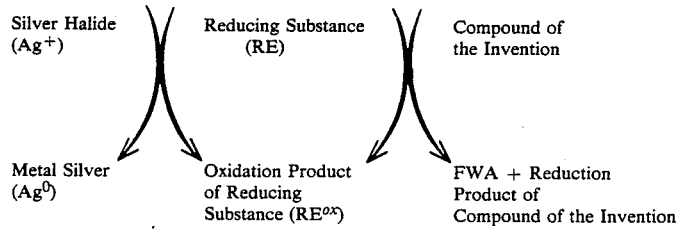

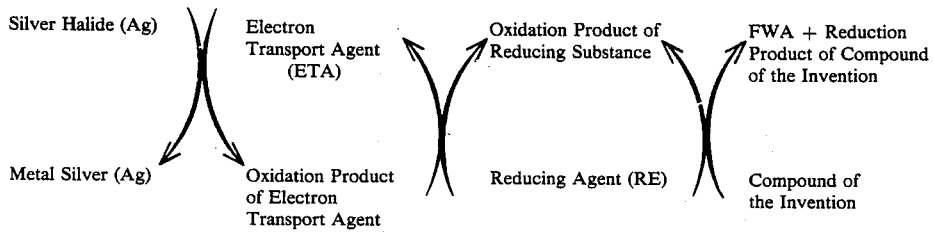

In formula (2) the electron transport agent (ETA) can be selected from the above-mentioned reducing agents, and is preferably selected from the organic reducing agents of formulae C-1), (C-2), (C-3), (C-4), (C-7), (C-9), (C-10), and C-12). In order that the electron transport agent (ETA) may act more effectively, it is desired that its redox potential is in the middle between the reducing substance (RE) and the silver halide.

The method of reacting the electron transport agent (ETA) and the reducing agent (RE) is the same as the method of reacting the reducing substance (RE) in formula (1).

The process of formula (2) is the same as that of formula (1) except that the transfer of the electron from the reducing substance to the silver halide, is mediated by the electron transport agent in the former for release of the photographically useful group. In the process of formula (2), when the reducing substance is in the form of an immobile state, the electron transport from the reducing substance to the silver halide is often delayed. If the electron transport from the reducing substance to the silver halide is delayed, the reaction of the reducing substance with the compound of the present invention will predominantly be effected, as understood from the process of formula (1). Therefore, the difference in the amount of the photographically useful group released between the developed part and the non-developed part will be small. The electron transport agent can be used for the purpose of attaining a smooth electron transport from the immobile reducing substance to the silver halide so that the difference in the amount of the photographically useful group released between the developed part and the non-developed part may be large. For this purpose, therefore, when the electron transport agent is used together with an immobile reducing agent (RE), the electron transport agent is required to be more mobile than the reducing agent (RE). As shown in formula (2), an immobile reducing substance can effectively be used, through the employment of an electron transport agent.

The reducing agent which can be used in combination with ETA may be any one of the above-mentioned reducing agents which are substantially immobile, but hydroquinones, aminophenols, aminonaphthols, 3-pyrazolidinones, saccharin and precursors thereof, picoliniums and the electron-donating compounds described in Japanese Patent Application (OPI) No. 110827/78, are especially preferred.

Examples of preferred reducing agents are described below, however, the present invention should not be construed as being limited thereto.

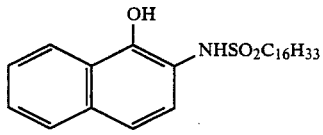

S-1

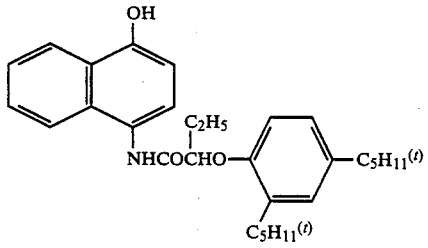

S-2

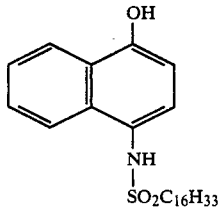

S-3

-continued
S-4
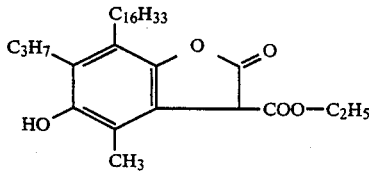
S-5
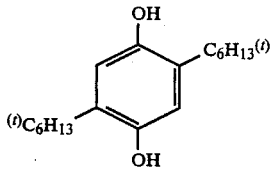
S-6
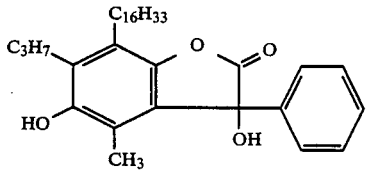
S-7
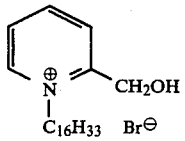
S-8
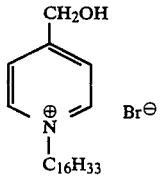
S-9
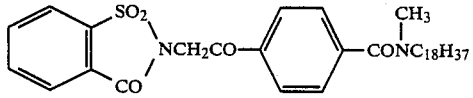
S-10
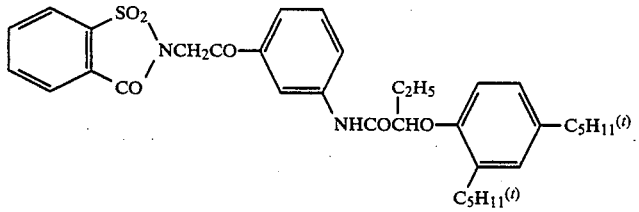
S-11
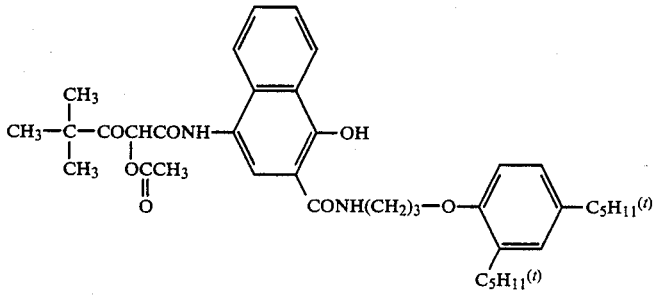

-continued
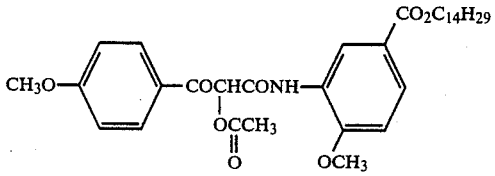
S-12
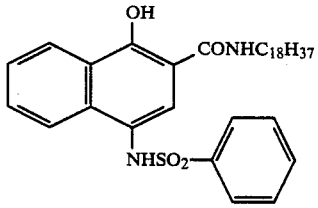
S-13
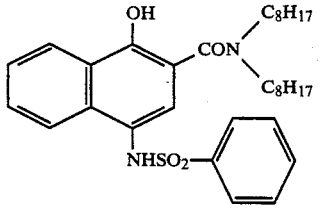
S-14
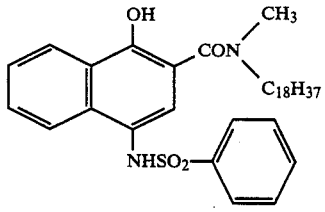
S-15
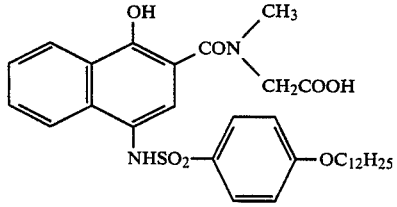
S-16
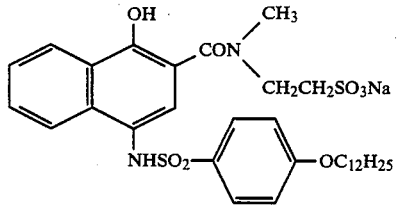
S-17
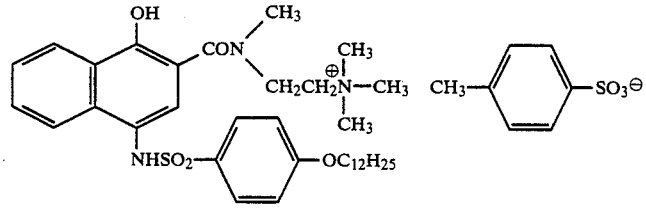
S-18

-continued
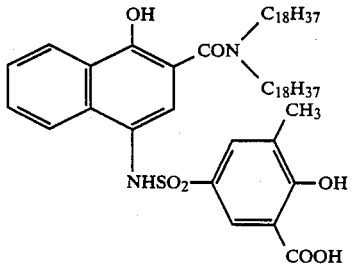
S-19
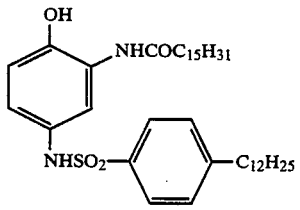
S-20
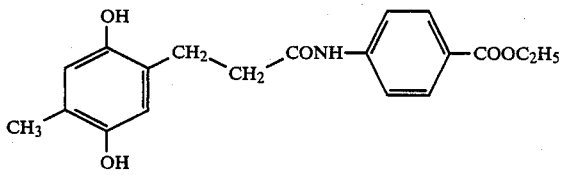
S-21
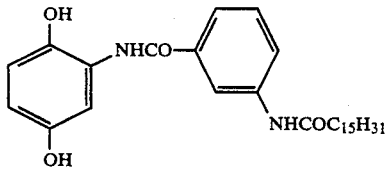
S-22
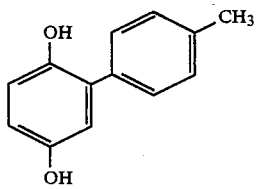
S-23
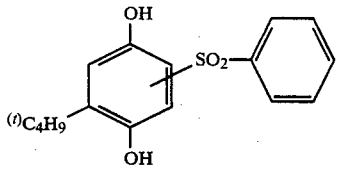
S-24
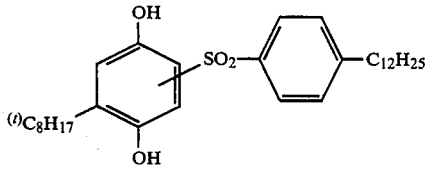
S-25
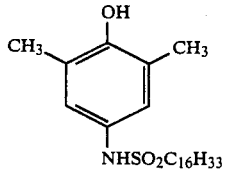
S-26

-continued
S-27
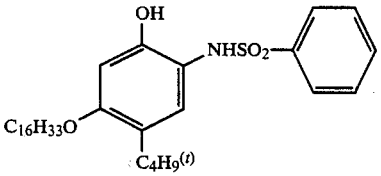
S-28
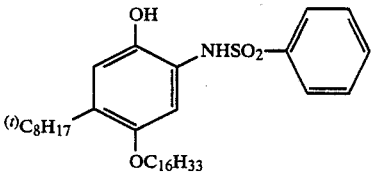
S-29
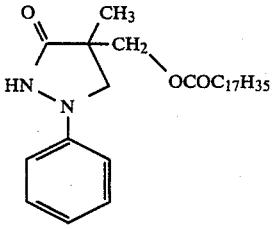
S-30
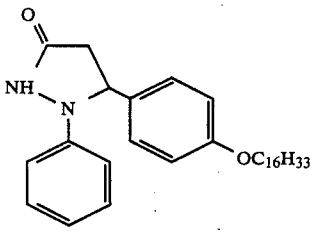
S-31
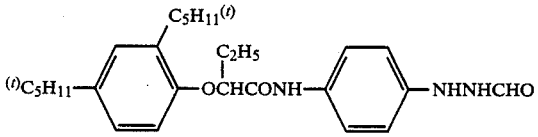
S-32
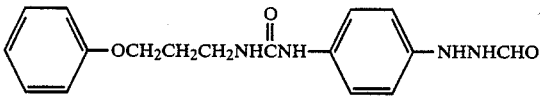
S-33
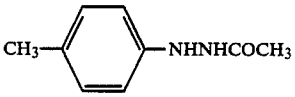
S-34
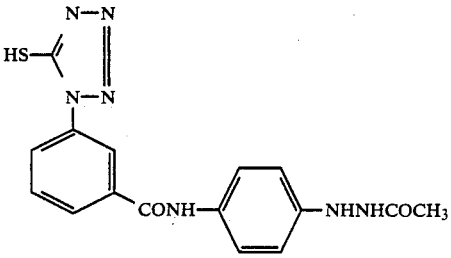

-continued
S-35
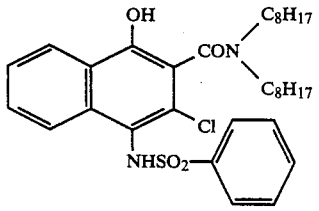
S-36
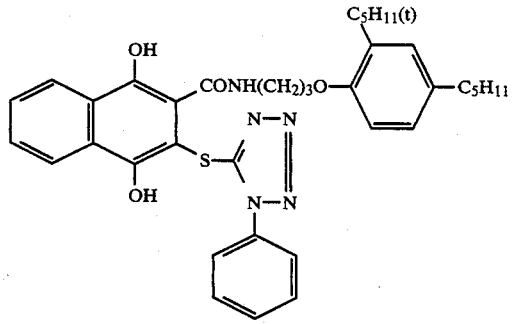
S-37
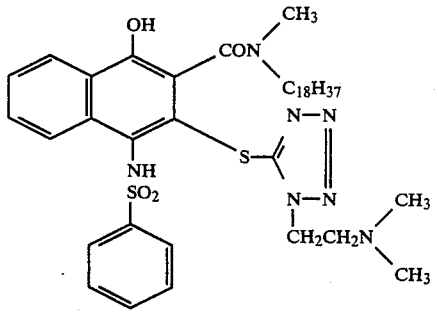
S-38
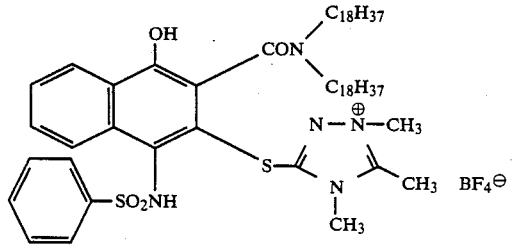
S-39
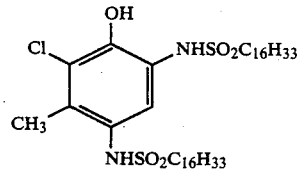
S-40
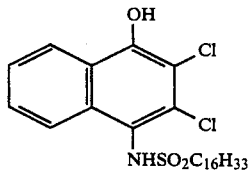
S-41
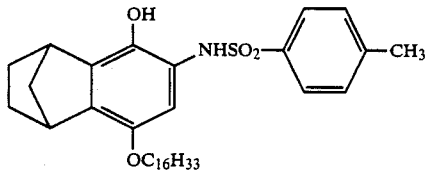

-continued
S-42
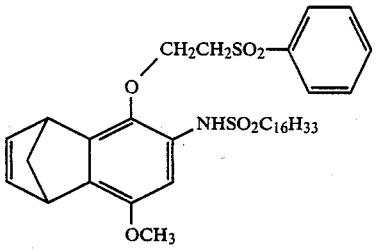
S-43
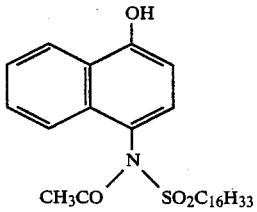
S-44
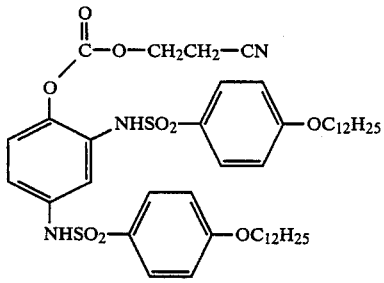
S-45
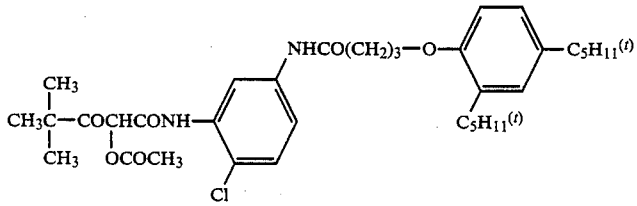
S-46
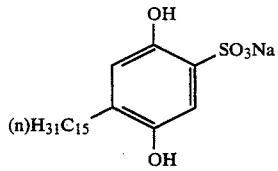
S-47
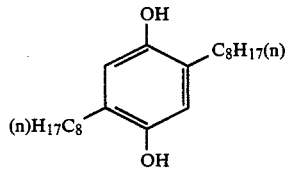
S-48
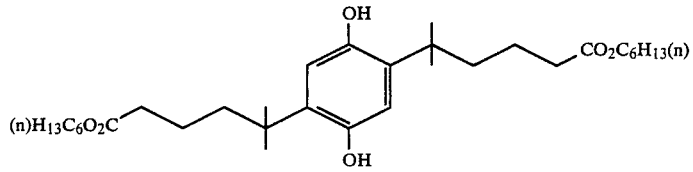

-continued

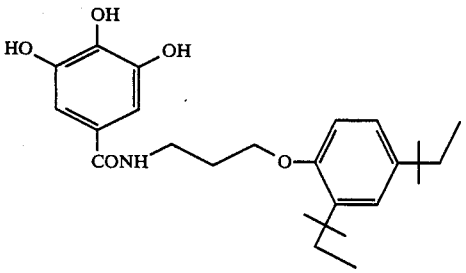

S-49

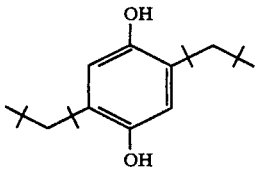

S-50

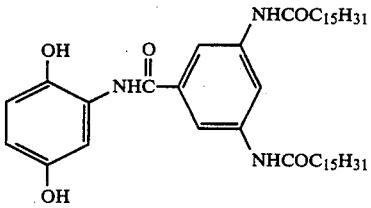

S-51

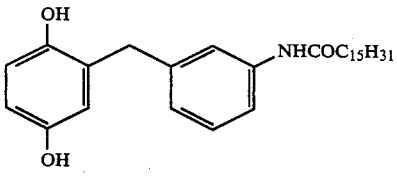

S-52

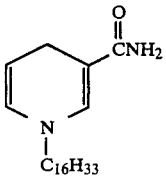

S-53

As the electron transport agent [ETA] to be used in combination with the reducing substance, anyone can be employed which may react with the reducing agent for cross-oxidation, but diffusible 3-pyrazolidinones, aminophenols, phenylenediamines and reductones are preferred.

Specific examples include the following compounds: 3-pyrazolidinones (for example, 1-phenyl-3-pyrazolidinone, 4,4-dimethyl-1-phenyl-3-pyrazolidinone, 4-hydroxymethyl-4-methyl-1-phenyl-3-pyrazolidinone, 4-hydroxymethyl-4-methyl-1-tolyl-3-pyrazolidinone, 4-hydroxymethyl-4-methyl-1-(4'-methoxy)-3-pyrazolidinone, 4,4-bis(hydroxymethyl)-1-phenyl-3-pyrazolidinone, 4,4-bis(hydroxymethyl)-1-tolyl-3-pyrazolidinone, 4,4-bis(hydroxymethyl)-1-(4'-methoxy)-3-pyrazolidione, 4,4-dimethyl-1-tolyl-3-pyrazolidinone, 1,5-diphenyl-3-pyrazolidinone, etc.); aminophenols (for example, p-aminophenol, p-methylaminophenol, p-dimethylaminophenol, p-diethylaminophenol, p-dibutylaminophenol, p-piperidinoaminophenol, 4-dimethylamino-2,6-dimethoxyphenol, etc.); phenylenediamines (for example, N-methyl-p-phenylenediamine, N,N-dimethyl-p-phenylenediamine, N,N-diethyl-p-phenylenediamine, N,N,N',N'-tetramethyl-p-phenylenediamine, 4-diethylamino-2,6-dimethoxyaniline, etc.); reductones (for example, piperidinohexosereductone, pyrrolidinohexose-reductone, etc.).

Furthermore, precursors which may be hydrolyzed under alkaline conditions to form the above-described compounds may also be used.

For example, the precursors described in Japanese Patent Application (OPI) No. 52055/80, Japanese Patent Publication No. 39727/78, Japanese Patent Application (OPI) No. 135949/82, etc., may be used.

For use of the above-described reducing substance or the combination of the reducing substance and ETA in conventional silver halide photographic materials, there are preferably two systems. In the first system, the reducing substance and ETA are incorporated into a developing solution and applied to the photographic material during development. In the second system, the reducing substance is incorporated into the photographic material and ETA is added to a developing solution. In the former case, the amount of the agents to be incorporated into the developing solution is preferably from 0.001 mol/liter to 1 mol/liter as the total concentration in the developing solution; and in the latter case, the reducing substance is incorporated into the photographic material in an amount of form 0.5 to 5 mols per mol of the compound of the present invention in the material, and the concentration of ETA in the developing solution is preferably from 0.01 mol/liter to 1 mol/liter.

On the other hand, when the reducing substance or the combination of the reducing substance and ETA is applied to heat developable photographic materials, these compounds are preferably incorporated into the heat developable photographic materials. In this case, the amount of the reducing substance and that of ETA to be incorporated into the photographic material are from 0.5 to 5 mols and from 0.1 to 10 mols, respectively, per mol of the compound of the present invention in the material.

These reducing agents can act also as a color mixing preventing agent, color image stabilizer, color clouding preventing agent or the like in photographic materials.

The compounds of the present invention can directly release the residue (FWA) having a function as a brightening agent, by the action of the above-mentioned reducing agent in an aqueous solution or through the variation of the pH value in the solution, during or after the image formation step. However, the residue is preferably imagewise released. In the latter preferred case, the compound to release the FWA residue is required to be substantially in contact with the silver halide grains and therefore, it is preferred that the compound of the present invention is incorporated into the light-sensitive layer of the photographic material.

The silver halide emulsion for use in the present invention may be any of silver chloride, silver bromide, silver chlorobromide, silver iodobromide and silver iodochlorobromide.

The silver halide grains in the photographic emulsions for use in the present invention may have a regular crystal form such as cubic, octahedral, tetradecahedral, rhombic dodecahedral, etc., or an irregular crystal form such as spherical, tabular, etc., or further a composite form thereof. Also, the emulsions may comprise a mixture of grains with various crystal forms. Further, epitaxial structural grains can also be used.

The silver halide grains may have different phases in the inside and the surface layer thereof, or they may have the same and uniform phase in the both parts thereof. The grains may be those in which latent images are mainly formed in the surface thereof (for example, negative type emulsions) or those in which latent images are mainly formed in the inside thereof (for example, internal latent image type emulsions, pre-fogged direct reversal type emulsions, etc.).

The silver halide grain size is generally preferably from 0.01 $\mu$ to 4.0 $\mu$. In particular, for graphic art photographic materials, the size is preferably from 0.02 to 0.4 $\mu$; and for general picture-taking photographic materials, the size is preferably from 0.2 to 3.0 $\mu$.

The photographic emulsions for use in the present invention can be prepared by the methods described in P. Glafkindes, *Chimie et Physique Photographique* (published by Paul Montel, 1967), G. F. Duffin, *Photographic Emulsion Chemistry* (published by Focal Press, 1966), V. L. Zelikman, *Making and Coating Photographic Emulsion* (published by Focal Press, 1864), etc.

The silver halide grains may also be formed or physically ripened in the presence of a cadmium salt, a zinc salt, a thallium salt, an iridium salt or a complex salt thereof, a rhodium salt or a complex salt thereof, an iron salt or a complex salt thereof, etc.

The silver halide emulsions may or may not be chemically ripened. For chemical ripening, for example, the method described in H. Frieser, *Die Grundlagen der Photographischen Prozesse mit Silberhalogeniden* (published by Akademische Ferlagsgesellshaft, 1968), pages 675 to 734, can be used.

Specifically, a sulfur sensitization method using a sulfur-containing compound capable of reacting with active gelatin or silver (e.g., thiosulfates, thioureas, mercapto compounds, rhodanines, etc.), a reduction sensitization method using a reducing material (e.g., stannous salts, amines, hydrazine derivatives, derivatives, formamidinesulfinic acid, silane compounds, etc.), a noble metal sensitization method using a noble metal compound (e.g., gold complex salts and complex salts of metals belonging to group VIII of the Periodic Table, such as platinum, iridium, palladium, etc.) can be used individually or as a combination thereof.

In the case of direct positive photographic materials, non-prefogged internal latent image type silver halide emulsions are preferably used.

The non-prefogged internal latent image type silver halide emulsions for use in the present invention are emulsions containing silver halide grains which are not prefogged on the surface thereof but which may form latent images mainly in the inside thereof. More specifically, the emulsions are defined as follows: when the emulsion is coated on a transparent support in an amount of from 0.5 to 3 g/m$^2$ as silver and exposed to light for a fixed period of time of from 0.01 to 10 seconds and then developed with the following Developer (A) (internal type developer) for 5 minutes at 18° C., the maximum density to be obtained by conventional photographic density measuring method is preferably at least 5 times larger than the maximum density to be obtained in the same photographic material formed by coating the same emulsion on the same support in the same amount, the latter material being exposed in the same manner but developed with the following Developer (B) (surface type developer) at 20° C. for 6 minutes. More preferably, the maximum density of the former is at least 10 times larger than that of the latter.

Internal Type Developer (A):

"Metol" 2 g
Sodium Sulfite (Anhydride) 90 g
Hydroquinone 8 g
Sodium Carbonate (Monohydrate) 52.5 g
KBr 5 g
KI 0.5 g
Water to make 1 liter Surface TYpe Developer (B):

"Metol" 2.5 g
L-Ascorbic Acid 10 g
$NaBO_2 \cdot 4H_2O$ 35 g
KBr 1 g
Water to make 1 liter Examples of internal latent image type emulsions include the conversion type silver halide emulsions and the shell-added emulsions thereof described in U.S. Pat. No. 2,592,250, Japanese Patent Publication Nos. 54379/83, 3536/83, and 5582/85, Japanese Patent Application (OPI) Nos. 156614/77, 79940/82, 70221/83; and the core/shell type silver halide emulsions in which the inside is doped with a metal, described in U.S. Pat. Nos. 3,761,276, 3,850,637, 3,923,513, 4,035,185, 4,395,478, and, 4,504,570, Japanese Patent Application (OPI) Nos. 60222/78, 22681/81, 208540/84, 107641/85, and 3137/86, as well as patent publications mentioned in *Research Disclosure* (RD No. 23510), (November, 1983), page 236, *Research Disclosure* (RD No. 18155) (May, 1979), pages 265 to 268.

Various compounds can be incorporated into the photographic emulsions for use in the present invention, for the purpose of preventing fog during manufacture, preservation and photographic processing of the photographic materials or for the purpose of stabilizing the photographic characteristics of the materials. For example, various compounds which are known as an anti-foggants or stabilizers can be used for these purposes, including azoles (such as benzothiazolium salts, nitroindazoles, triazoles, benzotriazoles, and benzimidazoles (especially nitro- or halogen-substitutes)); heterocyclic mercapto compounds (such as mercaptothiazoles, mercaptobenzothiazoles, mercaptobenzimidazoles, mercaptothiadiazoles, mercaptotetrazoles (especially 1-phenyl-5-mercaptotetrazole), and mercaptopyrimidines); heterocyclic mercapto compounds having a water-soluble group (such as carboxyl group or sulfone group); thioketo compounds (such as oxazolinethione); azaindenes (such as tetrazaindenes (especially 4-hydroxy-substituted (1,3,3a,7)tetrazaindenes)); benzenethiosulfonic acids; benzenesulfinic acids; etc.

In the case of color photographic materials, the silver halide photographic emulsions contain color couplers such as cyan couplers, magenta couplers and yellow couplers as well as compounds for dispersing the couplers.

For example, the following couplers can be used in the present invention: Image-forming couplers, DIR couplers (for example, the couplers described in U.S. Pat. Nos. 3,227,554, 4,146,396, 4,248,962, 4,409,323, 4,421,845, 4,477,563, and 3,148,062, etc.), weakly diffusible dye-forming couplers (for example, the couplers described in U.S. Pat. Nos. 4,522,915 and 4,420,556, etc.), development accelerator- or fogging agent-releasing couplers (for example, the couplers described in U.S. Pat. No. 4,390,618, etc.), colored couplers (for example, the couplers described in U.S. Pat. Nos. 4,004,929, 4,138,258, and 4,070,191, etc.), competing couplers (for example, the couplers described in U.S. Pat. No. 4,130,427, etc.), poly-equivalent couplers (for example, the couplers described in U.S. Pat. Nos. 4,283,472, 4,338,393, and 4,310,618, etc.), DIR redox compound-releasing couplers (for example, the couplers described in Japanese Patent Application (OPI) No. 185950/85, etc.), couplers for releasing dyes which may recolor after being released (for example, the couplers described in European Patent No. 173302A, etc.), and other various kinds of polymer couplers (for example, the couplers described in U.S. Pat. Nos. 3,767,412, 3,623,871, 4,367,282, and 4,474,870, etc.).

The dyes to be formed from the couplers may be anyone of yellow, magenta and cyan dyes. For example, these may include acylacetamide type couplers or malondiamide type couplers as a yellow coupler; 5-pyrazolone type couplers, pyrazoloneimidazole type couplers or pyrazolotriazole type couplers as a magenta coupler; and phenol type couplers or naphthol type couplers as a cyan coupler. All of these may be either 4-equivalent couplers or 2-equivalent couplers. Further, couplers which form substantially no dye can also be used. As such a coupler there may be used, the couplers described in U.S. Pat. Nos. 3,958,993, 3,961,959, 4,315,070, 4,183,752, and 4,171,223, etc.

In the case of color photographic materials, hydroquinone derivatives, gallic acid derivatives, catechol derivatives, ascorbic acid derivatives, etc., which are generally used as a color mixing preventing agent or anti-fading agents, can also be used and these may function as a reducing agent for the compounds of the present invention.

In addition, as a color fogging preventing agent or a color mixing preventing agent the following may also be used: hindered phenols (such as aminophenol derivatives, amines, colorless couplers, sulfonamidophenol derivatives, p-alkoxyphenols, bisphenols, etc.), methylenedioxybenzenes, hindered amines and ether or ester derivatives thereof, in which the phenolic hydroxyl group has been silylated or alkylated, as well as 6-hydroxychromans, 5-hydroxycoumarans, spirochromans, etc., and metal complexes such as (bissalicylaldoximato)nickel complexes and (bis-N,N-dialkyldithiocarbamato)nickel complexes, etc.

Examples of organic anti-fading agents which can be used in the present invention are described in the following patent publications: hydroquinones are described in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, U.S. Pat. Nos. 2,710,801 and 2,816,028, etc,; 6-hydroxychromans, 5-hydroxycoumarans and spirochromans are described in U.S. Pat. Nos. 3,432,300, 3,573,050, 3,574,627, 3,698,909, and 3,764,337, Japanese Patent Application (OPI) No. 152225/77, etc.; spiroindanes are described in U.S. Pat. No. 4,360,589, etc.; p-alkoxyphenols are described in U.S. Pat. No. 2,735,765, British Patent No. 2,066,975, Japanese Patent Application (OPI) No. 10539/84, Japanese Patent Publication No. 19764/82, etc.; hindered phenols are described in U.S. Pat. No. 3,700,455, Japanese Patent Application (OPI) No. 72225/77, U.S. Pat. No. 4,228,235, Japanese Patent Publication No. 6623/77, etc.; gallic acid derivatives, methylenedioxybenzenes and aminophenols are described in U.S. Pat. Nos. 3,457,079 and 4,332,886, Japanese Patent Publication No. 21144/81, etc.; hindered amines are described in U.S. Pat. Nos. 3,336,135 and 4,268,593, British Patent Nos. 1,326,889, 1,354,313, and 1,410,846, Japanese Patent Publication No. 1420/76, Japanese Patent Application (OPI) Nos. 114036/83, 53846/84, and 78344/84, etc.; phenolic hydroxyletherified or esterified derivatives are described in U.S. Pat. Nos. 4,155,765, 4,174,220, 4,254,216, and 4,264,720, Japanese Patent Application (OPI) Nos. 145530/79, 6321/80, 105147/83, and 10539/84, Japanese Patent Publication No. 37856/82, U.S. Pat. No. 4,279,990, Japanese Patent Publication No. 3263/78, etc.; metal complexes are described in U.S. Pat. Nos. 4,050,938 and 4,241,155, British Patent No. 2,027,731(A), etc.

The compounds having both partial structures of hindered amine and hindered phenol in one molecule, described in U.S. Pat. No. 4,268,593, are effective for prevention of deterioration of yellow images by heat, moisture and light. In addition, the spiroindanes described in Japanese Patent Application (OPI) No. 159644/81 and the hydroquinone-diether- or -monoether-substituted chromans described in Japanese Patent Application (OPI) No. 89835/80, are effective for prevention of deterioration of magenta images, especially deterioration thereof by light. For attaining this object, these compounds may be added to the light-sensitive layer by emulsifying these compounds together with the corresponding color coupler, generally in an amount of from 5 to 100% by weight of the coupler. For the purpose of prevention of deterioration of cyan dyes by heat and especially by light, it is effective to incorporate an ultraviolet absorbent to the both layers adjacent to the cyan-coloring layer.

The functional brightening agents used in the present invention are not fluorescent by themselves or are only weakly fluorescent. Additionally, these agents have a high absorbance in the ultraviolet range, and therefore, can be used also as an ultraviolet absorbent. In particular, these agents can remain largely in the image-forming part of photographic materials, and can also be used as a light-fastness imparting agent.

The brightening agent to be released from the compound of the present invention is preferably fixed in the hydrophilic colloid layer of photographic materials. For this, the brightening agent itself is made to have a hydrophobic and hardly diffusible chemical structure or the agent is fixed to a hydrophilic colloid or a dispersion thereof by electric charged bonding. In the latter case, a so-called anion-exchange polymer which may give a cation site in the processing solution is used. For example, the cation polymers, or water-dispersed latices thereof, described in Japanese Patent Application (OPI) No. 65230/75, U.S. patent application Ser. No. 07/109,888, Japanese Patent Application (OPI) Nos. 30328/78, 92274/79, 155835/79, 126027/79, and 142339/80, U.S. Pat. No. 3,958,955, etc.; the polyvinylpyridinium salts described in U.S. Pat. Nos. 2,548,564, 3,148,061, and 3,756,814, etc.; and the quaternary ammonium salt polymers described in U.S. Pat. Nos. 3,209,690 and 3,898,088, etc.; can be incorporated into the hydrophilic layers of the photographic material, for example, by the method described in Japanese Patent Application (OPI) No. 65230/75 or U.S. patent application Ser. No. 07/109,888.

In such a case, gelatin having a relatively high isoelectric point, for example, acid-processed gelatin or gelatin derivatives, is preferably used as the hydrophilic colloid.

The photographic emulsions of the present invention can contain, for the purpose of elevation of sensitivity or enhancement of contrast or as a development accelerator, for example, polyoxyalkylene oxides or ether, ester amine derivatives thereof thioether compounds, thiomorpholines, quaternary ammonium salt compounds, urethane derivatives, urea derivatives, imidazole derivatives, 3-pyrazolidones, etc. For hard contrast reflective photographic materials to be used in the graphic arts or office copy field, it is preferred to use the hydrazine derivatives described, for example, in U.S. Pat. Nos. 4,224,401, 4,168,977, 4,166,742, 4,311,781, 4,272,606, 4,211,857, and 4,243,739, Japanese Patent Application (OPI) No. 37556/85, U.S. patent application Ser. Nos. 07/137,891 and 07/138,405, etc. For direct positive emulsions, it is preferred to use the nucleating agents, and accelerators therefor, such as hydrazine derivatives, etc. In the case of such photographic materials containing the noted hydrazine derivative, it is also preferred to use, together with the hydrazine derivative, the compounds described in Japanese Patent Application (OPI) Nos. 77616/78, 37732/79, 137133/78, 140340/85, and 14959/85, etc., as a development accelerator.

The silver halide photographic emulsions of the present invention can contain, together with the dyes of the present invention, any known water-soluble dyes other than the dyes of the present invention (for example, oxonole dyes, hemioxonole dyes, merocyanine dyes and benzylidene dyes), as a filter dye or for the purpose of anti-irradiation or for other various purposes. In addition, any known cyanine dyes, merocyanine dyes or hemicyanine dyes other than the dyes of the present invention can also be used together with the dyes of the present invention, as a spectral sensitizer.

Preferably used in the photographic materials of the present invention are the nitron compounds and derivatives thereof described in Japanese Patent Application (OPI) Nos. 76743/85 and 87322/85; the mercapto compounds described in Japanese Patent Application (OPI) No. 80839/85; the heterocyclic compounds and heterocyclic compound/silver complex salts (for example, 1-phenyl-5-mercaptotetrazole/silver complex) described in Japanese Patent Application (OPI) No. 164735/82, etc.

The photographic materials of the present invention can further contain, in the photographic emulsion layers or in any other hydrophilic colloid layers, various kinds of surfactants for various purposes. For example, various types of surfactants may be used for coating assistance, static charge prevention, slide property improvement, emulsification and dispersion, prevention of blocking and improvement of photographic characteristics (such as acceleration of developability, elevation of hard contrast, sensitization), etc.

For example, nonionic surfactants such as saponin (steroid type); alkylene oxide derivatives (e.g., polyethylene glycol, polyethylene glycol/polypropylene glycol condensation product, polyethylene glycol alkyl ethers, polyethylene glycol alkylaryl ethers, silicon-polyethylene oxide adducts, etc.); alkyl esters of saccharide, etc.; anionic surfactants such as alkylsulfonic acid salts, alkylbenzenesulfonic acid salts, alkylnaphthalenesulfonic acid salts, alkylsulfuric acid esters, N-acyl-N-alkyltauric acids, sulfosuccinic acid esters, sulfoalkylpolyoxyethylene alkylphenyl ethers, etc.; ampholytic surfactants such as alkylbetaines, alkylsulfobetaines, etc.; and cationic surfactants such as aliphatic or aromatic quaternary ammonium salts, pyridinium salts, imidazolium salts, etc., can be used for the noted purposes.

Among them, anionic surfactants such as sodium dodecylbenzenesulfonate, sodium di-2-ethylhexyl-α-sulfosuccinate, sodium p-octylphenoxyethoxyethoxyethanesulfonate, sodium dodecylsulfate, sodium triisopropylnaphthalenesulfonate, N-methyloleoyltaurine sodium salt, etc.; cations such as dodecyltrimethylammonium chloride, N-oleoyl-N',N',N'-trimethylammoniodiaminopropane bromide, dodecylpyridinium chloride, etc.; betaines such as N-dodecyl-N,N-dimethylcarboxybetaine, N-oleoyl-N,N-dimethylsulfobutylbetaine, etc.; and nonions such as saponin, polyoxyethylene (mean polymerization degree n=10) cetyl ether, polyoxyethylene (n=25) p-nonylphenyl ether, bis(1-polyoxyethylene(n=15)-oxy- 2,4-di-t-pentylphenyl)ethane, etc., are preferably used.

Preferably used antistatic agents are, for example, fluorine-containing surfactants, such as potassium perfluorooctanesulfonate, N-propyl-N-perfluorooctanesulfonylglycine sodium salt, sodium N-propyl-N-perfluorooctanesulfonylaminoethyloxypolyoxyethylene(n=3)-butanesulfonate, N-perfluorooctanesulfonyl-N',N',N'-trimethylammoniodiaminopropane chloride, N-perfluorodecanoylaminopropyl-N,N'-dimethyl-N'-carboxybetaine, etc.; the nonionic surfactants described in Japanese Patent Application (OPI)

Nos. 80848/85, 112144/86, 172343/87, and 173459/87, etc.; alkali metal nitrates; electro-conductive tin oxide; zinc oxide; vanadium pentaoxide, and complex oxides thereof formed by doping antimony, etc.

The surface layer of the photographic materials of the present invention may have applied thereon, as a slide property-imparting agent, the silicone compounds described in U.S. Pat. Nos. 3,489,576 and 4,047,958, etc.; the colloidal silica described in Japanese Patent Publication No. 23139/81; as well as paraffin wax, higher fatty acid esters, starch derivatives, etc.

The hydrophilic colloid layers of the photographic materials of the present invention can contain, as a plasticizer, polyols such as trimethylolpropane, pentanediol, butanediol, ethylene glycol, glycerin, etc. Further, it is preferred to incorporate a polymer latex into the hydrophilic colloid layers of the photographic material of the present invention for the purpose of improving pressure-resistance. As the polymers are preferred homopolymers of alkyl acrylates or copolymers thereof with acrylic acid, styrene-butadiene copolymers and polymers or copolymers of active methylene-containing monomers.

The photographic emulsions and non-light-sensitive hydrophilic colloid layers in the photographic material of the present invention can contain inorganic or organic hydrophilic colloids. For example, active vinyl compounds (e.g., 1,3,5-triacryloylhexahydro-s-triazine, bis(vinylsulfonyl)methyl ether, N,N'-methylenebis[β-(vinylsulfonyl)propionamide], etc.), active halogen compounds (e.g., 2,4-dichloro-6-hydroxy-s-triazine, etc.), mucohalogenic acids (e.g., mucochloric acid, etc.), N-carbamoylpyridinium salts (e.g., (1-morpholinocarbonyl-3-pyridinio)methanesulfonate, etc.), haloamidinium salts (e.g., 1-(1-chloro-1-pyridinomethylene)pyrrolidinium, 2-naphthalensulfonate, etc.), etc. can be used singly or in combination thereof. Above all, the active vinyl compounds described in Japanese Patent Application (OPI) Nos. 41220/78, 57257/78, 162546/84, and 80846/85, etc. and the active halogen compounds described in U.S. Pat. No. 3,325,287, etc. are especially preferred.

The finished emulsions are coated on an appropriate reflective support, for example. a baryta paper, a resin-coated paper, a synthetic paper, a white pigment-containing triacetate film, polyethylene terephthalate film (or the like plastic base), or a glass plate. In addition, the finished emulsions can be applied to photographic materials having the support or reflective support described in Japanese Patent Application (OPI) No. 210346/86, etc.

Other additives for use in the photographic materials of the present invention can be selected from those described in *Research Disclosure,* (RD) Nos. 17643 and 18716, as set forth below.

| No. | Kind of Additives | RD 17643 | RE 18716 |
|---|---|---|---|
| 1 | Chemical Sensitizer | p. 23 | p. 648, right column |
| 2 | Sensitivity Elevating Agent | | p. 648, right column |
| 3 | Spectral Sensitizer, Supersensitizer | pp. 23–24 | from p. 648, right column to p. 649, right column |
| 4 | Brightening Agent | p. 24 | |
| 5 | Anti-foggant, Stabilizer | pp. 24–25 | p. 649, right column |
| 6 | Light Absorbent, Filter Dye, UV Absorbent | pp. 25–26 | from p. 649, right column to p. 650, left column |
| 7 | Stain Preventing Agent | p. 25 right column | p. 650, from left to right column |
| 8 | Color Image Stabilizer | p. 25 | |
| 9 | Hardening Agent | p. 26 | p. 651, left column |
| 10 | Binder | p. 26 | p. 651, left column |
| 11 | Plasticizer, Lubricant | p. 27 | p. 650, right column |
| 12 | Coating Aid, Surfactant | pp. 26–27 | p. 650, right column |
| 13 | Antistatic Agent | p. 27 | p. 650, right column |

The silver halide photographic materials to which the present invention can be applied are those having a reflective support, especially those with a white background. For example, the applicable photographic materials include black-and-white or color photographic papers, reversal photographic papers, direct positive color photographic papers, photocomposing papers, photographic materials for black-and-white or color copy, photographic materials for black-and-white or color display, silver halide diffusion transfer or color diffusion transfer reflective photographic materials, color photographic materials for a silver dye bleaching method, as well as the heat-developing type photographic materials described in U.S. Pat. No. 4,500,626, Japanese Patent Application (OPI) Nos. 133449/85, 218443/84, and 238056/86, etc.

The exposure of the photographic materials of the present invention for forming photographic images thereon can be effected in a conventional manner. For example, natural light (i.e., sunlight), a halogen lamp, a tungsten lamp, a fluorescent lamp, a mercury lamp, a xenon arc lamp, a carbon arc lamp, a xenon flash lamp, as well as a cathode ray flying spot method or a scanning exposure method with LED-emitted light or laser light, etc., can be employed. If desired, the spectral composition of the light to be imparted to the materials for exposure thereof can be varied by the use of color filters. Further, the materials can also be exposed with a light as emitted from a fluorescent body excited with electron beams, X rays, γ rays, α rays, etc.

For the photographic processing of the photographic materials of the present invention, any known method can be applied. Any known processing solution may be used, for example, as described in *Research Disclosure,* (RD No. 176), pages 28 to 30 (December, 1978). The photographic processing may be either processing for formation of silver images (black-and-white development) or processing for formation of color images (color development), in accordance with the type of materials to be processed. Although the pH value of the developing solution can not be generically defined, since it depends upon the type of black-and-white developing solution and color developing solution used, the kind of the developing agents employed, and the kind of the photographic materials to be processed, etc., it is generally from 9 to 12.5 in most cases. In particular, the preferred pH value is within the range of from 10 to 12.5. The processing temperature is from 18° to 50° C. However, the processing temperature may be lower than 18° C. or higher than 50° C. In the case of heat development processing, the temperature is generally from 50° C. to 90° C.

The color developing solution to be used for color development of the photographic materials of the present invention is an aqueous alkaline solution consisting mainly of an aromatic primary amine series developing agent. As the color developing agent, p-phenylenediamine series compounds are preferably used, although aminophenol series compounds are also useful. Specific examples of the p-phenylenediamine series compounds include 3-methyl-hydroxyethylaniline, 3-methyl-4-amino-N-ethyl-N-β-methanesulfonamidoethylaniline, 3-methyl-4-amino-N-ethyl-N-β-methoxyethylaniline and sulfates, hydrochlorides and phosphates thereof as well as p-toluenesulfonic acid salts, tetraphenylboric acid salts, p-(t-octyl)benzenesulfonic acid salts, etc. These diamines are more stable in the form of a salt thereof, than in a free state. Therefore, salts of such diamines are preferably used.

Aminophenol series derivatives include, for example, o-aminophenol, p-aminophenol, 4-amino-2-methylphenol, 2-amino-3-methylphenol, 2-hydroxy-3-amino-1,4-dimethylbenzene, etc.

Further, the compounds described in L. F. A. Mason, *Photographic Processing Chemistry* (published by Focal Press), pages 226 to 229, U.S. Pat. Nos. 2,193,015 and 2,592,364, Japanese Patent Application (OPI) No. 64933/73, etc., can also be used. If desired, two or more kinds of color developing agents can be used in combination.

The color developing solutions for processing the photographic material of the present invention can further contain a pH buffer such as alkali metal carbonates, borates or phosphates; a development inhibitor or antifoggant such as bromides, iodides, benzimidazoles, benzothiazoles, mercapto compounds, etc.; a perservative such as hydroxylamine, triethanolamine, the compounds described in West German Patent Application (OLS) No. 2,622,950, sulfites, bisulfites, etc.; an organic solvent such as diethylene glycol, etc.; a development accelerator such as benzyl alcohol, polyethylene glycol, quaternary ammonium salts, amines, thiocyanates, 3,6-thiaoctane-1,8-diol, etc.; a color-forming coupler; a competing coupler; a nucleating agent such as sodium borohydride, etc.; an auxiliary developing agent such as 1-phenyl-3-pyrazolidone, etc.; a tackifier; a chelating agent such as aminopolycarboxylic acids, for example, ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid and the compounds described in Japanese Patent Application (OPI) No. 195845/83, etc., 1-hydroxyethylidene-1,1'-diphosphonic acid, the organic phosphonic acids described in *Research Disclosure* (RD No. 18170) (May, 1979), aminophosphonic acids, for example, aminotris(methylenephosphonic acid), ethylenediamine-N,N,N',N'-tetramethylenephosphonic acid, etc., the phosphonocarboxylic acids described in Japanese Patent Application (OPI) Nos. 102726/77, 42730/78, 121127/79, 4024/80, 4025/80, 126241/80, 65955/80, and 65956/80, *Research Disclosure* (RD No. 18170) (May, 1979), etc.

The concentration of the color developing agent in a color developing solution is generally from about 0.1 g to about 30 g, more preferably from about 1 g to about 15 g, per liter of the developer. The pH value of the color developing solution is usually 7 or more, and generally from about 9 to about 13. For the color developing solution, a replenisher containing halides and color developing agent each in a controlled concentration is preferably used, so as to reduce the amount of the replenisher added for the purpose of prevention of environmental pollution and reduction of manufacture cost.

In general, reversal color photographic materials are first subjected to black-and-white development and then to color development. The black-and-white developing solution for use in the development may contain any known black-and-white developing agents, for example, a dihydroxybenzene compound such as hydroquinone, hydroquinone monosulfonate, etc., a 3-pyrazolidone compound such as 1-phenyl-3-pyrazolidone, etc., or an aminophenol compound such as N-methyl-p-aminophenol, etc., singly or in combination thereof.

After color development, the photographic emulsion layers are generally bleached. The bleaching step can be carried out simultaneously with fixation in a combined carried out simultaneously with fixation in a combined blix bath, or can be carried out separately. In order to accelerate the processing operation, bleach-fixation may follow bleaching. As bleaching agents to be used for compounds of polyvalent metals such as iron(III), cobalt(III), chromium(VI), copper(II), etc. (e.g., ferricyanides), peracids; quinones; nitroso compounds; organic complexes of iron(III) or cobalt(III) (e.g., complexes with aminopolycarboxylic acids such as ethylenediaminetetraacetic acid, diethylenetriaminepentaacetic acid, etc., or aminopolyphosphonic acids, phosphonocarboxylic acids and organic phosphonic acids, etc.); or organic acids such as citric acid, tartaric acid, malic acid, etc.; persulfates; hydrogen peroxide; permanganates; etc. Among these compounds, organic complexes of iron(III) and persulfates are especially preferred, due to their rapid processablility and freedom from environmental pollution. Examples of aminopolycarboxylic acids and aminopolyphosphonic acids and salts thereof, which are useful for formation of organic complexes of iron(III), are set forth below.

Ethylenediaminetetraacetic Acid
Diethylenetriaminepentaacetic Acid
Ethylenediamine-n-(8-oxyethyl)-N,N',N'-triacetic Acid
1,2-Diaminopropanetetraacetic Acid
Triethylenetetraminehexaacetic Acid
Propylenediaminetetraacetic Acid
Nitrilotriacetic Acid
Nitrilotripropionic Acid
Cyclohexanediaminetetraacetic Acid
1,3-Diamino-2-propanoltetraacetic Acid
Methylimonodiacetic Acid
Iminodiacetic Acid
Hydroxylaminodiacetic Acid
Dihydroxyethylglycine-ethylether-diaminetetraacetic Acid
Glycolether-diaminetetraacetic Acid
Ethylenediaminetetrapropionic Acid
Ethylenediaminedipropionic Acid
Phenylenediaminetetraacetic Acid
2-Phosphonobutane-1,2,4-triacetic Acid
1,3-Diaminopropanol-N,N,N',N'-tetramethylenephosphonic Acid
Ethylenediamine-N,N,N',N'-tetramethylenephosphonic Acid
1,3-Propylenediamine-N,N,N',N'-tetramethylenephosphonic Acid 1-Hydroxyethylidene-1,1'-diphosphonic Acid Among these compounds, iron(III) complexes with ethylenediaminetetraacetic acid, diethylenetriaminepentaacetic acid, cyclohexanedimainetetraacetic acid, 1,2-diaminopropanetetraacetic acid or methyliminodiacetic acid are especially preferred as having a high bleaching capacity.

Regarding the iron(III) complexes, one or more ready-made iron(III) complexes can be used directly; or an iron(III) salt (for example, ferric sulfate, ferric chloride, ferric nitrate, ammonium ferric sulfate, ferric phosphate, etc.) and a chelating agent (for example, aminopolycarboxylic acids, aminopolyphosphonic acids, phosphonocarboxylic acids, etc.) may be reacted in a solution to form the corresponding ferric complex therein. In the latter case, where the complex is formed in a solution, one or both of the ferric salt and chelating agent may be used as a mixture of two or more thereof. In both cases of using a ready-made complex or forming the complex in a solution, the chelating agent can be used in an amount more than the stoichiometric amount thereof. Further, the above-mentioned ferric complex-containing bleaching solution or bleach-fixing solution can contain any metal ion other than iron, for example, calcium, magnesium, aluminium, nickel, bismuth, zinc, tungsten, cobalt, copper, etc., as well as complex salts thereof, or hydrogen peroxide.

Persulfates to be used for bleaching or bleach-fixation of the photographic materials of the present invention are alkali metal persulfates such as potassium persulfate or sodium persulfate as well as ammonium persulfate.

The bleaching solution or bleach-fixing solution can contain a re-halogenating agent, such as bromides (e.g., potassium bromide, sodium bromide, ammonium bromide), chlorides (e.g., potassium chloride, sodium chloride, ammonium chloride) or iodides (e.g., ammonium iodide). The solution may further contain, if desired, one or more inorganic acids, organic acids and alkali metal or ammonium salts thereof, which have a pH-buffering capacity, for example, boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., or a corrosion-inhibitor such as ammonium nitrate, guanidine, etc.

The amount of the bleaching agent in the bleaching solution is suitably from 0.1 to 2 mols per liter of the solution. The preferred pH range of the bleaching solution is from 0.5 to 8.0 for the case of ferric complexes, and from 4.0 to 7.0 in the case of using ferric complexes of aminopolycarboxylic acids, aminopolyphosphonic acids, phosphonocarboxylic acids or organic phosphonic acids. In the case of using persulfates, the concentration is preferably from 0.1 to 2 mols/liter and the pH range is preferably from 1 to 5.

The fixing agent to be used for fixation or bleach-fixation may be any and every known fixing agent. For example, water-soluble silver halide solvents, which include thiosulfates, such as sodium thiosulfate, ammonium thiosulfate, etc.; thiocyanates, such as sodium thiocyanate, ammonium thiocyanate, etc.; and thioether compounds and thioureas, such as ethylenebisthioglycolic acid, 3,6-dithia-1,8-octanediol, etc., can be used as the fixing agent, either singly or in the form of a mixture of two or more thereof. Further, in bleach fixation, a special bleach fixing solution comprising a combination of a fixing agent and a large amount of a halide such as potassium iodide, as described in Japanese Patent Application (OPI) No. 155354/80, can also be used.

In fixation or bleach-fixation, the concentration of the fixing agent is desirably from 0.2 to 4 mol/liter. In bleach-fixation, the content of the ferric complex in the bleach-fixing solution is desirably from 0.1 to 2 mols per liter of the solution and the content of the fixing agent therein is desirably from 0.2 to 4 mols per liter of the solution. The pH value of the fixing solution or bleach-fixing solution is preferably from 4.0 to 9.0, and more preferably from 5.0 to 8.0.

The fixing solution of the bleach-fixing solution can further contain, in addition to the above-mentioned additives for bleaching solution, sulfites (e.g., sodium sulfite, potassium sulfite, ammonium sulfite, etc.), bisulfites, hydroxylamine, hydrazine, aldehyde-bisulfite adducts (e.g., acetaldehyde sodium bisulfite, etc.), etc., as a preservative. In addition, various kinds of brightening agents, defoaming agents, and surfactants as well as organic solvents (such as polyvinyl pyrrolidone, metanol, etc.), can also be incorporated into the fixing solution.

A bleaching accelerator can optionally be incorporated into the bleaching solution or bleach-fixing solution, or in the pre-bath thereof. Examples of useful bleaching accelerators include the mercapto group- or disulfide group-containing compounds described in U.S. Pat. No. 3,893,858, West German Patent Nos. 1,290,812 and 2,059,988, Japanese Patent Application (OPI) No. 32736/78, 57831/78, 37418/78, 65732/78, 72623/78, 95630/78, 95631/78, 104232/78, 124424/78, 141623/78, and 28426/78, *Research Disclosure* (RD No. 17129), (July, 1978), etc.; the thiazolidine derivatives described in Japanese Patent Application (OPI) No. 140129/75, etc.; the thiourea derivatives described in Japanese Patent Publication No. 8506/70, Japanese Patent Application (OPI) Nos. 20832/77 and 32735/78, U.S. Pat. No. 3,706,561, etc.; the iodides described in West German Patent No. 1,127,715, Japanese Patent Application (OPI) No. 16235/83, etc.; the polyethylene oxides described in West German Patent Nos. 966,410 and 2,748,430, etc.; the polyamine compounds described in Japanese Patent Publication No. 8836/70, etc.; the compounds described in Japanese Patent Application (OPI) Nos. 42434/74, 59644/74, 94927/78, 35727/79, 26506/80, and 163940/83, etc., as well as iodide and bromide ions. The mercapto group- or disulfite group-containing compounds are particularly preferred, as they have a large accelerating effect, and in particular, the compounds described in U.S. Pat. No. 3,893,858, West German Patent No. 1,290,812 and Japanese Patent Application (OPI) No. 95630/78, are especially preferred.

In the practice of the present invention, the processing solutions are used at a temperature of from 10° C. to 50° C. Although the temperature range falling between 33° C. and 38° C. is standard, it is possible to elevate the processing temperature to accelerate the processing so as to shorten the processing time, or on the other hand, to lower the temperature to improve the quality of images formed or to improve the stability of the processing solutions used. For the purpose of economizing silver in the photographic materials, the cobalt intensifier or hydrogen peroxide intensifier described in West German Patent No. 2,226,770 and U.S. Pat. No. 3,674,499, or the combined development-bleaching-fixation mono-bath system described in U.S. Pat. No. 3,923,511, can be used.

The silver halide color photographic materials of the present invention are, after being desilverized as described above, generally subjected to rinsing in water and stabilization. However, these materials may be processed by a simple stabilization process only, without being subjected to a substantial rinsing-in-water process.

Known additives can be added to the rinsing water to be used in the rinsing-in-water step, if so desired. For example, chelating agents such as inorganic phosphoric acids, aminopolycarboxylic acids, organic phosphoric acids, etc.; bactericides and fungicides for preventing propagation of various bacteria and algae; hardening agents such as magnesium salts, aluminium salts, etc.; surfactants for preventing drying load or unevenness, etc. all can be used. Further, the compounds described in L. E. West, *Water Quality Criteria Photo. Sci. and Eng.*, Vol. 9, No. 6, pages 344 to 359 (1965), etc., can also be used.

The rinsing-in-water step can be carried out in two or more rinsing tanks, if desired. Further, a multistage countercurrent rinsing system (for example, comprising from 2 to 9 stages) can also be employed so as to economize and reduce the rinsing water to be used.

As the stabilizing solution for use in the stabilization step, there is a processing solution capable of stabilizing color images formed. For example, a processing solution with a pH of from 3 to 6, which has a buffering capacity, or a solution containing an aldehyde (e.g., formalin, etc.), or the like, can be used. The stabilizing solution may further contain, if desired, a brightening agent, a chelating agent, a bactericide, a fungicide, a hardening agent, a surfactant, etc.

The stabilization step can be carried out in two or more tanks, if desired, or a multistage countercurrent stabilization step (for example, comprising from 2 to 9 stages) can optionally be employed so as to economize and reduce the stabilizer solution to be used. Further, the rinsing-in-water step can be omitted.

In continuous processing, replenishers for the respective processing solutions can be added so as to prevent the fluctuation of the compositions of the respective solutions, whereby constantly finished films can be obtained. The amount of the replenisher to be added may be a half or less of the standard amount to be replenished, so as to reduce the processing cost.

The respective processing baths can be provided with a heater, a temperature sensor, a liquid level sensor, a circulating pump, a filter, a floating lid, a squeegee, a nitrogen stirrer, an air stirrer, etc., if desired.

The processing time can be made shorter than the standard time, if desired, for the purpose of accelerating the processing step, only if the shortened processing times does not interfere with the processing itself.

The silver halide color photographic material of the present invention can contain a color developing agent, or a precursor thereof, for the purpose of simplifying and accelerating the processing step. When the agent is incorporated into the photographic material, the precursor thereof is preferred in view of the maintenance of the stability of the materials. Examples of developing agent precursors include the indoaniline series compounds described in U.S. Pat. No. 3,342,597; the Shiff base type compounds described in U.S. Pat. No. 3,3421,599, *Research Disclosure* (RD No. 14850), (August, 1976), *Research Disclosure* (RD No. 15159), (November, 1976), etc.; the aldole compounds described in *Research Disclosure* (RD No. 13924), etc.; the metal complexes described in U.S. Pat. No. 3,719,492, etc.; the urethane series compounds described in Japanese Patent Application (OPI) No. 135628/78, etc. Furthermore, the various salt type precursors described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82, and 83565/82, etc., can also be used in the present invention.

The silver halide color photographic material of the present invention may further contain various kinds of 1-phenyl-3-pyrazolidones so as to accelerate the color development of the materials. specific compounds for this purpose are described in Japanese Patent Application (OPI) Nos. 64339/81, 144547/82, 211147/82, 50532/83, 50536/83, 50533/83, 50534/83, 50535/83, and 115438/83, etc.

In continuous processing, replenishers for the respective processing solutions can be added so as to prevent the fluctuation of the compositions of the respective solutions, whereby constantly finished films can be obtained. the amount of the replenisher to be added may be a half or less of the standard amount to be replenished, so as to reduce the processing cost.

The respective processing baths can be provided with a heater, a temperature sensor, a liquid level sensor, a circulating pump, a filter, a floating lid, a squeegee, etc., if desired.

The following examples are intended to illustrate the present invention but to limit it in any way.

REFERENTIAL EXAMPLE

In order to specifically demonstrate the function of the compounds of the present invention, an experiment to show the cleavage reaction of the compounds under the following conditions was performed. The results shown in the table below indicate that the matching of the image formation condition for the photographic materials containing the functional compound with the cleavage reaction condition for the functional compound in the material, results in a cleavage reaction of the functional compound in the photographic material under these conditions.

Compounds Tested:

Compound Nos. 1, 2, 3, 4, 5 and 6.

Method for Measurement:

Reaction Temperature: 40.0° C.

Reaction Solvent: Mixed solvent of Tetrahydrofuran/Britton-Robinson Buffer (pH 10.0) (3/2). After being fully degassed, the atmosphere was substituted with argon.

Compound of the Invention: $1.6\times10^{-4}$ mol/liter

Reducing Agent (S-46): $1.6\times10^{-3}$ mol/liter

The operation was carried out entirely in an argon atmosphere, and 1N-HCl was used for the termination of the reaction, whereupon the pH value of the reaction solution was made to be 5.0.

Means for measurement:

A high performance liquid chromatography was used, in which an acetonitrile/water system (containing acetic acid/triethylamide, 2%) was used as an eluent.

The results obtained by the measurements are shown in the table below.

| Compound No. of the invention | Decreasing Rate of the Compound log k (t ½ sec) | Releasing Rate of Brightening Agent log k (t ½ sec) |
|---|---|---|
| 1 | 2.25 (123) | 2.28 (132) |
| 2 | 2.43 (187) | 2.39 (170) |
| 3 | 1.87 (51) | 1.88 (53) |
| 4 | 1.98 (66) | 2.00 (69) |
| 5 | 2.80 (437) | 2.87 (469) |
| 6 | 3.88 (5258) | 4.07 (8144) |

Compound No. 1 of the invention was dissolved in a mixed solvent of methyl ethyl ketone/methanol (1/1, by weight) and dispersed in a 5% gelatin solution, and the resulting dispersion was coated on a resin-coated paper (for photographic paper) in an amount of $1\times10^{-3}$ mol/m$^2$ to prepare Sample No. 1. Compound (a*) (shown below) to be obtained by cleavage of Compound No. 1 was also disposed in a 5% gelatin solution in the same manner, and this was also coated on a resin-coated paper of the same kind in an amount of $1\times10^{-3}$ mol/m$^2$ to prepare Sample No. 2. On the other hand, Sample No. 3 was prepared in the same manner as above, except that Compound No. 1 of the invention or Compound (a*) was not used, but gelatin was coated on a resin-coated paper of the same kind in the same manner.

The spectral reflectivity of each of Sample Nos. 1, 2 and 3 was measured using a xenon lamp as a light source in Color Analyzer 307 Type (by Hitachi, Ltd.). The results obtained are shown in FIG. 1, in which curve (A) indicates Sample No. 3, curve (1) indicates Sample No. 1 and curve (2) indicates Sample No. 2.

As can be seen from the results shown in FIG. 1, Compound No. 1 of the invention may strongly absorb ultraviolet ray but has a weak brightening ability, while on the other hand, Compound (a*) has a strong brightening ability.

Compound (a*):

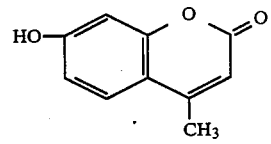

EXAMPLE 2

Compound (a*) of the invention and Reducing Agent (S-46) were dispersed in a hydrophilic colloid together with a coupler of an ultraviolet absorbent, and the resulting dispersion was used for the purpose of incorporating the compound of the invention into emulsion layers of interlayers. Table 1 below shows the compositions of the constituting layers of various photographic material samples. As a hardening agent 1,3-bisvinylsulfo-2-propanol was used, and this was added to the protective layer so as to harden the respective emulsion layers and to give sufficient interlayer adhesion in the materials.

The silver halide emulsions used herein were prepared in accordance with the description of Examples 2 and 4 in Japanese Patent Application (OPI) No. 215141/86.

Thus, Sample Nos. 101, 102 and 103 of the present invention and Comparative Sample B were prepared having the composition as shown in Table 1 below.

TABLE 1

| Layer | Main Composition | Sample B | Sample 101 | Sample 102 | Sample 103 |
|---|---|---|---|---|---|
| 7th Layer (Protective Layer) | Gelatin | 1.33 g/m$^2$ | Same as Sample B | Same as Sample B | Same as Sample B |
| | Acryl-modified Copolymer of Polyvinyl Alcohol (Modification Degree 17%) | 0.17 g/m$^2$ | Same as Sample B | Same as Sample B | Same as Sample B |
| | Hardening Agent | 0.05 g/m$^2$ | Same as Sample B | Same as Sample B | Same as Sample B |
| 6th Layer (UV Absorbing Layer) | Gelatin | 0.54 g/m$^2$ | 0.54 g/m$^2$ | 0.54 g/m$^2$ | 0.54 g/m$^2$ |
| | UV Absorbent (k) | 0.11 g/m$^2$ | 0.06 g/m$^2$ | 0.06 g/m$^2$ | 0.06 g/m$^2$ |
| | Solvent (m) | 0.09 cc/m$^2$ | 0.09 cc/m$^2$ | 0.09 cc/m$^2$ | 0.09 cc/m$^2$ |
| 5th Layer (Red-sensitive Layer) | Silver Halide Emulsion (2) Spectrally Sensitized with Red-sensitizing Dye (c) | 0.22 g/m$^2$ as Ag | Same as Sample B | Same as Sample B | Same as Sample B |
| | Gelatin | 0.90 g/m$^2$ | Same as Sample B | Same as Sample B | Same as Sample B |
| | Cyan Coupler (n) | 0.36 g/m$^2$ | Same as Sample B | Same as Sample B | Same as Sample B |
| | Color Image Stabilizer (o) | 0.17 g/m$^2$ | Same as Sample B | Same as Sample B | Same as Sample B |
| | Solvent (f) | 0.22 cc/m$^2$ | Same as Sample B | Same as Sample B | Same as Sample B |
| | Compound (9) | — | 0.20 g/m$^2$ | — | 0.10 g/m$^2$ |
| | Reducing Agent S-46 | — | — | — | 0.05 g/m$^2$ |
| 4th Layer (UV Absorbing Layer) | Gelatin | 1.60 g/m$^2$ | Same as Sample B | 1.60 g/m$^2$ | Same as Sample 102 |
| | UV-Absorbent (k) | 0.62 g/m$^2$ | Same as Sample B | 0.30 g/m$^2$ | Same as Sample 102 |
| | Color Mixing Preventing Agent (l) | 0.05 g/m$^2$ | Same as Sample B | 0.05 g/m$^2$ | Same as Sample 102 |
| | Solvent (m) | 0.26 cc/m$^2$ | Same as Sample B | 0.26 cc/m$^2$ | Same as Sample 102 |
| | Compound (9) | — | — | 0.10 g/m$^2$ | 0.10 g/m$^2$ |
| | Reducing Agent S-46 | — | — | 0.10 g/m$^2$ | 0.10 g/m$^2$ |
| 3rd Layer | Silver Halide Emulsion (3) Spectrally | 0.15 g/m$^2$ | Same as | Same as | Same as |

TABLE 1-continued

| Layer | Main Composition | Sample B | Sample 101 | Sample 102 | Sample 103 |
|---|---|---|---|---|---|
| (Green-sensitive Layer) | Sensitized with Green-sensitizing Dye (b) | as Ag | Sample B | Sample B | Sample B |
| | Gelatin | 1.80 g/m$^2$ | Same as Sample B | Same as Sample B | Same as Sample B |
| | Magenta Coupler (h) | 0.38 g/m$^2$ | Same as Sample B | Same as Sample B | Same as Sample B |
| | Color Image Stabilizer (i) | 0.16 g/m$^2$ | Same as Sample B | Same as Sample B | Same as Sample B |
| | Solvent (j) | 0.38 cc/m$^2$ | Same as Sample B | Same as Sample B | Same as Sample B |
| | Compound (9) | — | — | 0.10 g/m$^2$ | Same as Sample B |
| | Reducing Agent S-46 | — | — | 0.10 g/m$^2$ | Same as Sample B |
| 2nd Layer (Color Mixing Preventing Layer) | Gelatin | 0.99 g/m$^2$ | Same as Sample B | Same as Sample B | Same as Sample B |
| | Color Mixing Preventing Agent (g) | 0.08 g/m$^2$ | Same as Sample B | Same as Sample B | Same as Sample B |
| 1st Layer (Blue-sensitive Layer) | Silver Halide Emulsion (5) Spectrally Sensitized with Blue-sensitizing dye (a) | 0.26 g/m$^2$ as Ag | Same as Sample B | Same as Sample B | Same as Sample B |
| | Gelatin | 1.83 g/m$^2$ | Same as Sample B | Same as Sample B | Same as Sample B |
| | Yellow Coupler (d) | 0.91 g/m$^2$ | Same as Sample B | Same as Sample B | Same as Sample B |
| | Color Image Stabilizer (e) | 0.19 g/m$^2$ | Same as Sample B | Same as Sample B | Same as Sample B |
| | Solvent (f) | 0.36 cc/m$^2$ | Same as Sample B | Same as Sample B | Same as Sample B |
| | Compound (9) | — | — | — | 0.05 g/m$^2$ |
| | Reducing Agent S-46 | — | — | — | 0.05 g/m$^2$ |
| Subbing Layer on Support | Gelatin | 0.15 g/m$^2$ | Same as Sample B | Same as Sample B | Same as Sample B |
| | Hardening Agent | 0.02 g/m$^2$ | Same as Sample B | Same as Sample B | Same as Sample B |

The Compounds used above were as follows:

Blue-sensitizing Dye (a):

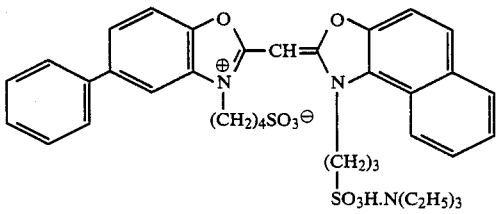

Green-sensitizing Dye (b):

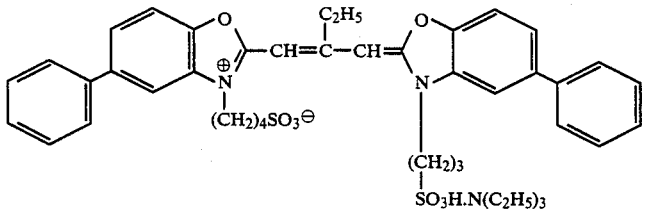

Red-sensitizing Dye (c):

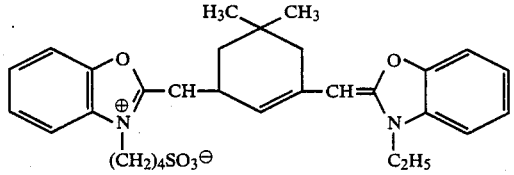

Yellow Coupler (d):

-continued
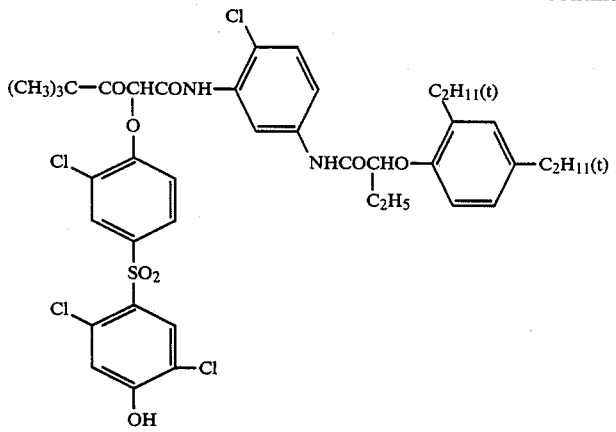
Color Image Stabilizer (e):
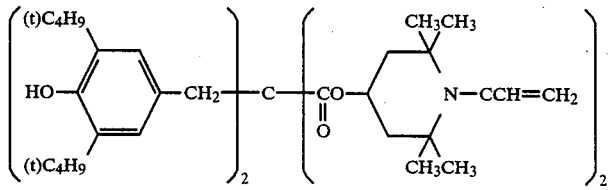
Solvent (f):
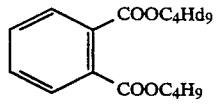
Color Mixing Preventing Agent (g):
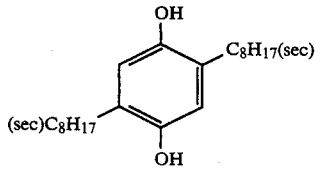
Magenta Coupler (h):
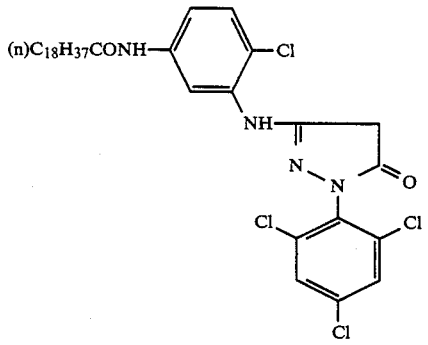
Color Image Stabilizer (i):
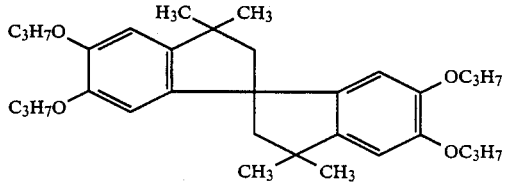
Solvent (j):

-continued
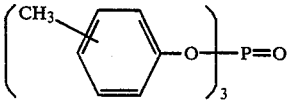
UV Absorbent (k):
Mixture (1/5/3, by mol) of the following compounds
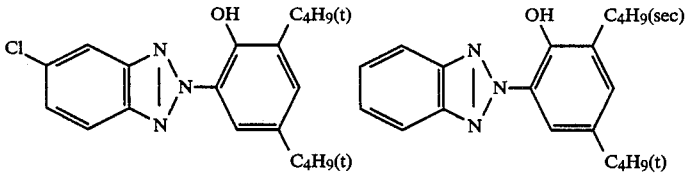
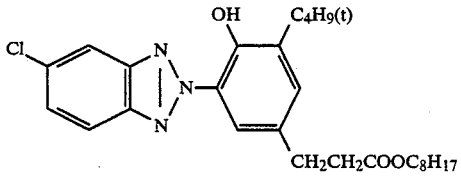
Color Mixing Preventing Agent (l):
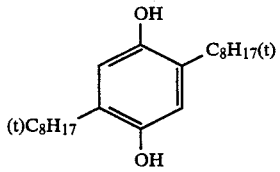
Solvent (m):
$(isoC_9H_{18}O)_3P{=}O$
Cyan Coupler (n):
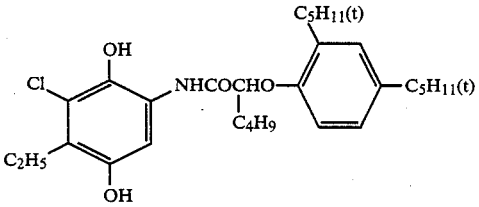
Color Image Stabilizer (o):
Mixture (1/3/3, by mole) of the following compounds
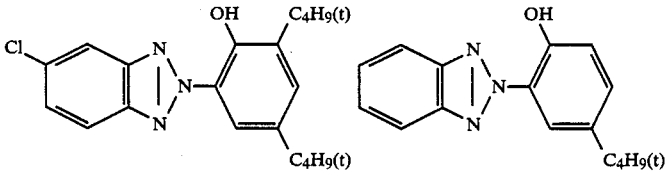
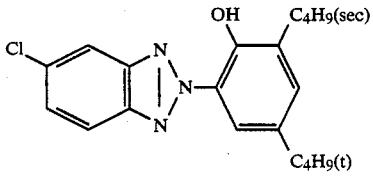
Magenta Coupler (p):

-continued

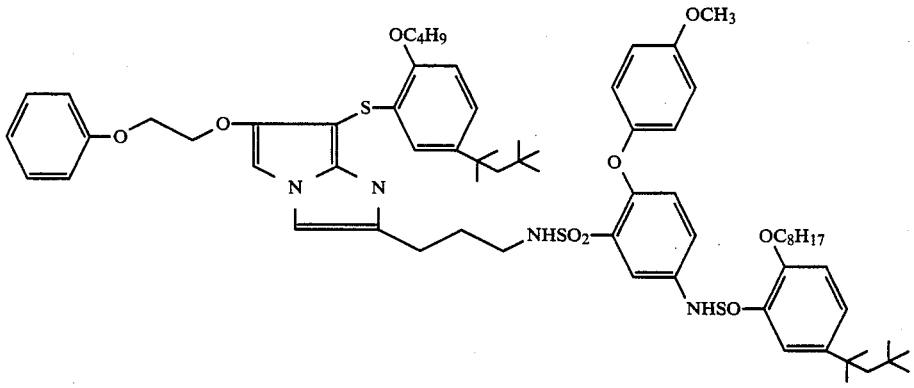

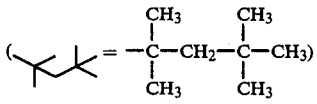

Cyan Coupler (g):

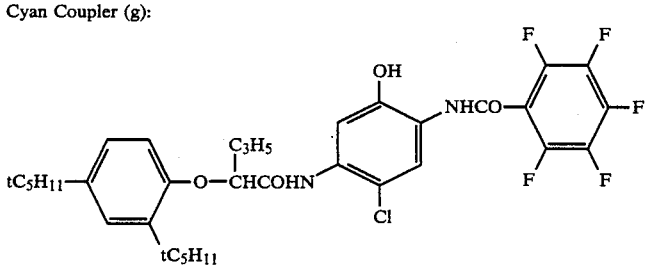

The samples thus prepared were left under the conditions of a relative humidity of 60% and a room temperature of 23° C.±2° C. for 6 days. Sample B, Sample 101, Sample 102 and Sample 103, were cut into strips and wedgewise exposed to a white light source of 2854° K. through a white filter and a three color-separation filter.

Next, the thus exposed samples were color-developed as follows:

| | | | |
|---|---|---|---|
| Development | Process (A) | 35° C. | 45 sec |
| Bleach-fixation | Process (A) | 35° C. | 45 sec |
| Rinsing | Process (A) | 28–35° C. | 1 min 30 sec |

The processing solutions used were as follows:

Color Developer (A):

Water 800 cc
Diethylenetriaminepentaacetic acid 1.0 g
Sodium sulfite 0.2 g
N,N-diethylenehydroxylamine 4.2 g
Potassium bromide 0.6 g
Sodium chloride 1.5 g
Triethanolamine 8.0 g
Potassium carbonate 30 g
N-Ethyl-N-(β-methanesulfonamidoethyl)-3-methyl-4-aminoaniline sulfate 4.5 g
Water to make 1000 cc
KOH to make pH 10.8

Blix Solution for (A):

Ammonium thiosulfate (54 wt %) 150 ml
$Na_2SO_3$ 15 g
$NH_4[Fe(III)(EDTA)]$ 55 g
EDTA.2Na 4 g
Glacial acetic acid 8.61 g
Water to make 1000 ml (pH 5.4)

Rinsing Solution for (A):

EDTA.2Na.$2H_2O$ 0.4 g
Water to make 1000 ml (pH 7.0)

The whiteness attained in the strips of Samples 101, 102 and 103 was superior to that in the strips of Comparative Sample B. The gray density in the non-image part was measured with a desensitometer, and the results were as follows:

TABLE 2

| Sample | Optical Density (Non-image Part) |
|---|---|
| B | 0.14 |
| 101 | 0.12 |
| 102 | 0.10 |
| 103 | 0.09 |

EXAMPLE 3

A silver chlorobromide emulsion layer (halogen composition: AgCl 67%, mean grain size: 0.4 μ) for photographic paper was coated on Support A formed by coating a subbing layer on a photographic WP paper, and a protective layer was superimposed thereover. Compound No. 4 of the invention was incorporated into the silver chlorobromide emulsion layer in an amount of 0.20 g/m². The amount of the silver coated was 2.1 g/m². The photographic material sample thus prepared was designated as Sample 104, and this was exposed through a negative film original and then developed in D-72 Developer (½ diluted) for 2 minutes and fixed and rinsed in water.

In the same manner as above, the same light-sensitive layer (but not containing Compound No. 4) and the same protective layer were coated on Support A in layer, to obtain Sample C. Sample C was exposed in the same manner through a negative film original and then processed also in the same manner as above. Thus strips were obtained.

In the photograph obtained from Sample 104, the whiteness in the non-image part was better than that obtained from Comparative Sample C, and the former Sample 104 gave a cold tone silver image.

TABLE 3

| Sample | Optical Density (Non-image Part) |
|---|---|
| C | 0.12 |
| 104 | 0.08 |

EXAMPLE 4

A light-shielding layer containing carbon black and a backing layer containing titanium white were coated on the back surface of a polyethylene terephthalate support containing titanium white pigment.

A subbing layer was further coated on the support, and then plural layers, each having the composition described below, were formed thereon.

The subbing layer has a three layer constitution as set forth below.

(1) A neutralization layer containing acrylic acid/butyl acrylate (8/2, by mol) copolymer having a mean molecular weight of 50,000, in an amount of 22 g/m$^2$.

(2) A neutralization timing layer containing a mixture (95/5, by weight) of cellulose acetate having an acetylation degree of 51.3% and styrene-maleic anhydride (1/1, by mol) copolymer having a molecular weight of about 10,000, in an amount of 4.5 g/m$^2$.

(3) A layer containing a mixture formed by blending (A) a polymer latex formed by emulsion-polymerization of styrene-butyl acrylate-acrylic acid-N-methylolacrylamide (47.7/42.3/4/4, by weight) and (B) a polymer latex formed by emulsion-polymerization of methyl methacrylate-acrylic acid-N-methylolacrylamide (93/3/4, by weight), the ratio of (A)/(B) as solids content being 6/4, in an amount of 1.6 g/m$^2$ as total solids content.

First Layer: Mordant Layer

Acid-processed gelatin 3.0 g/m$^2$
Polymer latex mordant agent shown below 3.0 g/m$^2$

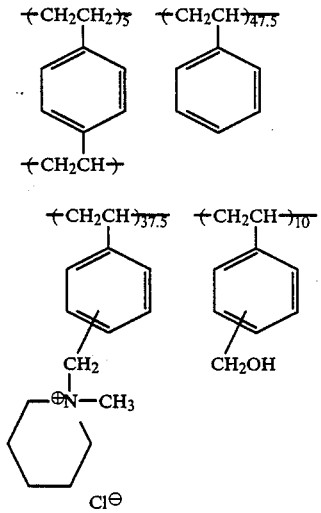

Second Layer: First Release Layer

Gelatin 0.6 g/m$^2$

Third Layer: Second Release Layer

Hydroxyethyl cellulose 0.6 g/m$^2$

Fourth Layer: Third Release layer

Gelatin 0.27 g/m$^2$
Colloidal silica (mean grain size: 0.01 μm) 0.3 g/m$^2$

Fifth Layer: DRR Layer

Gelatin 0.8 g/m$^2$
Cyan dye-releasing redox compound shown below 0.44 g/m$^2$

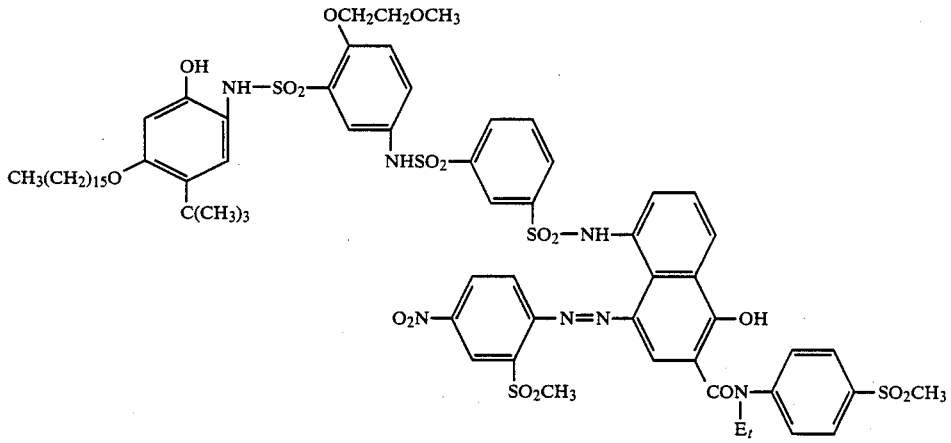

Tricyclohexyl phosphate 0.09 g/m$^2$
2,5-Di-t-pentadecylhydroquinone 0.08 g/m$^2$ Sixth Layer: Red-sensitive Emulsion Layer Gelatin 1.2 g/m$^2$
Red-sensitive internal direct positive silver bromide emulsion 0.03 g/m$^2$ as Ag
Nucleating agent shown below 0.04 g/m$^2$

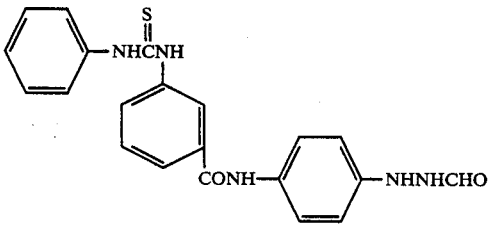

2-Sulfo-5-n-pentadecylhydroquinone sodium salt 0.13 g/m²

Seventh Layer: Interlayer

Gelatin 0.4 g/m²
2,5-Di-t-pentadecylhydroquinone 0.43 g/m²
Trihexyl phosphate 0.1 g/m²

Eighth Layer: DRR Layer

Gelatin 0.9 g/m²
Magenta dye-releasing redox compound having structural formula (I) below 0.21 g/m²
Magenta dye-releasing redox compound having structural formula (II) below 0.11 g/m²
Tricyclohexyl phosphate 0.08 g/m²
2,5-Di-t-pentadecylhydroquinone 0.009 g/m²

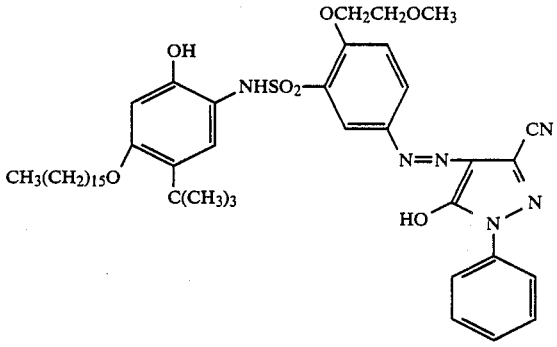

Tricyclohexyl phosphate 0.13 g/m²
2,5-Di-t-pentadecylhydroquinone 0.01 g/m²

Twelfth Layer: Blue-sensitive Emulsion Layer

Gelatin 1.1 g/m²
Blue-sensitive internal direct positive silver bromide emulsion 1.09 g/m² as Ag
Nucleating agent (same as 6th layer) 0.04 g/m²
2-Sulfo-5-n-pentadecylhydroquinone sodium salt 0.07 g/m²

Thirteenth Layer: Interlayer (I):

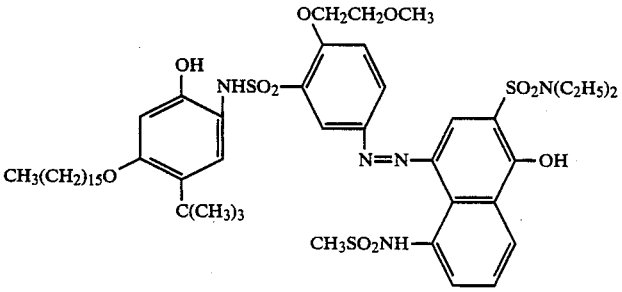

(II):

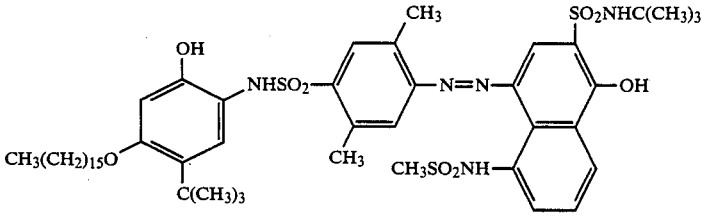

Gelatin 1.0 g/m²

Ninth Layer: Green-sensitive Emulsion Layer

Gelatin 0.9 g/m²
Green-sensitive internal direct positive silver bromide emulsion 0.82 g/m² as Ag
Nucleating agent (same as 6th layer) 0.03 g/m²
2-Sulfo-5-n-pentadecylhydroquinone sodium salt 0.08 g/m²

Tenth Layer: Interlayer

Same as Seventh Layer

Eleventh Layer: DRR Layer

Gelatin 0.7 g/m²
Yellow dye-releasing redox compound shown below 0.53 g/m²

Cover sheet:

The following layers (1) to (4), were coated on a transparent polyethylene terephthalate support.

(1) A layer containing acrylic acid/butyl acrylate (80/20, by weight) copolymer (11 g/m²) and 1,4-bis(2,3-epoxypropoxy)butane (0.22 g/m²).

(2) A layer containing acetyl cellulose (which produces 36.6 g of acetyl group when 100 g of the acetyl cellulose is hydrolyzed) (4.3 g/m²); methanol-ring opened product of styrene-maleic anhydride (60/40, by weight) copolymer (molecular weight, about 50,000) (0.23 g/m²) and 5-(2-cyano-1-methylthio)-1-phenyltetrazole (2.6 mmol/m²).

(3) A layer comprising a copolymer latex of styrene-n-butyl acrylate-acrylic acid-N-methylolacrylamide (49.7/42.3/3/5, by weight) and a copolymer latex of methyl methacrylate-acrylic acid-N-methylolacrylamide (93/4/3, by weight), the solids ratio of the former to the latter being 6/4. The thickness of the layer coated was 2μ.

(4) A layer containing gelatin (1.5 g/m²).

1,3-Bisvinylsulfonyl-2-propanol was used for the hardening of gelatin.

The processing solution as mentioned below was filled in a processing pod.

Figure 2:
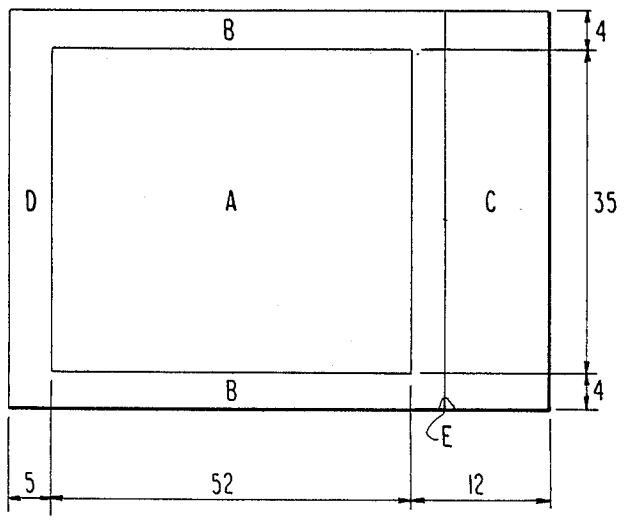
FIG. 2 shows the arrangement of a combined instant photographic unit as set forth in Example 4, where the size is represented by a unit of mm. A denotes an image region, B denotes a rail region, C denotes a processing pod region, D denotes a liquid reservoir region, and E denotes perforations and notches.

The above-mentioned photographic element, cover sheet and processing pod were combined as shown in FIG. 2, to form a combined instant photographic unit. This unit was designated as Sample E. Next, the compounds of the present invention were added to this, as described in the following table, to prepare Samples 105, 106 and 107.

| Layer | Sample 105 Compound | Sample 105 Amount added (g/m²) | Sample 106 Compound | Sample 106 Amount added (g/m²) | Sample 107 Compound | Sample 107 Amount Added (g/m²) |
|---|---|---|---|---|---|---|
| 5th Layer | Reducing Agent S-46 | 0.08 | Reducing Agent S-46 | 0.08 | Reducing Agent S-46 | 0.08 |
| | Compound (5) | 0.10 | Compound (5) | 0.10 | Compound (5) | 0.10 |
| 6th Layer | — | — | Compound (5) | 0.10 | — | — |
| 8th Layer | Reducing Agent S-46 | 0.10 | Reducing Agent S-46 | 0.10 | Reducing Agent S-46 | 0.10 |
| | Compound (5) | 0.10 | Compound (5) | 0.10 | Compound (5) | 0.10 |
| 9th Layer | — | — | Compound (5) | 0.10 | — | — |
| 11th Layer | — | — | — | — | Reducing Agent S-46 | 0.08 |
| | | | | | Compound (5) | 0.10 |
| 12th Layer | — | — | — | — | Compound (5) | 0.05 |

The film unit thus formed was set in an instant photographic camera (manufactured by Fuji Photo Film Co., Ltd.) and exposed through the cover sheet and then passed between a pair of rollers whereby the processing solution filled in the processing pod was uniformly spread between the photographic element and the cover sheet and the element was developed.

The processing solution used comprised the following ingredients.

1-p-Tolyl-4-hydroxymethyl-4-methyl-3-pyrazolidone 6.9 g
Methylhydroquinone 0.3 g
5-Methylbenzotriazole 3.5 g
Sodium sulfite (anhydride) 0.2 g
Sodium carboxymethyl cellulose 58 g
Potassium hydroxide (28 wt % aqueous solution) 200 cc
Benzyl alcohol 1.5 cc
Carbon black 150 g
Water 685 cc Two minutes after development, the E part of the film unit (see, FIG. 2) was strongly bent and the image part on the support was released from the pod part and the cover sheet part via the E part, while the C part was suppressed, whereby the second release layer was released and a photograph as printed on the thin support was obtained.

The whiteness of the background in each of the film unit Sample 105, 106 and 107 was higher than that in the comparative film unit, Sample E. The optical density of the white background part in each sample was as follows:

TABLE 5

| Sample | Blue Filter Density |
|---|---|
| E | 0.16 |
| 105 | 0.14 |
| 106 | 0.12 |

TABLE 5-continued

| Sample | Blue Filter Density |
|---|---|
| 107 | 0.13 |

In place of Compound No. 5 of the present invention, other Compound Nos. 2, 12, 22, 23, 40, 41, 51, 56, 58, 59, 65, 79, etc. were used in the same manner and the same results were obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one silver halide emulsion layer on a support, comprising a compound of formula (I):

$$\text{PWR—(Time)}_t\text{—FWA} \qquad \text{(I)}$$

wherein PWR represents a group capable of releasing $(\text{Time})_t$—FWA upon reduction; FWA represents a group which functions as a brightening agent; Time represents a group capable of releasing FWA through a reaction which follows the release of $(\text{Time})_t$—FWA from PWR; and t represents an integer of 0 to 1, wherein said compound of formula (I) does not itself emit or only weakly emits a fluorescent light, and wherein the brightening agent released from the compound of formula (I) strongly emits a fluorescent light.

2. A silver halide photographic material as in claim 1, wherein the compound of formula (I) is represented by formula (II):

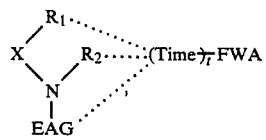

(II)

wherein X represents an oxygen atom, a sulfur atom or a nitrogen-containing group of formula —N($R_3$)—; $R_1$, $R_2$, and $R_3$ each represents a mere bond or a group other than a hydrogen atom; EAG represents an electron accepting group; or $R_1$, $R_2$, $R_3$ and EAG are connected to each other to form a ring; Time represents a group capable of releasing FWA upon cleavage of the N—X bond through a reaction subsequent to the release from the rest of the compound in the form of —$(\text{Time})_t$FWA; when t is 0, Time represents a mere bond; and the dotted lines represent possible bonds, provided that at least one dotted line is a bond; and FWA and t are as defined in claim 1.

3. A silver halide photographic material as in claim 2, wherein the compound of formula (II) is represented by formula (III);

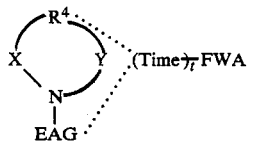

(III)

wherein Y represents a divalent linking group; $R_4$ represents an atomic group forming a 5-membered to 8-membered nitrogen-containing monocyclic or condensed heterocyclic ring together with X and Y; and X, EAG, Time, t, FWA and the dotted lines are as defined in claim 2.

4. A silver halide photographic material as in claim 3, wherein X represents an oxygen atom.

5. A silver halide photographic material as in claim 3, wherein Y represents —C— or —$SO_2$—.

6. A silver halide photographic material as in claim 3, wherein EAG represents an aryl or heterocyclic group substituted with at least one electron accepting group.

7. A silver halide photographic material as in claim 1, further comprising a reducing substance having an oxidation potential of at most 0.8 volt.

8. A silver halide photographic material as in claim 7, further comprising an electron transport agent.

9. A silver halide photographic material as in claim 1, wherein the silver halide emulsion layer comprises silver halide grins having a gain size of from 0.01μ to 4.0μ.

10. A silver halide photographic material as in claim 1, further comprising at least one color coupler.

11. A silver halide photographic material as in claim 1, wherein FWA is a coumarin series brightening agent.

12. A silver halide photographic material as in claim 11, wherein FWA is bonded to Time, or to PWR when T=0, at the 7-position of the coumarin moiety.

13. A silver halide photographic material as in claim 1, wherein the compound of formula (I) is incorporated into the silver halide emulsion layer.

14. A method for forming an image in a silver halide photographic material having at least one silver halide emulsion layer on a support, comprising:

providing a silver halide photographic material which contains a compound of formula (I):

$$PWR—(Time)_t—FWA \quad (I)$$

wherein PWR represents a group capable of releasing $(Time)_t$—FWA upon reduction; FWA represents a group which functions as a brightening agent; Time represents a group capable of releasing FWA through a reaction which follows the release of $(Time)_t$—FWA from PWR; and t represents an integer of 0 to 1, wherein said compound of formula (I) does not itself emit or only weakly emits a fluorescent light, and wherein the brightening agent released from the compound of formula (I) strongly emits a fluorescent light, developing the silver halide after imagewise exposure, and releasing FWA counter-corresponding to the development of silver halide.

* * * * *